US011554080B2

(12) United States Patent
Miyazaki

(10) Patent No.: US 11,554,080 B2
(45) Date of Patent: Jan. 17, 2023

(54) KIT PREPARATION AND DOSE ADJUSTMENT METHOD

(71) Applicant: Futoshi Miyazaki, Tokyo (JP)

(72) Inventor: Futoshi Miyazaki, Tokyo (JP)

( * ) Notice: Subject to any disclaimer, the term of this patent is extended or adjusted under 35 U.S.C. 154(b) by 323 days.

(21) Appl. No.: 15/755,749

(22) PCT Filed: Sep. 2, 2016

(86) PCT No.: PCT/JP2016/075744
§ 371 (c)(1),
(2) Date: Feb. 27, 2018

(87) PCT Pub. No.: WO2017/038959
PCT Pub. Date: Mar. 9, 2017

(65) Prior Publication Data

US 2018/0280239 A1 Oct. 4, 2018

(30) Foreign Application Priority Data

Sep. 3, 2015 (JP) ..... JP2015-174081

(51) Int. Cl.
*A61J 1/20* (2006.01)
*A61J 1/05* (2006.01)
(Continued)

(52) U.S. Cl.
CPC ..... *A61J 1/2093* (2013.01); *A61J 1/05* (2013.01); *A61J 1/10* (2013.01); *A61J 1/1406* (2013.01);
(Continued)

(58) Field of Classification Search
CPC .... A61J 1/05; A61J 1/10; A61J 1/2093; A61J 1/00; A61J 1/201; A61J 1/06; A61J 1/067;
(Continued)

(56) References Cited

U.S. PATENT DOCUMENTS 4,994,057 A 2/1991 Carmen et al.
5,267,646 A * 12/1993 Inoue ..... A61J 1/2093 206/204
(Continued)

FOREIGN PATENT DOCUMENTS

EP 1838272 A1 10/2007
JP H07-171198 A 7/1995
(Continued)

OTHER PUBLICATIONS

International Search Report to Corresponding International appl.: PCT/JP2016/075744, dated Nov. 8, 2016, pages.
(Continued)

*Primary Examiner* — Benjamin J Klein
(74) *Attorney, Agent, or Firm* — Ronald M. Kachmarik; Cooper Legal Group LLC

(57) ABSTRACT

A kit preparation that enables drug dose adjustment. The kit preparation includes a bag which contains an infusion solution or pure water and at least one drug enclosing part in which a drug is enclosed and which is provided with a sealing part. The drug enclosing part is connected to the bag via the sealing part; and, when the sealing part is released, the bag is communicated with the drug enclosing part and thus the drug is poured into the bag so that a dispensing work can be carried out.

11 Claims, 36 Drawing Sheets

(51) Int. Cl.
*A61J 3/00* (2006.01)
*A61J 1/10* (2006.01)
*A61J 1/14* (2006.01)

(52) U.S. Cl.
CPC ..... *A61J 1/201* (2015.05); *A61J 1/2096* (2013.01); *A61J 3/00* (2013.01)

(58) Field of Classification Search
CPC .. A61J 1/202; A61J 1/22; A61J 1/1406; A61J 1/2096; A61J 3/00
See application file for complete search history.

(56) References Cited

U.S. PATENT DOCUMENTS

| | | | | |
|---|---|---|---|---|
| 2014/0346071 | A1* | 11/2014 | Genosar ..... | A61J 1/067 206/438 |
| 2018/0280239 | A1 | 10/2018 | Miyazaki | |

FOREIGN PATENT DOCUMENTS

| | | | | |
|---|---|---|---|---|
| JP | H10-108893 | A | 4/1998 | |
| JP | 2001-299910 | | 10/2001 | |
| JP | 2001-524353 | | 12/2001 | |
| JP | 2003-220116 | | 8/2003 | |
| JP | 2004-290217 | | 10/2004 | |
| JP | 2005-067730 | A | 3/2005 | |
| JP | 2006-111532 | | 4/2006 | |
| JP | 2006-175212 | A | 7/2006 | |
| JP | 2006-230445 | | 9/2006 | |
| JP | 2008-539142 | | 11/2008 | |
| JP | 2011-103953 | A | 6/2011 | |
| JP | 2014-217555 | A | 11/2014 | |
| WO | 1999027885 | A1 | 6/1999 | |
| WO | WO-9927885 | A1 * | 6/1999 | ..... A61J 1/2093 |
| WO | 2005/025482 | A1 | 3/2005 | |
| WO | 2006057442 | A1 | 6/2006 | |
| WO | 2006118697 | | 11/2006 | |
| WO | 2017038959 | A1 | 6/2018 | |

OTHER PUBLICATIONS

"Comparison of surface contamination with cyclophosphamide and fluorouracil using a closed-system drug transfer device versus standard preparation techniques" Harrison et al. American Journal of Health-System Pharmacy, vol. 63, Sep. 15, 2006; 1736-1744.
"Surface contamination with antineoplastic agents in six cancer treatment centers in Canada and the United States" Connor et al. American Journal of Health-System Pharmacy vol. 56, Jul. 15, 1999; 1427-32.
"Cancer risk assesment for health care workers occupationally exposed to cyclophosphamide" Sessink et al. Int Arch Occup Environ Health. 1995; 67: 317-23; Received Jul. 29, 1994/Accepted Mar. 15, 1995.
"C1 Directive 2004/37/EC of the European Parliament and of the Council of Apr. 29, 2004 on the protection of workers from the risk related to exposure to carcinogens or mutagens at work"; (OJ L 158, Apr. 30, 2004, p. 50).
"Examination of safety improvement upon preparation of anti-cancer agent using two-connected closed system transfer devices" Proceedings of The Annual Meeting of the Japanese Society of Pharmaceutical Health Care and Sciences 21, 227, Sep. 9, 2011; P-0275; with Eng Translation.
Pallet vol. 57, dated Nov. 20, 2006 with partial Eng Translation.
Supplementary European Search Report for corresponding EP application No. 16841988, dated Apr. 17, 2019, 2 pages.
Corresponding Japanese Application No. 2019-080567, Japanese Office action dated Nov. 4, 2020.
Corresponding Japanese Application No. 2019-080567, Japanese Office action dated Feb. 7, 2020.
Corresponding Japanese Application No. 2017-538121, Japanese Office action dated Jun. 27, 2018.
Corresponding Japanese Application No. 2017-538121, Japanese Office action dated Jan. 21, 2019.
Corresponding European Application No. 16841988.5, European Office action dated Dec. 18, 2019.
Corresponding European Application No. 16841988.5, European Office action dated Aug. 31, 2020.
Corresponding European Application No. 16841988.5, European Summons to attend oral proceedings dated Jul. 29, 2021.
Toshiaki Nakayama et al., "Nutrition Therapy for Cancer Patients and Peripheral Problems Advances in medical devices for patients undergoing cancer chemotherapy (From a nutritional point of view) *", Parenteral and Enteral Nutrition, 2013, p. 47(635)-p. 56(644), vol. 28, No. 2, Department of Hospital Pharmacy, Saitama Cancer Center.
Hiroyuki Hayashi, Chapter 3 Intravenous nutrition, 2. Total parenteral nutrition (TPN), 17. TPN Infusion Preparation Method, Oct. 20, 2015, 2001-2011, p. 1-p. 4.
Hiroyuki Hayashi, Chapters Intravenous nutrition, 2. Total parenteral nutrition (TPN), 17. TPN Infusion Preparation Method, Aug. 20, 2018, 2001-2011, p. 1-p. 4.
Kenji Tezuka, "About kit products", Pharmaceutics, 75 (4), 240-243 (2015).
Guidelines for Occupational Exposure Control in Cancer Pharmacotherapy, 2019 Edition, pp. 56-58.

* cited by examiner

KIT PREPARATION AND DOSE ADJUSTMENT METHOD

TECHNICAL FIELD

The present invention relates to a kit product and a dose adjustment method.

BACKGROUND ART

Medical intravenous drip infusion (hereinafter referred to as intravenous drip) has been known as a method for directly administering drugs to human body in the medical art (e.g., see PTL 1). In the intravenous drip, a drug liquid filled in, for example, a bag is administered to human body via an injection needle inserted into the vein of a patient. In the intravenous drip, a drug liquid, which has been prepared, needs to be filled into the bag.

For example, when the intravenous drip is used for administrating anti-cancer drugs, it has been pointed out that many of medical practitioners are exposed to a risk of developing cancer through exposure to the anti-cancer agents. This is due to the following reasons:

(1) Many of the anti-cancer agents are cytotoxic (carcinogenic);

(2) Routine procedure causes exposure to the anti-cancer agents;

(3) Carcinogenicity can be predicted from the exposure to the anti-cancer agents upon drug preparation (e.g., see NPLs 1, 2, and 3); and (4) Sufferers from the exposure to the anti-cancer agents are not limited to the people in charge of drug preparation.

With the recent improvement of inspection techniques, it has been revealed that sufficient safety (anti-exposure) is not ensured only with safety cabinets or PPE (Personal Protective Equipment). Mutagens or drug ingredients may be detected even in urine of the people in charge of drug preparation who have used the safety cabinets or people who worked in the same room.

As predicted from the above four facts (circumstantial evidence), it is believed that the medical practitioners are routinely exposed to the anti-cancer agents in preparing and administering the anti-cancer agents and thus exposed to the risk of developing cancer.

In Europe, measures such as substitution with low- or non-toxic products are implemented in order to prevent or reduce the exposure (e.g., see NPL 4). In Directive 2004/37/EC of the European Parliament and of the Council, the order of priority is as follows: 1. substitution with low- or non-toxic products, 2. use of closed systems, 3. integral ventilation for each region, and 4. use of personal protective equipment. However, the anti-cancer agents have been administered based on evidence regarding efficacy and safety. Therefore, the substitution with low- or non-toxic products is difficult if there is no evidence.

Means using the closed systems such as closed system transfer devices and negative pressure vials have also been implemented. Carcinogenicity is known to increase in proportion to exposure levels. Therefore, decreasing the exposure levels as much as possible is the best way and the use of the closed system transfer devices is greatly significant. However, it is difficult to completely prevent the exposure even using the existing closed systems (e.g., see NPL 5). The use of the closed system transfer devices is very effective for decreasing the exposure levels, but operation of the closed system transfer devices is very complicated. Therefore, it is problematic in that they induce the exposure to the anti-cancer agents by mistake and labor efficiency is decreased. Moreover, only a portion of purchasing expenses of the closed systems is paid at the public expense. Therefore, the more the closed systems are used, the higher the cost is, resulting in pressing management of medical facilities. This is problematic. In view of such a background, at present, there is a huge barrier to popularize the measures with the substitution with low- or non-toxic products or the use of the closed systems.

There have been known double bag type products in which a solid drug-containing chamber is isolated from a drug solution-containing chamber by an easily openable sealing portion so as to easily bring them in communication with each other through application of pressure in order to simplify filling operation of drug liquid (e.g., see PTL 2). This bag enables safe drug preparation work by bringing the solid drug-containing chamber and the drug solution-containing chamber into communication with each other by the easily openable sealing portion.

CITATION LIST

Patent Literature

PTL 1: Japanese Patent Application Laid-Open (JP-A) No. 2006-230445

PTL 2: JP-A No. 2006-111532

Non-Patent Literature

NPL 1: American Journal of Health-System Pharmacy Vol. 63, Sep. 15 1736-1744, 2006

NPL 2: Am J Health-Syst Pharm, 1999; 56: 1427-32

NPL 3: Int Arch Occup Environ Health. 1995; 67: 317-23

NPL 4: Directive 2004/37/EC of the European Parliament and of the Council of 29 Apr. 2004 on the protection of workers from the risk related to exposure to carcinogens or mutagens at work NPL 5: Proceedings of The Annual Meeting of the Japanese Society of Pharmaceutical Health Care and Sciences 21, 227, 2011 Sep. 9 P-0275 Examination of safety improvement upon preparation of anti-cancer agent using two-connected closed system transfer devices.

SUMMARY OF INVENTION

Technical Problem

It is also contemplated to prevent the exposure to the anti-cancer agents using the double bag type products. However, in the double bag type products disclosed in PTL 2, it was not envisaged to perform dose adjustment upon drug preparation. Dosage of the anti-cancer agent is varied for each patient because it is mainly determined depending on the body surface area. Therefore, the dose adjustment is needed, but the drug was not able to be prepared in an amount corresponding to a patient who receives the drug. Therefore, there is a need to provide a new technique which enables dose adjustment while preventing exposure to drugs which may harmfully or adversely affect human body (anti-cancer agents).

The present invention has been made in view of the foregoing and has an object to provide a kit product and a dose adjustment method which enables dose adjustment while preventing exposure to drugs which may harmfully or adversely affect human body (e.g., anti-cancer agents).

Solution to Problem

According to one aspect of the present invention, provided is a kit product including a bag which contains an infusion solution or pure water; and at least one drug-enclosing portion in which a drug is enclosed and which includes a sealing portion, wherein drug preparation is enabled by connecting the drug-enclosing portion and the bag via the sealing portion and opening the sealing portion to bring the bag into communication with the drug-enclosing portion, thereby charging the drug into the bag, and wherein the kit product enables dose adjustment of the drug.

In the kit product according to the aspect, the drug-enclosing portion may be configured to be able to isolate a residue of the drug, which remains in the drug-enclosing portion without being used in the drug preparation, from the bag.

In the kit product according to the aspect, the sealing portion may be configured to be re-sealable after opened.

In the kit product according to the aspect, the drug-enclosing portion may be configured to be able to cut away the residue of the drug from the bag.

In the kit product according to the aspect, the drug-enclosing portion may be configured to include two or more portions each enclosing one of two or more of different drugs.

In the kit product according to the aspect, the drug-enclosing portion may be configured to include two or more portions partitioned for each amount of the drug.

In the kit product according to the aspect, the drug may be configured to be housed in a drug plate including two or more drug-housing portions partitioned for each amount.

In the kit product according to the aspect, the drug may be configured to be able to be dose-adjusted by adjusting the number of the drug-enclosing portions to be connected to the bag.

In the kit product according to the aspect, the drug-enclosing portion may be configured to be supplied in at least one standard selected from 0.001 mg, 0.01 mg, 0.1 mg, 1.0 mg, 10 mg, 100 mg, and 1,000 mg.

In the kit product according to the aspect, the drug-enclosing portion may be configured to be supplied in at least one standard selected from 1 mg, 10 mg, and 100 mg.

In the kit product according to the aspect, the drug-enclosing portion may be configured to be supplied in at least one standard selected from 10 mg, 20 mg, 30 mg, 40 mg, 50 mg, 100 mg, 200 mg, 300 mg, 400 mg, and 500 mg.

In the kit product according to the aspect, the drug may be configured to be able to be dose-adjusted by adjusting the number of the sealing portions to be opened.

In the kit product according to the aspect, the drug may be configured to include an anti-cancer agent needed to be dose-adjusted.

In the kit product according to the aspect, the drug may be configured to have one or more of properties described in the following (1) to (6):

(1) the drug is an intravenous formulation;

(2) an administration period is 30 seconds or longer;

(3) the drug needs to be stored at a temperature of 15° C. or lower;

(4) the drug needs to be dissolved in a dissolution liquid upon drug preparation;

(5) the drug needs to be diluted in a dilution liquid upon drug preparation; and (6) the drug needs to be stored in darkness.

In the kit product according to the aspect, the number of the drug-enclosing portions may be two or more, the drug-enclosing portion may be configured to be supplied in at least one standard selected from 1x mg, 2x mg, 3x mg, 4x mg, and 5x mg and in at least one standard selected from 10x mg, 20x mg, 30x mg, 40x mg, and 50x mg, where the x is any selected from 0.001, 0.01, 0.1, 1.0, 10, 100, and 1,000.

According to one aspect of the present invention, provided is a dose adjustment method of a drug including determining, based on a dosage of the drug, a standard and a number of a drug-enclosing portion to be used.

In the dose adjustment method according to the aspect, the drug-enclosing portion may be configured to be supplied in at least one standard selected from 0.001 mg, 0.01 mg, 0.1 mg, 1.0 mg, 10 mg, 100 mg, and 1,000 mg.

The dose adjustment method according to the aspect may include connecting the drug-enclosing portion in the thus-determined standard and number with the bag of the above-described kit product.

In the dose adjustment method according to the aspect, the drug may be configured to have one or more of properties described in the following (1) to (6):

(1) the drug is an intravenous formulation;

(2) an administration period is 30 seconds or longer;

(3) the drug needs to be stored at a temperature of 15° C. or lower;

(4) the drug needs to be dissolved in a dissolution liquid upon drug preparation;

(5) the drug needs to be diluted in a dilution liquid upon drug preparation; and (6) the drug needs to be stored in darkness.

In the dose adjustment method according to the aspect, the number of the drug-enclosing portions to be used may be configured to be determined based on the number of digits of significant figures of the dosage of the drug.

In the dose adjustment method according to the aspect, the number of the drug-enclosing portions to be used may be configured to be equal to or greater than the number of digits of significant figures of the dosage of the drug.

In the dose adjustment method according to the aspect, the number of the drug-enclosing portions may be two or more, the drug-enclosing portion may be configured to be supplied in at least one standard selected from 1x mg, 2x mg, 3x mg, 4x mg, and 5x mg and in at least one standard selected from 10x mg, 20x mg, 30x mg, 40x mg, and 50x mg, where the x is any selected from 0.001, 0.01, 0.1, 1.0, 10, 100, and 1,000.

Advantageous Effects of Invention

According to the present invention, a kit product and a dose adjustment method which enables dose adjustment while preventing exposure to drugs which may harmfully or adversely affect human body (e.g., anti-cancer agents).

DESCRIPTION OF EMBODIMENTS

Embodiments of the present invention will now be described in detail with reference to drawings.

Note that, characteristic portions may be enlarged, for convenience, in drawings referenced in the description below in order to clarify characteristics thereof. For example, dimension ratios of components are not necessarily the same as actual dimension ratios.

In one embodiment, the present invention provides a kit product including a bag which contains an infusion solution or pure water; and at least one drug-enclosing portion in which a drug is enclosed and which includes a sealing portion, wherein drug preparation is enabled by connecting the drug-enclosing portion and the bag via the sealing portion and opening the sealing portion to bring the bag into communication with the drug-enclosing portion, thereby charging the drug into the bag, and wherein the kit product enables dose adjustment of the drug.

As described below, a kit product according the present embodiment may be supplied in a state where the drug-enclosing portion and the bag are connected to each other in advance. Alternatively, the kit product may be supplied in a state where the drug-enclosing portion and the bag are separated from each other and the drug-enclosing portion may be connected to the bag upon drug preparation.

Embodiments of the kit product will now be described.

First Embodiment

Figure 1:
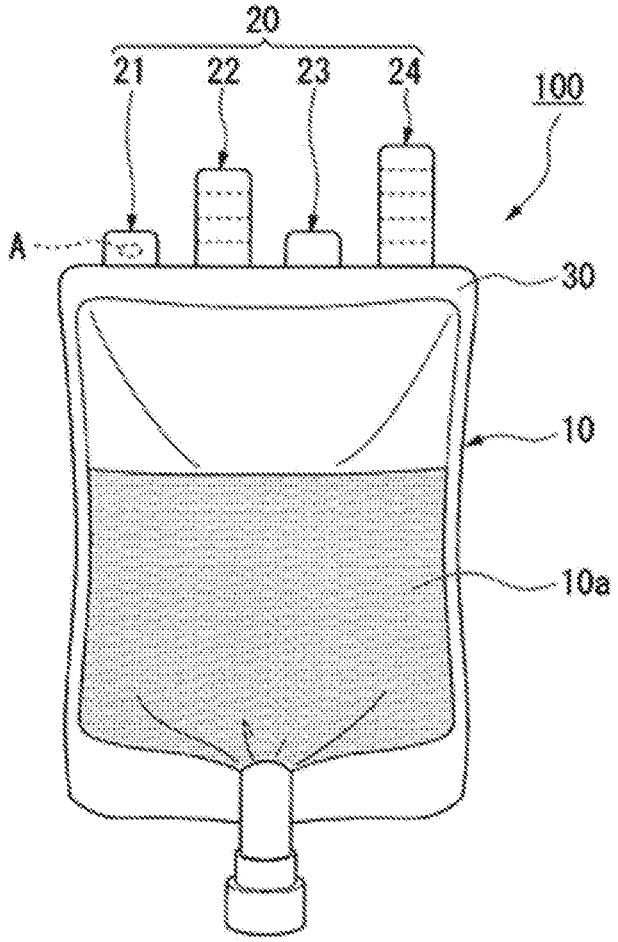
FIG. 1 is a view illustrating one exemplary schematic configuration of a kit product according to the first embodiment.
Figure 2:
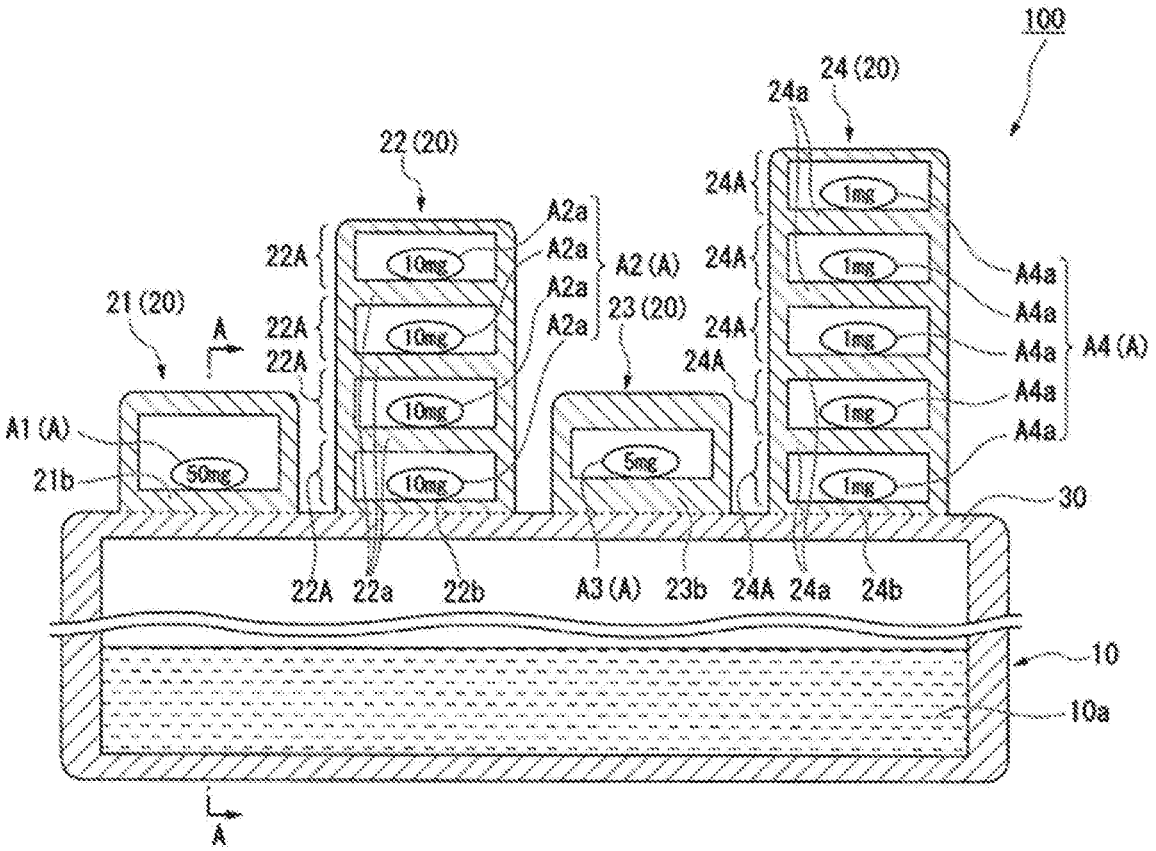
FIG. 2 is a view illustrating one exemplary essential-part configuration of a kit product according to the first embodiment.

FIG. 1 is a view illustrating one exemplary schematic configuration of a kit product according to the first embodiment. FIG. 2 is a view illustrating one exemplary essential-part configuration of a kit product. Note that, the kit products illustrated in FIGS. 1 and 2 are before drug preparation. As used hereinafter, the phrase "before drug preparation" means before a portion or all of a drug in a drug-enclosing portion is charged into an infusion solution or pure water in a bag; and the phrase "after drug preparation" means after a portion or all of the drug in the drug-enclosing portion is charged into the infusion solution or the pure water in the bag.

As illustrated in FIGS. 1 and 2, a kit product 100 includes a bag 10 containing a liquid 10*a*; drug-enclosing portions 20 each enclosing the predetermined drug; and sealing portions 30 disposed between the bag 10 and the drug-enclosing portions 20.

In the kit product 100 according to the present embodiment, a residue of a drug A (residual drug), which remains in the drug-enclosing portions 20 without being used in the drug preparation (dose-adjusted), is configured to be able to isolate from the bag 10 before (before drug preparation (dose adjustment)) or after (after drug preparation (dose adjustment)) a portion or all of the drug A is charged into the bag 10. As used herein, a state where the drug A is isolated from the bag 10 means a state where the drug A is not able to be charged into the bag 10 because the drug-enclosing portions 20 and the bag 10 coupled via the sealing portions 30 are sealed by the sealing portions 30 or a state where the drug A is not able to be charged into the bag 10 because the drug-enclosing portions 20 have been cut away from the bag 10.

In the present embodiment, the drug-enclosing portions 20 enclose, as the drug A, an anti-cancer agent which needs to be dose-adjusted. In the present embodiment, the drug A includes a cytotoxic anti-cancer agent. Note that, the drug A may be in any form such as a liquid form, a solid form, and a powder form.

The anti-cancer agent which needs to be dose-adjusted is classified into, for example, (1) an antibody drug, (2) a cytotoxic anti-cancer agent, (3) a molecular target drug (low molecular weight), and (4) other agents.

(Antibody Drug)

Examples of the antibody drug may include bevacizumab, rituximab, trastuzumab, panitumumab, and cetuximab.

(Cytotoxic Anti-Cancer Agent)

Examples of the cytotoxic anti-cancer agent may include pemetrexed, oxaliplatin, paclitaxel, docetaxel, gemcitabine, carboplatin, irinotecan, azacytidine, cisplatin, epirubicin, bendamustine, fluorouracil, methotrexate, cytarabine, etoposide, pirarubicin, doxorubicin, vinorelbine, amrubicin, soleomycin, bortezomib, capecitabine, cyclophosphamide, dacarbazine, fludarabici, befitinib, gemtuzumab ozogamicin, idarubicin, ifosfamide, lenalidomide, liposomal doxorubicin, fosinate, melphalan, nogitecan, tegafur-gimeracil-oteracil, tegafur-uracil, vincristine, levofolinate, and vinblastine.

(Molecular Target Drug (Low Molecular Weight))

Examples of the molecular target drug (low molecular weight) may include bortezomib, erlotinib, everolimus, gefitinib, imatinib, lapatinib, sorafenib, and sunitinib.

(Other Agents)

Examples of the other agents may include dexamethasone, interferon α, methylprednisolone, prednisolone, and thalidomide.

The bag 10 contains, as the liquid 10*a*, the infusion solution or the pure water used, for example, upon dose adjustment. The infusion solution used upon dose adjustment means a solvent used for dissolving or diluting the drug. Examples of the infusion solution used upon dose adjustment include physiological salt solutions (saline), glucose-saline solutions, electrolyte maintenance solutions, glucose solutions (e.g., 5 w/v %), and water for injection. In the present embodiment, the bag 10 contains, for example, the pure water as the liquid 10*a*. The bag 10 is made of a plastic mainly including polyethylene or polypropylene. Note that, a material for forming the bag 10 is not limited to the above-described material, as long as the material is generally suitable for a medical infusion solution bag.

The drug-enclosing portions 20 are configured to keep the drug A enclosed therein so as to prevent the drug A from leaking outside. The drug-enclosing portions 20 are, for example, made of the same material as that of the bag 10. The drug-enclosing portions 20 can be brought in communication with the bag 10 by unsealing (opening) the sealing portions 30, thereby charging the drug into the bag 10, as described below.

The drug-enclosing portions 20 are formed on the sealing portions 30. In the present embodiment, the drug-enclosing portions 20 enclose, for example, 100 mg worth of the drug A as a whole. The drug-enclosing portion 20 includes a first enclosing portion 21, a second enclosing portion 22, a third enclosing portion 23, and a fourth enclosing portion 24 each enclosing the drug A for each amount.

In the present embodiment, the first enclosing portion 21, the second enclosing portion 22, the third enclosing portion 23, and the fourth enclosing portion 24 each encloses different amounts of the drug A therein. The first enclosing portion 21 the second enclosing portion 22, the third enclosing portion 23, and the fourth enclosing portion 24 each displays the amount of the drug A enclosed therein on its surface by printing or stamping.

Thus, operators (medical practitioners) can correctly select only the enclosing portion containing a required amount of the drug A from the first enclosing portion 21, the second enclosing portion 22, the third enclosing portion 23, and the fourth enclosing portion 24 without making a mistake. Note that, it is also possible to allow the first enclosing portion 21, the second enclosing portion 22, the third enclosing portion 23, and the fourth enclosing portion 24 to have different sizes or shapes so as to easily and correctly select the amount of the drug A enclosed therein.

The first enclosing portion 21 encloses a portion of the drug A, for example, 50 mg worth of a drug A1. A bottom portion 21*b* of the first enclosing portion 21 is configured to be easily openable when external pressure is applied (e.g., by fingers) to the first enclosing portion 21 (e.g., when pulling a surface 11 away from a back surface 12 (see, FIG. 3), the same applies hereafter.).

The first enclosing portion 21 is configured to be able to cut away from the bag 10 (sealing portion 30) by cutting at the bottom portion 21*b*. Note that, it is preferable to use, for example, a hot sealer upon cutting. This makes it possible to seal the thus-produced cut section through heat sealing reliably and safely from the viewpoint of exposure.

The second enclosing portion 22 encloses a portion of the drug A, for example, 40 mg worth of a drug A2. An internal enclosing space of the second enclosing portion 22 has four regions 22A partitioned by partition walls 22*a* and a bottom portion 22*b*. The regions 22A each encloses, for example, 10 mg worth of the drug A2*a*. The partition walls 22*a* and the bottom portion 22*b* are configured to be easily openable when external pressure is applied (e.g., by fingers) to the predetermined regions 22A.

The second enclosing portion 22 is configured to be able to cut away from the bag 10 (sealing portion 30) by cutting at the partition walls 22*a* and the bottom portion 22*b*. Note that, it is preferable to use, for example, a hot sealer upon cutting. This makes it possible to seal the thus-produced cut section through heat sealing reliably and safely from the viewpoint of exposure.

The third enclosing portion 23 encloses a portion of the drug A, for example, 5 mg worth of a drug A3. A bottom portion 23*b* of the third enclosing portion 23 is configured to be easily openable when external pressure is applied (e.g., by fingers) to the third enclosing portion 23.

The third enclosing portion 23 is configured to be able to cut away from the bag 10 (sealing portion 30) by cutting at the bottom portion 23*b*. Note that, it is preferable to use, for example, a hot sealer upon cutting. This makes it possible to seal the thus-produced cut section through heat sealing reliably and safely from the viewpoint of exposure.

The fourth enclosing portion 24 encloses a portion of the drug A, for example, 5 mg worth of a drug A4. An internal enclosing space of the fourth enclosing portion 24 has, for example, five regions 24A partitioned by partition walls 24*a* and a bottom portion 24*b*. The regions 24A each encloses, for example, 1 mg worth of the drug A4*a*. The partition walls 24*a* and the bottom portion 24*b* are configured to be easily openable when external pressure is applied (e.g., by fingers) to the corresponding regions 24A.

The fourth enclosing portion 24 is configured to be able to cut away from the bag 10 (sealing portion 30) by cutting at the partition walls 24*a* and the bottom portion 24*b*. Note that, it is preferable to use, for example, a hot sealer upon cutting. This makes it possible to seal the thus-produced cut section through heat sealing reliably and safely from the viewpoint of exposure.

The sealing portions 30 are made of the same material as that of the bag 10. That is, the sealing portions 30 are integrally formed with the bag 10 and constitute a portion of the bag 10.

Figure 3:
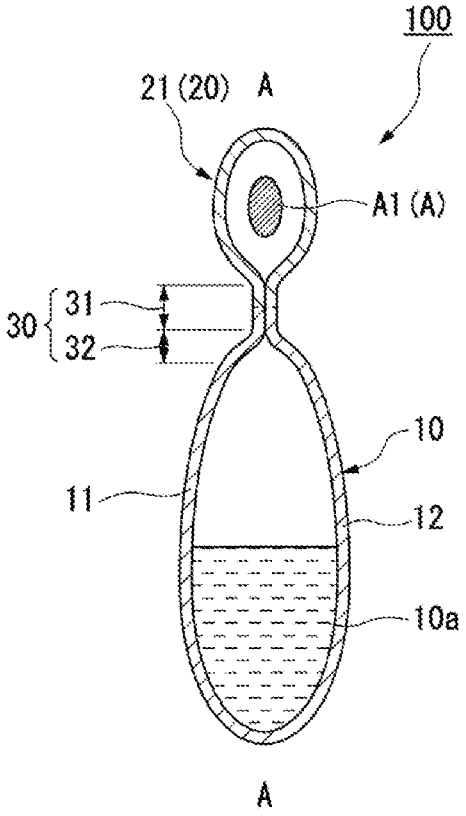
FIG. 3 is a view illustrating a cross-sectional structure taken through the line A-A of FIG. 2.

FIG. 3 is a view illustrating a cross-sectional structure taken through the line A-A of FIG. 2. As illustrated in FIG. 3, the sealing portion 30 includes a sealing section 31 and a re-sealing section 32. The sealing section 31 bonds the surface 11 and the back surface 12 of the bag 10 with, for example, the heat sealing or known adhesives. The sealing section 31 is, for example, opened by applying external force in a direction pulling the surface 11 and the back surface 12 away from each other to thereby release a bonded state. Meanwhile, the re-sealing section 32 is not bonded in an initial state and the surface 11 is apart from the back surface 12. However, the re-sealing section 32 is bonded through the heat sealing after drug preparation, if necessary.

Based on such a configuration, the sealing portion 30 is configured to allow the drug A to be charged from the drug-enclosing portions 20 into the bag 10 by opening the sealing section 31 upon drug preparation, as described below. The bag 10 can be re-sealed after opening the sealing portion 30 upon drug preparation by bonding the surface 11 and the back surface 12 through the heat sealing of the re-sealing section 32.

Drug preparation in the kit product 100 according to the present embodiment will now be described.

Figure 4:
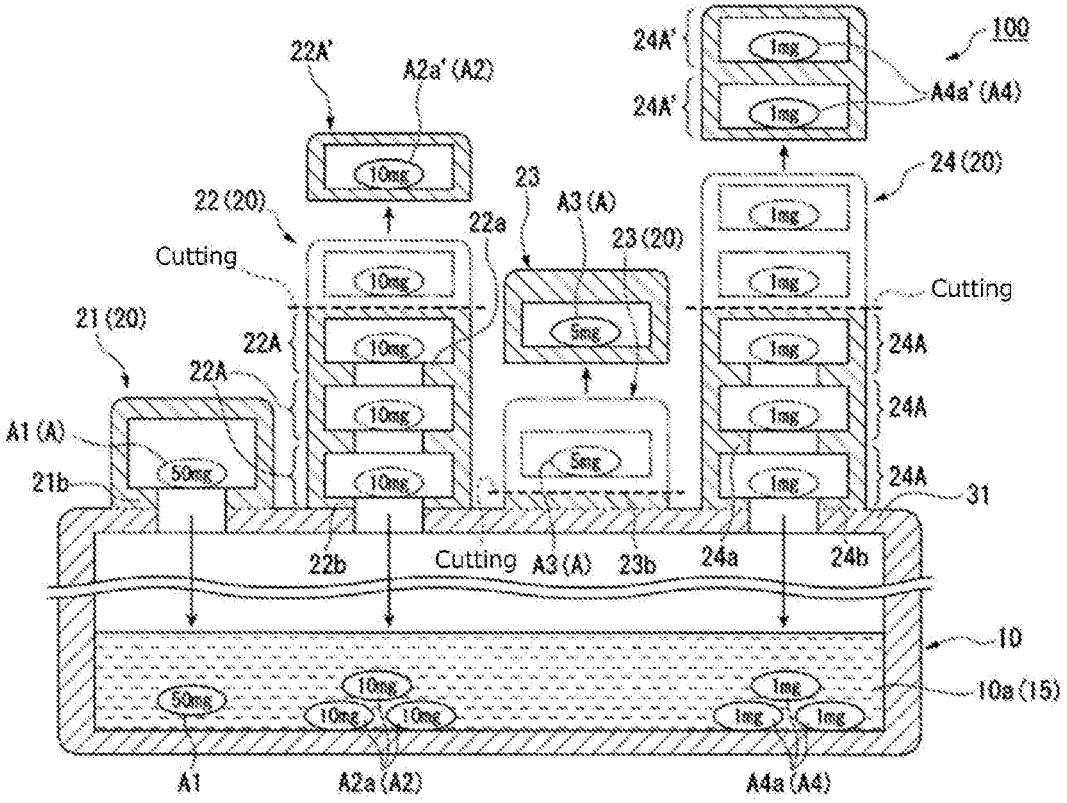
FIG. 4 is an explanatory view illustrating one exemplary drug preparation (dose adjustment) of a kit product according to the first embodiment.

FIG. 4 is an explanatory view illustrating one exemplary drug preparation of the kit product 100. The case where, for example, 83 mg worth of the drug A is charged from the drug-enclosing portions 20 into the bag 10 will now be described. In this description, the drug A is charged from the first enclosing portion 21, the second enclosing portion 22, and the fourth enclosing portion 24 into the bag 10, but the drug A is not charged from the third enclosing portion 23 into the bag 10.

For example, the sealing section 31 of the sealing portion 30 is firstly opened by applying external pressure (e.g., by fingers). Then, the bottom portion 21*b* is unsealed by applying external pressure (e.g., by fingers) to the first enclosing portion 21. This brings the bag 10 into communication with the first enclosing portion 21, thereby charging the drug A1 (e.g., 50 mg worth) enclosed in the first enclosing portion 21 into the bag 10.

Then, a portion of the drug A2 (e.g., 30 mg worth) is charged from the second enclosing portion 22 into the bag 10. Specifically, the partition walls 22*a* and the bottom portion 22*b* are unsealed by applying external pressure (e.g., by fingers) to lower three regions 22A of the four regions 22A. This brings the bag 10 into communication with the second enclosing portion 22, thereby charging only the predetermined amount of the drug A2 enclosed in the second enclosing portion 22 into the bag 10.

Then, a portion of the drug A4 (e.g., 3 mg worth) is charged from the fourth enclosing portion 24 into the bag 10. Specifically, the partition walls 24*a* and the bottom portion 24*b* are unsealed by applying external pressure (e.g., by fingers) to lower three regions 24A of the five regions 24A. This brings the bag 10 into communication with the fourth enclosing portion 24, thereby charging only the predetermined amount of the drug A4 enclosed in the fourth enclosing portion 24 into the bag 10.

Thus, drug preparation work requiring the dose adjustment can be performed without exposing the drug to the outside air, that is, without a risk of exposure by charging a portion of the drug A (e.g., 83 mg worth) enclosed in the drug-enclosing portions 20 in the liquid 10*a* in the bag 10. This allows a drug liquid 15 prepared from the drug A and the liquid 10*a* to be contained in the bag 10.

After the drug A is charged into the bag 10, the surface 11 and the back surface 12 of the bag 10 are bonded through the heat sealing at the re-sealing section 32 of the sealing portion 30 (see, FIG. 3). This allows the sealing portion 30 to re-enclose the drug liquid 15 in the bag 10.

Then, the residue of the drug A, which remains in the drug-enclosing portion 20 without being used in the drug preparation, is cut away from the bag 10. Specifically, the residue of the drug A is cut away from the bag 10 by cutting the uppermost region 22A' of the second enclosing portion 22. The region 22A' is cut at the partition wall 22*a* using a hot sealer. The thus-produced cut section by the hot sealer is reliably sealed through the heat sealing. Therefore, a drug A2*a*' (residual drug) in the region 22A', which has been cut away, is prevented from leaking outside (exposure).

Then, the residue of the drug A, which remains in the third enclosing portion 23 without being used in the drug preparation, is cut away from the bag 10. Specifically, the residue of the drug A is cut away from the bag 10 by cutting the bottom portion 23*b* of the third enclosing portion 23. The third enclosing portion 23 is cut at the bottom portion 23*b* using a hot sealer. The thus-produced cut section by the hot sealer is reliably sealed through the heat sealing. Therefore, a drug A3 (residual drug) in the third enclosing portion 23, which has been cut away, is prevented from leaking outside (exposure).

The residue of the drug A, which remains in the fourth enclosing portion 24 without being used in the drug preparation, is cut away from the bag 10 in the same manner. Specifically, the residue of the drug A is cut away from the bag 10 by cutting upper two regions 24A' of the fourth enclosing portion 24. The regions 24A' are cut at the partition wall 24*a* using a hot sealer. The thus-produced cut section by the hot sealer is reliably sealed. Therefore, a drug A4*a*' (residual drug) in the region 24A', which has been cut away, is prevented from leaking outside (exposure).

The bag 10 in which an unused drug A (residual drugs A2*a*', A3, and A4*a*') is isolated (cut away) by cutting off the drug-enclosing portions 20 is used as a bag for intravenous drip, as described below.

According to the kit product 100 according to the present embodiment, the drug preparation work requiring the dose adjustment can be performed without exposing the drug A to the outside air, that is, without a risk of exposure while preventing exposure to the drug A which may affect human body, thereby conveniently producing the predetermined dose of the drug liquid 15.

The residue of the drug A, which remains in the drug-enclosing portions 20 without being used in the drug preparation, can be completely cut away from the bag 10. Therefore, for example, even when the drug-enclosing portions 20 are damaged by applying external force to the bag 10, the drug A does not remain in the drug-enclosing portions 20. This makes it possible to surely prevent the exposure to the drug A from occurring.

Medical accidents due to overdose (e.g., a medical practitioner charges the residue of the drug A into the bag 10 by mistake) can be prevented from occurring because the drug A is isolated from the bag 10. Moreover, the residue of the drug A remaining in the drug-enclosing portions 20, which has been cut away from the bag 10, can be reused. Therefore, the drug A can be used without waste, resulting in a reduced amount of waste.

In the conventional drug preparation work, for example, a safety cabinet as well as a vial for drug, a vial for saline for dilution, a syringe for adjustment, or a bag for intravenous drip have been needed in order to prevent the exposure. Therefore, expenses have been needed for purchasing and disposing them. In contrast, the kit product 100 is formed into a kit, so that drug preparation work other than the dose adjustment, and thus, the vial and the syringe become unnecessary. This enables a significant cost reduction.

The drug preparation work can be easily performed, making it possible to perform more drug preparation work with fewer operators (medical practitioners). Therefore, drug preparation service with higher quality can be provided to more patients. For example, when using the kit product 100 which is formed into the kit as described in the present embodiment, a risk of contamination during the work can be greatly reduced than when injections are mixed together to prepare a drug at a medical setting as before.

It is also possible to protect patients and their families from exposure due to administration of anti-cancer agents to other patients. In medical facilities, the drug preparation work is more simplified than when using conventional vials, resulting in improved efficiency of the drug preparation work. This makes it possible to reduce the number of operators and thus to perform more drug preparation work while reducing a cost such as personnel expenses.

The expenses borne by the medical facilities may be reduced because the exposure can be prevented without the use of closed tools as before. For medical practitioners in hospitals, efficiency of the drug preparation work is improved and a risk of exposure to anti-cancer agents due to, for example, contamination in a dispensary or a hospital ward can be greatly reduced because mistakes can be prevented from occurring upon drug preparation.

Note that, the present invention is not necessarily limited to the above embodiments and various modifications can be made without departing from the spirit of the present invention.

For example, in the first embodiment, the case in which the residue of the drug A remaining in the drug-enclosing portions 20 is cut away from the bag 10 after the drug preparation has been described, but the first embodiment is not limited thereto. For example, a portion of the drug-enclosing portions 20 enclosing the drug A which would remain without being used in the drug preparation may be previously cut away before the drug preparation. The same applies to kit products according to other embodiments described below.

In the above embodiment, the cytotoxic anti-cancer agent has been exemplified as the drug, but the present invention is not limited thereto.

For example, the drug may be glucose or sodium chloride (NaCl). The drug may also have one or more of properties described in the following (1) to (6): (1) the drug is an intravenous formulation; (2) an administration period is 30 seconds or longer; (3) the drug needs to be stored at a temperature of 15° C. or lower; (4) the drug needs to be dissolved in a dissolution liquid upon drug preparation; (5) the drug needs to be diluted in a dilution liquid upon drug preparation; and (6) the drug needs to be stored in darkness. In the above embodiment, the case in which only one type of drug (cytotoxic anti-cancer agent) is enclosed in the drug-enclosing portions 20 have been exemplified, but the drug-enclosing portions 20 may be configured to enclose one of two or more of different drugs. The same applies to kit products according to other embodiments described below.

Note that, the intravenous formulation includes products for intravenous one shot injection or intravenous drip.

Figure 5A:
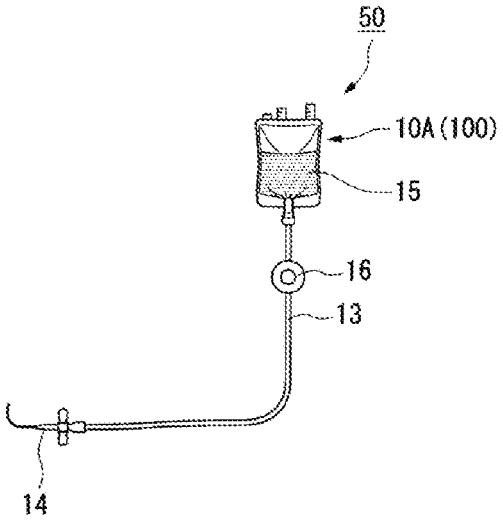
FIG. 5*a* is a view-1 illustrating one exemplary configuration of an intravenous drip device using a kit product according to the first embodiment.
Figure 5B:
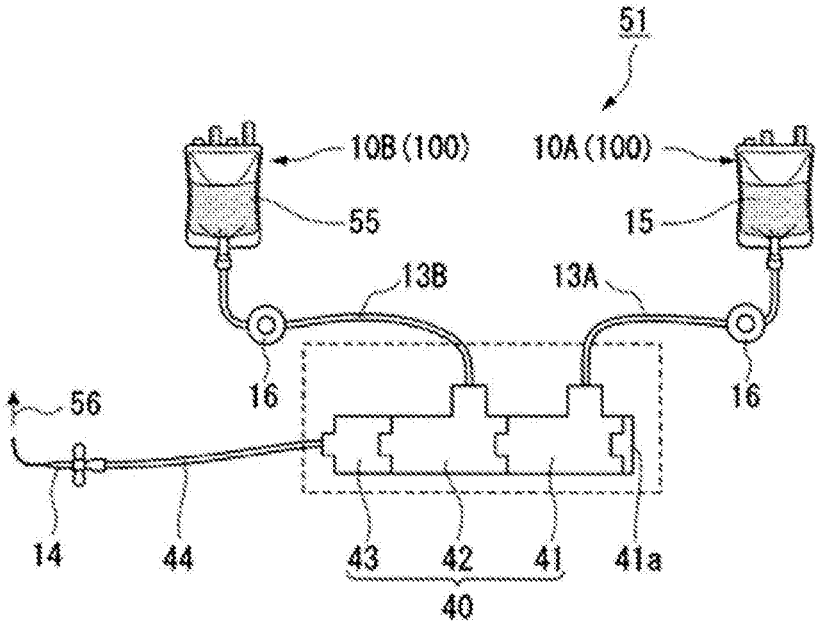
FIG. 5*b* is a view-2 illustrating one exemplary configuration of an intravenous drip device using a kit product according to the first embodiment.

FIG. 5 is a view illustrating a configuration of an intravenous drip device formed from the kit product 100 according to the present embodiment. FIG. 5*a* is a view when a single bag is used for intravenous drip. FIG. 5*b* is a view when two bags are used for intravenous drip.

As illustrated in FIG. 5*a*, an intravenous drip device 50 includes a bag for intravenous drip 10A formed of the kit product 100, a tube for intravenous drip 13, an injection needle 14, and a two-way cock 16. The tube for intravenous drip 13 is connected to the bag for intravenous drip 10A at one end and to the injection needle 14 at the other end. Note that, the bag for intravenous drip 10A contains the drug liquid 15 prepared from 83 mg worth of the drug A as described above.

A tip of the injection needle 14 is pricked to a rubber cap (not illustrated) before use. The injection needle 14 is charged with saline, which eliminates the need of priming. A flow channel for the drug liquid 15 in the tube for intravenous drip 13 is configured to be openable and closable by the two-way cock 16.

Depending on a required amount of the drug liquid, the intravenous drip may be performed using a plurality of bags coupled to each other. As illustrated in FIG. 5*b*, an intravenous drip device 51 include bags for intravenous drip 10A and 10B, tubes for intravenous drip 13A and 13B, a coupler 40, the injection needle 14, a tube 44 configured to connect the coupler 40 and the injection needle 14, and two two-way cocks 16 each disposed in the tubes for intravenous drip 13A and 13B. Note that, the bag for intravenous drip 10B contains, for example, the drug liquid 55 prepared from 100 mg worth of the drug A in the kit product 100. In this case, the bag for intravenous drip 10A contains the drug liquid 15 prepared from 53 mg worth of the drug A.

The tube for intravenous drip 13A is connected to the bag for intravenous drip 10A at one end and to the coupler 40 at the other end. The tube for intravenous drip 13B is connected to the bag for intravenous drip 10B at one end and to the coupler 40 at the other end. A flow channel for the drug liquid 15 in the tube for intravenous drip 13 is configured to be openable and closable by the two-way cock 16.

The coupler 40 includes a first coupler 41, a second coupler 42, and a third coupler 43. The first coupler 41 is connected to the bag for intravenous drip 10A via the tube for intravenous drip 13A and configured to supply the drug liquid 15 supplied from the bag for intravenous drip 10A to the second coupler 42.

The second coupler 42 is connected to the bag for intravenous drip 10B via the tube for intravenous drip 13B and configured to supply the drug liquid 55 supplied from the bag for intravenous drip 10B and the drug liquid 15 supplied from the first coupler 41 to the third coupler 43.

The third coupler 43 is connected to an outlet for drug liquid of the second coupler 42 and configured to supply the drug liquid 15 and the drug liquid 55 to the injection needle 14 via the tube 44. Flow channels for the drug liquids 15 and 55 in the tubes for intravenous drip 13A and 13B are each configured to be openable and closable by the two-way cock 16.

Thus, the intravenous drip device 51 couples two bags for intravenous drip 10A and 10B to each other, so that 153 mg worth of the drug liquids 15 and 55 can be intravenously dripped. Note that, the drug liquids 15 and 55 to be contained in the bags for intravenous drip 10A and 10B may be the same type as or different type from each other.

The number of bags to be coupled is not limited to two and may be appropriately changed by combining many couplers.

For example, the number of bags can be increased by removing a cap 41*a* attached to the first coupler 41 and connecting another coupler to the first coupler 41. Thus, according to the present application, any regimen can be wholly formed into a kit by appropriately selecting, according to the regimen, a type of the anti-cancer agent to be charged into each of the thus-coupled bags.

Modification Example

Structure according to the first modification example of the coupler 40 illustrated in FIG. 5*b* will now be described.

Figure 6A:
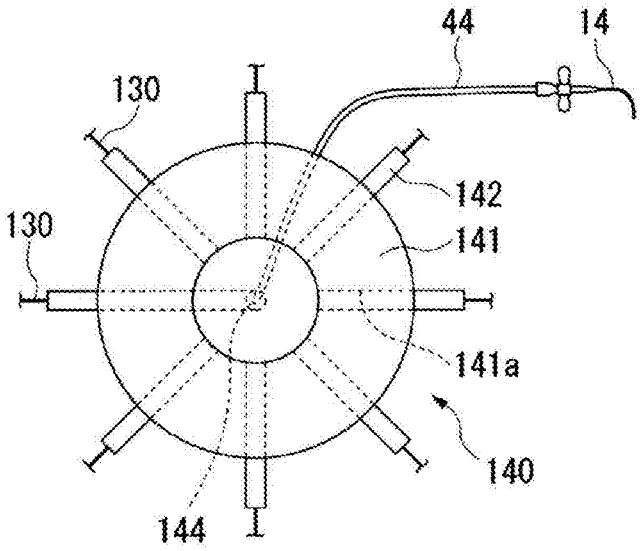
FIG. 6*a* is a view-1 illustrating one exemplary configuration of a coupler according to the first modification example.
Figure 6B:
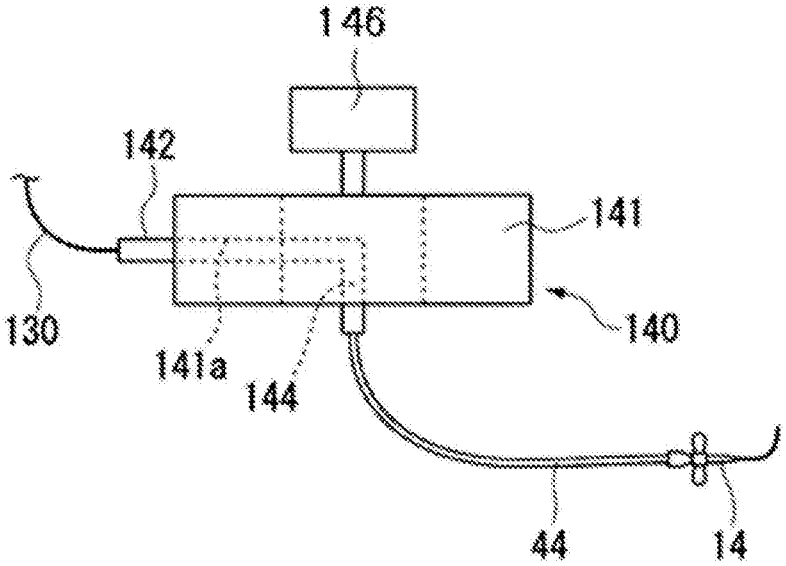
FIG. 6*b* is a view-2 illustrating one exemplary configuration of a coupler according to the first modification example.

FIG. 6 is a view illustrating one exemplary configuration of a coupler 140 according to the first modification example. FIG. 6*a* is a top view of the coupler 140 and FIG. 6*b* is a side view of the coupler 140.

As illustrated in FIG. 6*a*, the coupler 140 includes a body portion 141, a plurality of (e.g., eight) connecting portions 142, a flow channel-switching handle 146, and an outlet for drug liquid 144. A bag (not illustrated) is connected to each of connecting portions 142 via the tube for intravenous drip 130. The injection needle 14 is connected to the outlet for drug liquid 144 via the tube 44.

The connecting portions 142 are arranged along a circumference surface of the body portion 141 which is circular in planar view. In the body portion 141, a plurality of internal flow channels 141*a* to be in communication with the connecting portions 142 are formed. The internal flow channels 141*a* extend towards a center of the body portion 141 and combined at the center of the body portion 141, which is connected to the outlet for drug liquid 144.

The flow channel-switching handle 146 is configured to switch the connecting portion 142 to be in communication with the outlet for drug liquid 144 through rotation with respect to the body portion 141. This makes it possible to selectively supply, for example, different types of drug liquids, which is supplied from the bag 10 connected to the predetermined connecting portion 142, to the outlet for drug liquid 144, as illustrated in FIG. 6*b*. Therefore, drug administration can be performed according to any regimen by appropriately selecting, according to the regimen, a type of the anti-cancer agent to be charged into each of bags connected to the connecting portion 142.

Figure 7A:
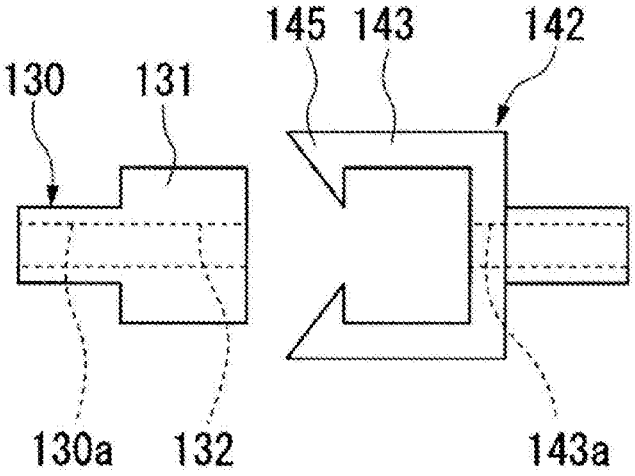
FIG. 7*a* is a view-1 illustrating one exemplary configuration of a connecting portion in a coupler according to the first modification example.
Figure 7B:
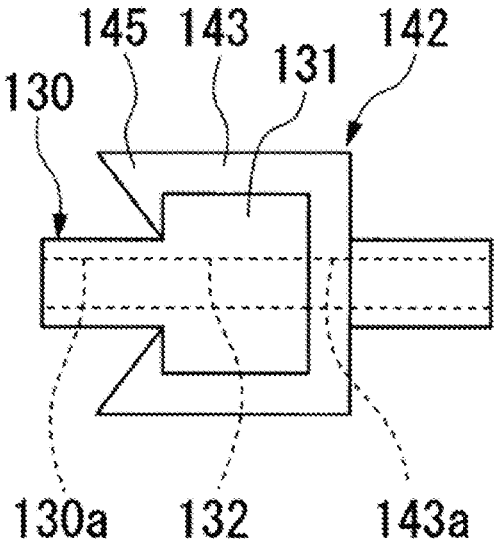
FIG. 7*b* is a view-2 illustrating one exemplary configuration of a connecting portion in a coupler according to the first modification example.

FIG. 7 is a view illustrating an essential-part of one exemplary connection mechanism between the connecting portion 142 and the tube for intravenous drip 130. FIG. 7*a* illustrates a state before connected and FIG. 7*b* illustrates a state after connected. As illustrated in FIG. 7*a*, the tube for intravenous drip 130 includes a seal member 131 configured to be able to keep an airtight connection with the connecting portion 142. The seal member 131 has a through hole 132 integrally formed with an internal flow channel 130*a* of the tube for intravenous drip 130.

Meanwhile, the connecting portion 142 includes an engaging frame portion 143 to be engaged with the seal member 131 and a hook portion 145 disposed in the engaging frame portion 143. The engaging frame portion 143 has an opening 143*a* configured to bring the through hole 132 of the seal member 131 in communication with the internal flow channel 130*a* when engaged with the seal member 131.

As illustrated in FIG. 7*b*, the connecting portion 142 has a structure in which the tube for intravenous drip 130 is not able to be detached once connected by locking the seal member 131, which is held in the engaging frame portion 143, with the hook portion 145. Based on the structure, the coupler 140 can supply the drug liquid from each bag 10 towards the injection needle 14 while preventing the drug liquid from leaking.

Figure 8:
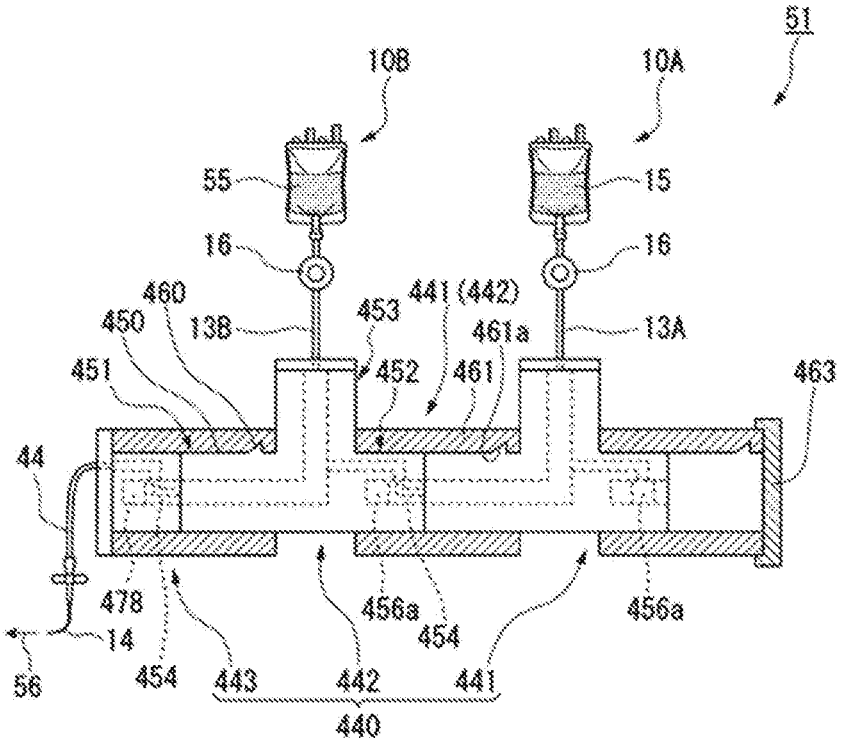
FIG. 8 is a view illustrating one exemplary configuration of an intravenous drip device using a coupler according to the second modification example.

Then, a structure of a coupler according to the second modification example will now be described. FIG. 8 is a view illustrating one exemplary configuration of an intravenous drip device using the coupler according to the second modification example.

As illustrated in FIG. 8, a coupler 440 of the intravenous drip device 51 includes a first coupler 441, a second coupler 442, and a third coupler 443. The second coupler 442 is connected to the bag for intravenous drip 10B via the tube for intravenous drip 13B and configured to supply the drug liquid 55 supplied from the bag for intravenous drip 10B to the third coupler 443. Note that, drugs used for the drug liquids 15 and 55 may be the same as or different from each other. A flow channel for the drug liquid 55 in the tube for intravenous drip 13B is configured to be openable and closable by the two-way cock 16.

The first coupler 441 is connected to the bag for intravenous drip 10A via the tube for intravenous drip 13A and configured to supply the drug liquid 15 supplied from the bag for intravenous drip 10A to the second coupler 442. A flow channel for the drug liquid 15 in the tube for intravenous drip 13A is configured to be openable and closable by the two-way cock 16.

The third coupler 443 is connected to an outlet for drug liquid of the second coupler 442 and configured to supply the drug liquids 15 and 55 to the injection needle 14 via the tube 44. A tip of the injection needle 14 is pricked to a rubber cap (not illustrated) before use. The injection needle 14 is charged with saline, which eliminates the need of priming.

Figure 9:
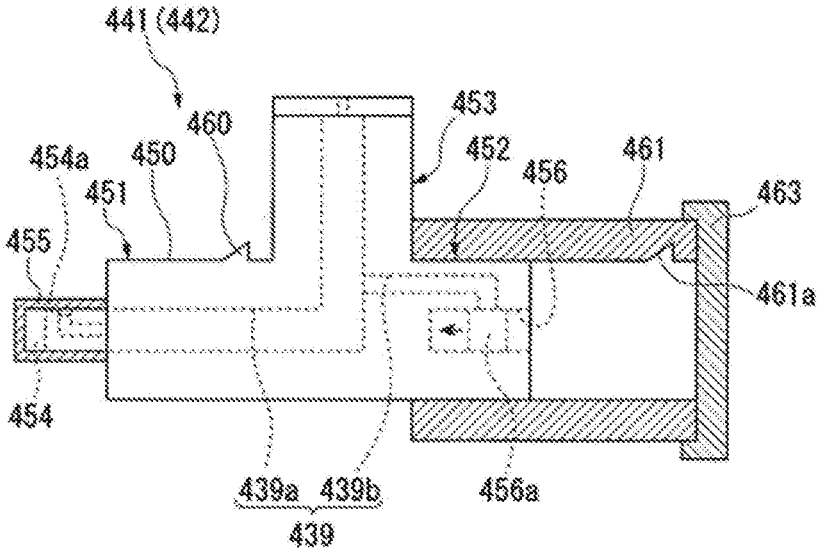
FIG. 9 is a view illustrating one exemplary configuration of a first or second coupler according to the second modification example.

The first coupler 441 has the same structure as the second coupler 442. The first coupler 441 will now be described as an example. FIG. 9 is a view illustrating one exemplary configuration of the first coupler 441.

As illustrated in FIG. 9, the first coupler 441 includes a body portion 450 in which an internal flow channel 439 is formed. The body portion 450 includes a first connecting portion 451, a second connecting portion 452, and a third connecting portion 453. The internal flow channel 439 includes a first flow channel 439*a* extending between the first connecting portion 451 and the second connecting portion 452, and a second flow channel 439*b* branched from the first flow channel 439*a* and extending towards the third connecting portion 453.

A connecting member 454 is formed at an end of the first connecting portion 451. A flow channel 454*a* configured to be in communication with the internal flow channel 439 is formed in the connecting member 454. A concave portion 456 is formed at an end of the second connecting portion 452.

The concave portion 456 is configured to be in communication with the second flow channel 439*b*. A movable rubber stopper 456*a*, which is configured to be movable along an internal surface, is disposed in the concave portion 456. The movable rubber stopper 456*a* is configured to be movable between a closing position at which the second flow channel 439*b* is closed and an opening position at which the second flow channel 439*b* is opened.

The bag for intravenous drip 10A is connected to the first flow channel 439*a* via the tube for intravenous drip 13A at an end of the third connecting portion 453 (see FIG. 8). Note that, the third connecting portion 453 is connected to the bag for intravenous drip 10B via the tube for intravenous drip 13B at the second coupler 442 (see FIG. 8).

A convex portion 460 which has a triangular cross section is disposed in a base portion of the first connecting portion 451. A tubular holding member 461 protruding along a circumference surface is disposed in the second connecting portion 452. A notch 461*a* is formed in an internal surface of an opening end of the holding member 461.

An inside of the first coupler 441 is kept sterile by covering the opening end of the holding member 461 with a lid portion 463 and covering the connecting member 454 protruding from a tip of the first connecting portion 451 with a cap 455 when unused. The cap 455 and the lid portion 463 are removed immediately before use. Note that, the internal flow channel 439 is charged with saline up to the top of the connecting member 454. This eliminates the need of priming and a worry about exposure.

Figure 10:
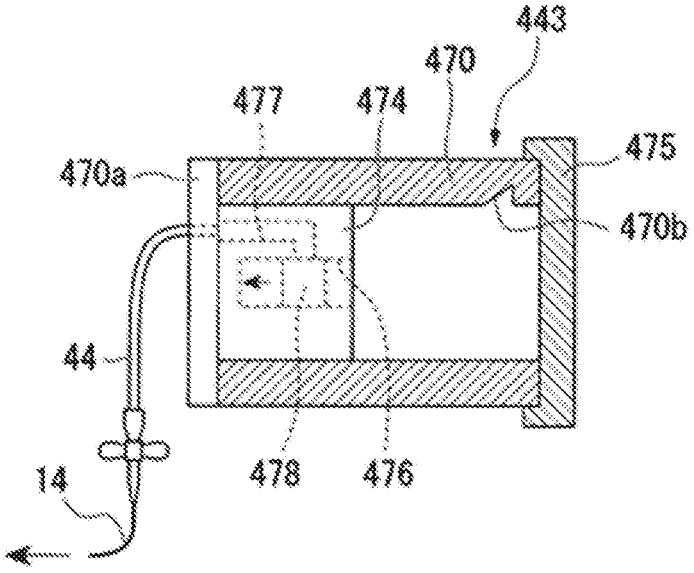
FIG. 10 is a view illustrating one exemplary configuration of a third coupler according to the second modification example.

FIG. 10 is a view illustrating one exemplary configuration of the third coupler 443.

As illustrated in FIG. 10, the third coupler 443 includes a bottomed tubular body portion 470 and a flow channel-forming member 474 attached to a bottom portion 470*a* of the body portion 470. An inside of the third coupler 443 is kept sterile by covering the body portion 470 with a lid portion 475 at one end when unused.

In the flow channel-forming member 474, a concave portion 476 and a flow channel 477, which is configured to be in communication with the concave portion 476, are formed. A movable rubber stopper 478, which is configured to be movable along an internal surface, is disposed in the concave portion 476. The movable rubber stopper 478 is configured to be movable between a closing position at which the flow channel 477 is closed and an opening position at which the flow channel 477 is opened.

In the body portion 470, the injection needle 14 is connected to the bottom portion 470*a* via the tube 44. The tube 44 is attached to the bottom portion 470*a* so as to be in communication with the flow channel 477 formed in the flow channel-forming member 474. A tip of the injection needle 14 is pricked to a rubber cap (not illustrated) before use. The injection needle 14 is charged with saline, which eliminates the need of priming.

In the body portion 470, a notch 470*b* is formed on an inner circumferential surface of an opening end opposite to the bottom portion 470*a*. The convex portion 460 disposed in the first connecting portion 451 is configured to mate with the notch 470*b*.

For assembly of the coupler 440, the third coupler 443 and the second coupler 442 are firstly coupled to each other. When the third coupler 443 and the second coupler 442 are coupled to each other, the first connecting portion 451 of the second coupler 442 from which the cap 455 has been removed to expose the connecting member 454 is inserted into the body portion 470 of the third coupler 443 from which the lid portion 475 has been removed.

Thus, the connecting member 454 disposed at the top of the second coupler 442 is inserted into the concave portion 476 formed in the flow channel-forming member 474. At this time, the movable rubber stopper 478 is pushed into the concave portion 476 by the connecting member 454. As a result, the flow channel 477 closed by the movable rubber stopper 478 is unclosed and the internal flow channel 439 of the second coupler 442 and the flow channel 477 of the third coupler 443 are brought in communication with each other via the connecting member 454 (flow channel 454*a*).

The convex portion 460 disposed in the base portion of the first connecting portion 451 (second coupler 442) is mated with the notch 470*b* of the body portion 470 (third coupler 443). This allows the third coupler 443 to be connected to the second coupler 442 well.

Then, the first coupler 441 is coupled to a coupled body of the third coupler 443 and the second coupler 442, thereby assembling the coupler 440. Specifically, when the first coupler 441 is coupled to the second coupler 442, the first connecting portion 451 of the first coupler 441 from which the cap 455 has been removed to expose the connecting member 454 is inserted into the holding member 461 of the second coupler 442 from which the lid portion 463 has been removed. Thus, the connecting member 454 disposed at the top of the first connecting portion 451 is inserted into the concave portion 456 disposed at the end of the second connecting portion 452 of the second coupler 442.

At this time, the movable rubber stopper 456*a* is pushed into the concave portion 456 by the connecting member 454.

As a result, the second flow channel 439*b* closed by the movable rubber stopper 456*a* is unclosed and the internal flow channels 439 of the first coupler 441 and the second coupler 442 are brought in communication with each other via the connecting member 454 (flow channel 454*a*). The convex portion 460 disposed in the base portion of the first connecting portion 451 (first coupler 441) is mated with the notch 461*a* of the holding member 461 (second coupler 442). This allows the first coupler 441 to be connected to the second coupler 442 well.

Thus, the coupler 440 can be assembled. The coupler 440 is configured to supply the drug liquid 56, which is a mixed liquid of the drug liquid 15 supplied from the bag for intravenous drip 10A to the first coupler 441 via the tube for intravenous drip 13A and the drug liquid 55 supplied from the bag for intravenous drip 10B to the second coupler 442 via the tube for intravenous drip 13B, to the injection needle 14 via the tube 44 connected to the third coupler 443, based on the above described configuration.

Therefore, also in the present modification example, the intravenous drip device 51 couples two bags for intravenous drip 10A and 10B to each other, so that 153 mg worth of the drug liquid 56 can be intravenously dripped. Note that, the drug liquids 15 and 55 contained in the bags for intravenous drip 10A and 10B may be the same type as or different type from each other.

For the coupler 440 according to the second modification example, the case in which the movable rubber stopper 456*a* is used for the first coupler 441 and the second coupler 442 and the movable rubber stopper 478 is used for the third coupler 443 has been described as an example, but the present invention is not limited thereto.

Note that, in the above embodiment and modification example, the configuration in which the drug-enclosing portion and the bag are integrally formed as the kit product has been described as an example, but the present invention is not limited thereto. For example, the drug-enclosing portion and the bag may be formed of separate members.

Figure 11:
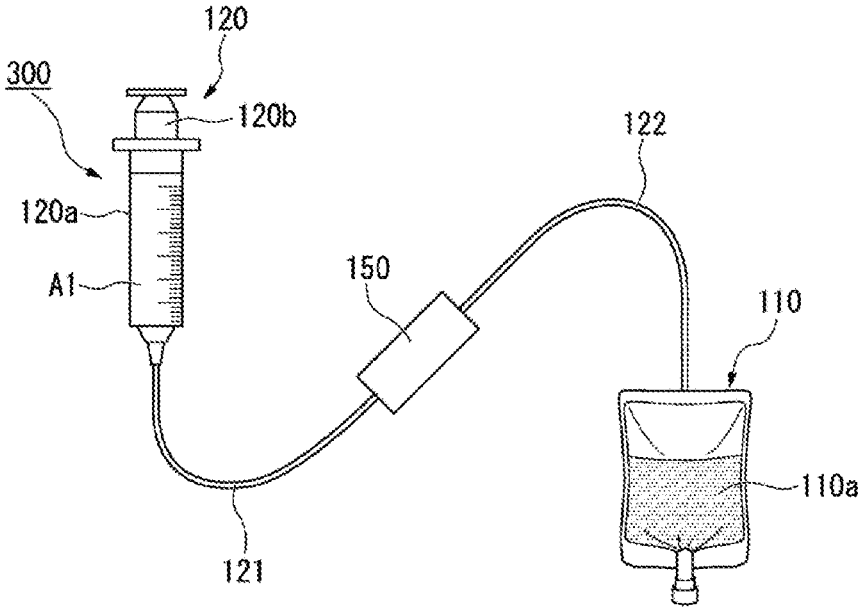
FIG. 11 is a view illustrating a configuration of a kit product according to one exemplary modification example.

FIG. 11 is a view illustrating one exemplary schematic configuration of a kit product 300 according to the modification example. As illustrated in FIG. 11, the kit product 300 includes a bag 110 containing a liquid 110*a*, a drug-enclosing portion 120 enclosing the predetermined drug, and a sealing portion 150 disposed between the bag 110 and the drug-enclosing portion 120.

The drug-enclosing portion 120 includes a cylinder portion 120*a* and a piston portion 120*b* attached to the cylinder portion 120*a*. The cylinder portion 120*a* contains the drug A1 therein and is configured to be able to push out the predetermined amount of the drug A1 by the piston portion 120*b*. The drug-enclosing portion 120 keeps the drug A1 enclosed therein so as to prevent the drug A1 from leaking outside.

In the drug-enclosing portion 120, an inside of the cylinder portion 120*a* has a negative pressure so that the piston portion 120*b* is not detached from the cylinder portion 120*a*. Note that, a lock mechanism configured to fix a positional relationship between the piston portion 120*b* and the cylinder portion 120*a* may be disposed.

The structure of the sealing portion 150 will now be described below. A tube 121 connects between the drug-enclosing portion 120 and the sealing portion 150. A tube 122 connects between the sealing portion 150 and the bag 110.

Based on such a configuration, upon drug preparation, the sealing portion 150 is configured to able to charge the predetermined amount of the drug A1 supplied from the drug-enclosing portion 120 into the bag 110 via the tube 122 as described below. This allows the drug liquid prepared from the drug A1 and a liquid 110*a* to be contained in the bag 110.

In the drug-enclosing portion 120, the drug-enclosing portion 120 is configured to be able to be separated from the sealing portion 150 along with the tube 121 after drug preparation. Thus, the residue of the drug A1, which remains in the drug-enclosing portion 120 without being used in the drug preparation, is cut away from the bag 110. The sealing portion 150 is configured to re-enclose the drug liquid in the bag 110. The bag 110 from which the drug-enclosing portion 120 has been separated to isolate (cut away) an unused drug A1 is used as the bag for intravenous drip.

According to the kit product 300 illustrated in FIG. 11, the drug preparation work requiring the dose adjustment can be performed without exposing the drug A1 to the outside air, that is, without a risk of exposure while preventing exposure to the drug A1 which may affect human body, thereby conveniently producing the predetermined dose of the drug liquid.

The residue of the drug A1, which remains in the drug-enclosing portion 120 without being used in the drug preparation, can be completely cut away from the bag 110. This makes it possible to reliably prevent the exposure to the drug A1 from occurring.

(Sealing portion)

First Embodiment

Figure 34A:
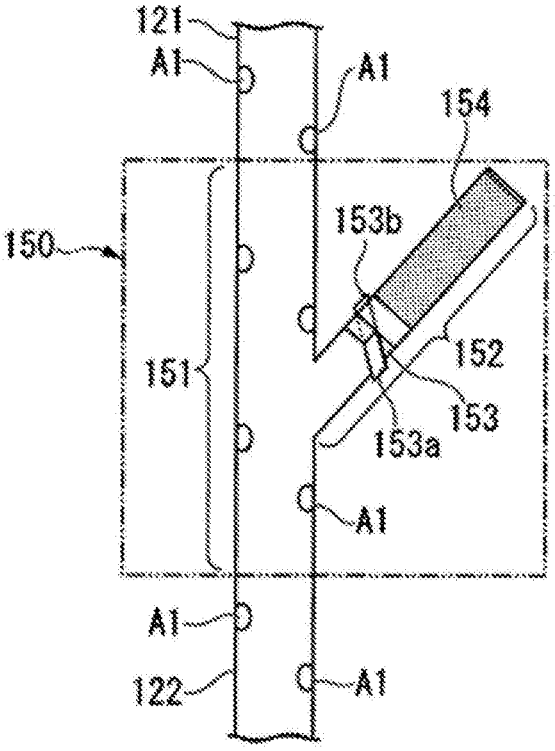
FIG. 34*a* is a view-1 illustrating one exemplary configuration of the first embodiment of a sealing portion.
Figure 34B:
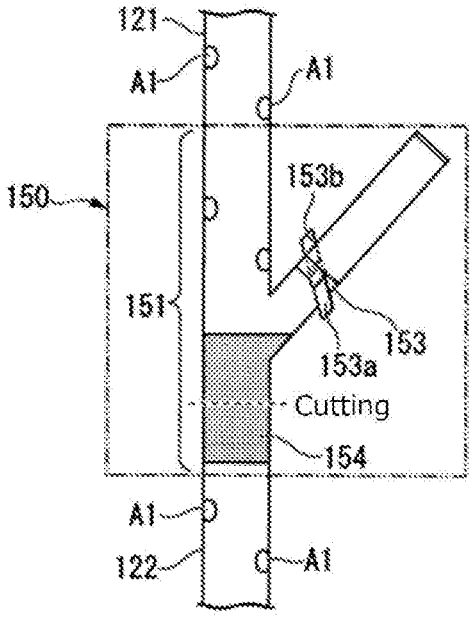
FIG. 34*b* is a view-2 illustrating one exemplary configuration of the first embodiment of a sealing portion.

FIGS. 34*a* and 34*b* are views illustrating one exemplary configuration of the first embodiment of the sealing portion 150. The sealing portion 150 according to the present embodiment includes a tube 151 connected to the tube 121 and the tube 122, and a tube 152 branched from the tube 151. The tube 152 contains a water absorptive polymer 154 therein, and a sealing portion 153 is disposed between the tube 152 and the tube 151. Examples of the water absorptive polymer 154 include polymers having intramolecular or extramolecular acid anhydride groups. More specifically, for example, poly[2,2'-(ethylenedisulfonyl)diacetic anhydride], poly(maleic anhydride), poly(anhydroitaconic acid), poly (acrylic anhydride), or poly(acrylic methacrylic anhydride) may be used.

The sealing portion 153 may include grip portions 153*a* and 153*b* configured to be gripped and pulled by, for example, fingers to thereby open the sealing portion 153. When the drug-enclosing portion 120 is separated from the bag 110 after drug preparation, the sealing portion 153 is firstly opened by gripping and pulling the grip portions 153*a* and 153*b*. Then, the water absorptive polymer 154 contained in the tube 152 is transferred into the tube 151 by gripping the tube 152 by fingers. As a result, the water absorptive polymer 154 adsorbs liquid droplets of the drug A1 remaining in the tube 151.

Then, the tube 151 is cut at a center of the water absorptive polymer 154 by, for example, the hot sealer. This makes it possible to seal the thus-produced cut section through heat sealing reliably. For example, when the water absorptive polymer 154 is the polymer having acid anhydride groups, the liquid droplets of the drug A1 chemically binds to the water absorptive polymer 154. Therefore, even when heating by for example, the hot sealer, drug A1-containing vapor is prevented from leaking outside.

Second Embodiment

Figure 35A:
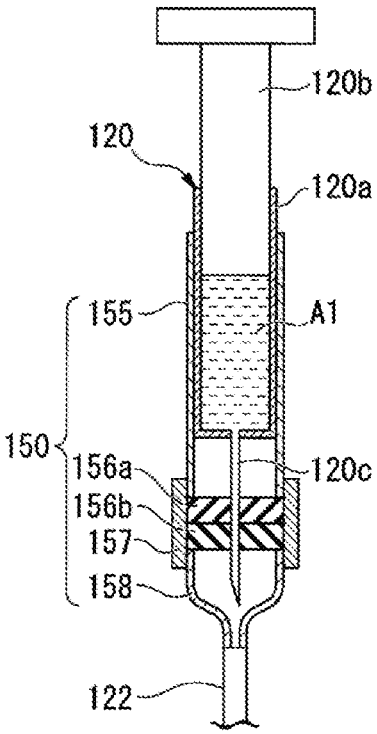
FIG. 35*a* is a view-1 illustrating one exemplary configuration of the second embodiment of a sealing portion.

FIGS. 35*a* to 35*d* are views illustrating one exemplary configuration of the second embodiment of the sealing portion 150. As illustrated in FIG. 35*a*, the sealing portion 150 according to the present embodiment is disposed adjacent to the drug-enclosing portion 120, and includes an outer cylinder portion 155 circumscribed on the cylinder portion 120*a*, a rubber member 156*a* disposed at one end of the outer cylinder portion 155, a rubber member 156*b* tightly contacting with the rubber member 156*a*, a fastener 157 configured to fasten the rubber members 156*a* and 156*b*, and a connecting portion 158 configured to connect the rubber member 156*b* with the tube 122. The cylinder portion 120*a* is configured to be able to move in the outer cylinder portion 155, but not to be removed from the outer cylinder portion 155.

As illustrated in FIG. 35*a*, the cylinder portion 120*a* includes a needle member 120*c*. The required amount of the drug A1 is charged upon drug preparation by piercing the rubber members 156*a* and 156*b* with the needle member 120*c* and pushing the piston portion 120*b* down.

Figure 35B:
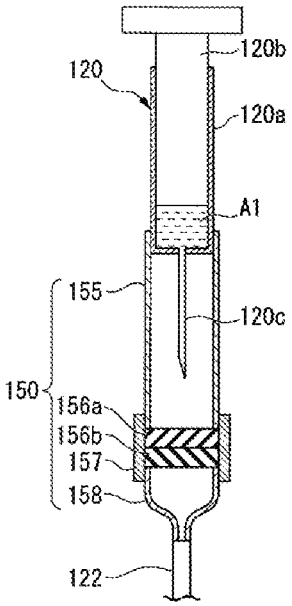
FIG. 35*b* is a view-2 illustrating one exemplary configuration of the second embodiment of a sealing portion.
Figure 35C:
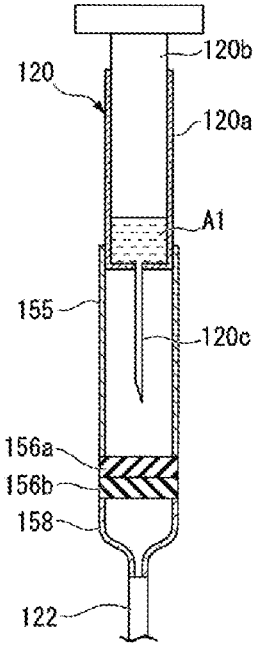
FIG. 35*c* is a view-3 illustrating one exemplary configuration of the second embodiment of a sealing portion.
Figure 35D:
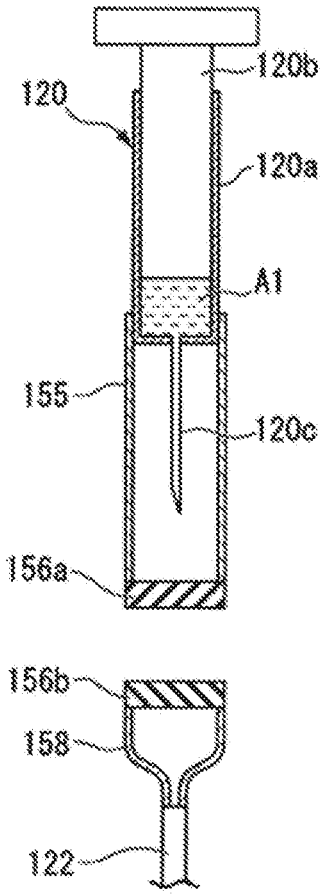
FIG. 35*d* is a view-4 illustrating one exemplary configuration of the second embodiment of a sealing portion.

As illustrated in FIG. 35*b*, when the drug-enclosing portion 120 is separated from the bag 110 after drug preparation, the needle member 120*c* is firstly pulled out of the rubber members 156*a* and 156*b*. Then, as illustrated in FIG. 35*c*, the fastener 157 is removed. Then, as illustrated in FIG. 35*d*, the rubber members 156*a* and 156*b* are separated from each other. This makes it possible to safely separate the drug-enclosing portion 120 from the bag 110 without leaking the drug A1 remaining in the cylinder portion 120*a*.

According to the present invention, for example, regimens of (1) lung cancer, (2) breast cancer, (3) stomach cancer, (4) esophageal cancer, (5) colon cancer, (6) liver, gallbladder, and pancreatic cancer, (7) gynecologic cancer, (8) urinary cancer, (9) hematopoietic tumor, and (10) head and neck cancer can be formed into kits.

(1. Regimen of Lung Cancer)

Note that, the following abbreviations are used in the regimen of lung cancer: CDDP (cisplatin), CPT-11 (irinotecan), ETP (etoposide), CBDCA (carboplatin), AMR (amrubicin), GEM (gemcitabine), BV (bevacizumab), DTX (docetaxel), VNR (vinorelbine), Erlotinib (erlotinib), Gefitinib (gefitinib), PTX (paclitaxel), and ALIMTA (alimta).

(1-1) Small Cell Lung Cancer

IP (CDDP+CPT-11) therapy, PE (CDDP+ETP) therapy, CBDCA+ETP therapy, CPT-11 monotherapy, and AMR monotherapy.

(1-2) Non-Small Cell Lung Cancer

IP (CDDP+CPT-11) therapy, GP (CDDP+GEM)±BV therapy, DC (CDDP+DTX) therapy, NP (CDDP+VNR) therapy, DTX monotherapy, Erlotinib monotherapy, Gefitinib monotherapy, TC (CBDCA+PTX)±BV therapy, and ALIMTA monotherapy.

(1-3) Malignant Pleural Mesothelioma

CDDP+ALIMTA therapy.

(2. Regimen of Breast Cancer)

Note that, the following abbreviations are used in the regimen of breast cancer: CPA (cyclophosphamide), MTX (methotrexate), 5-FU (5-fluorouracil), DXR (doxorubicin), EPI (epirubicin), PTX (paclitaxel), DTX (docetaxel), Trastuzumab (trastuzumab), VNB (vinorelbine), Capecitabine (capecitabine), S-1 (tegafur-gimeracil-oteracil), Lapatinib (lapatinib), and GEM (gemcitabine).

CMF (CPA+MTX+5-FU) therapy, AC (DXR+CPA) therapy, EC (EPI+CPA) therapy, AC (DXR+CPA) followed BY PTX therapy, CAF (CPA+DXR+5-FU) therapy, FEC (CPA+EPI+5-FU) followed BY PTX100 therapy, DAC (DTX+DXR+CPA) therapy (TAC therapy), TC (DTX+CPA) therapy, Trastuzumab monotherapy, DTX monotherapy, Weekly PTX monotherapy, VNB monotherapy, Capecitabine monotherapy S-1 monotherapy, Lapatinib+Capecitabine therapy, and GEM monotherapy.

(3. Regimen of Stomach Cancer)

Note that, the following abbreviations are used in the regimen of stomach cancer: CDDP (cisplatin), PTX (paclitaxel), and S-1 (tegafur-gimeracil-oteracil).

S-1 monotherapy, S-1+CDDP therapy, and PTX monotherapy.

(4. Regimen of Esophageal Cancer)

Note that, the following abbreviations are used in the regimen of esophageal cancer: CDDP (cisplatin), 5-FU (5-fluorouracil), and DTX (docetaxel).

FP (5-FU+CDDP)+RT (radiation) therapy, and DTX monotherapy.

(5. Regimen of Colon Cancer)

Note that, the following abbreviations are used in the regimen of colon cancer: 1-LV (levofolinate), LV (folinate), UFT (tegafur-uracil), L-OHP (oxaliplatin), 5-FU (5-fluorouracil), BV (bevacizumab), Cetuximab (cetuximab), Capecitabine (capecitabine), Panitumumab (panitumumab), and CPT-11 (irinotecan).

5-FU+1-LV therapy. UFT+LV therapy, Capecitabine monotherapy mFOLFOX6 (5-FU+1-LV+L-OHP)±BV therapy FOLFIRI (5-FU+1-LV+CPT-11)±BV therapy, CPT-11 monotherapy, Cetuximab monotherapy CPT-11+Cetuximab therapy, XELOX (Capecitabine+L-OHP)±BV therapy, Panitumumab±FOLFOX6 or FOLFIRI therapy.

(6. Regimen of Liver, Gallbladder, and Pancreatic Cancer)

Note that, the following abbreviations are used in the regimen of liver, gallbladder, and pancreatic cancer: Sorafenib (sorafenib), GEM (gemcitabine), and CDDP (cisplatin).

(6-1) Hepatocellular Cancer

Sorafenib monotherapy.

(6-2) Biliary Tract Cancer

GEM monotherapy and GC (CDDP+GEM) therapy.

(6-3) Pancreatic Cancer

GEM monotherapy.

(7. Regimen of Gynecologic Cancer)

Note that, the following abbreviations are used in the regimen of gynecologic cancer: CDDP (cisplatin), CPT-11 (irinotecan), CBDCA (carboplatin), DTX (docetaxel), PTX (paclitaxel), DXR (doxorubicin), Topotecan (topotecan), Nogitecan (nogitecan), and Liposomal Doxorubicin (liposome preparation of doxorubicin (doxil)).

(7-1) Uterine Cervix Cancer

CDDP+RT (radiation) therapy CT (CDDP+Topotecan/Nogitecan) therapy, and TP (PTX+CDDP) therapy.

(7-2) Uterine Body Cancer

AP (DXR+CDDP) therapy and TAP (PTX+DXR+CDDP) therapy.

(7-3) Ovarian Cancer

TC (PTX+CBDCA) therapy, DC (DTX+CBDCA) therapy, PTX monotherapy DTX monotherapy, CPT-11 monotherapy, Liposomal Doxorubicin monotherapy, and Dose-dence TC (weekly PTX+CBDCA) therapy.

(8. Regimen of Urinary Cancer)

Note that, the following abbreviations are used in the regimen of urinary cancer: CDDP (cisplatin), MTX (methotrexate), DXR (doxorubicin), DTX (docetaxel), GEM (gemcitabine), PSL (prednisolone), EP (estramustine), VP-16 (etoposide), BLM (bleomycin), IFM (ifosfamide), VLB (vinblastine), IFN-α (interferon α), Sorafenib (sorafenib), Sunitinib (sunitinib), and Everolomus (everolimus).

(8-1) Bladder Cancer

M-VAC (MTX+VLB+DXR+CDDP) therapy, and GC (GEM+CDDP) therapy.

(8-2) Prostatic Cancer

DP (DTX+PSL) therapy and DE (DTX+EP) therapy.

(8-3) Germ Cell Tumor

BEP (CDDP+VP-16+BLM) therapy, EP (CDDP+VP-16) therapy, VIP (CDDP+VP-16+IFM) therapy and VelP (CDDP+IFM+VLB) therapy.

(8-4) Renal Cell Cancer

IFN-α monotherapy, Sorafenib monotherapy, Sunitinib monotherapy, and Everolomus monotherapy.

(9. Regimen of Hematopoietic Tumor)

Note that, the following abbreviations are used in the regimen of hematopoietic tumor: DXR (doxorubicin), PSL (prednisolone), IDR (idarubicin), Ara-C (cytarabine), a complex of Gemtuzumab ozogamicin: antibody (Gemtuzumab) and a natural product (ozogamicin), Imatinib (imatinib), F-ara-A (fludarabine), L-PAM (melphalan), VCR (vincristine), DXR (doxorubicin), Dexamethasone (dexamethasone), Bortezomib (bortezomib), Thalidomide (thalidomide), Lenalidomide (lenalidomide), BLM (bleomycin), CDDP (cisplatin), DXR (doxorubicin), PSL (prednisolone), VP-16 (etoposide), IFM (ifosfamide), VLB (vinblastine), VCR (vincristine), mPSL (methylprednisolone), Ara-c (cytarabine), CPA (cyclophosphamide), CBDCA (carboplatin), Bendamustine (bendamustine), and DTIC (dacarbazine).

(9-1) Acute Myelogenous Leukemia

IDR+Ara-C therapy, High dose Ara-C therapy and Gemtuzumab ozogamicin monotherapy.

(9-2) Chronic Myelogenous Leukemia

Imatinib monotherapy.

(9-3) Chronic Lymphogenous Leukemia

F-ara-A monotherapy.

(9-4) Multiple Myeloma

MP (L-PAM+PSL) therapy, VAD (VCR+DXR+Dexamethasone) therapy, Bortezomib therapy, Thalidomide monotherapy, and Lenalidomide monotherapy.

(9-5) Malignant Lymphoma

ABVD (DXR+BLM+VLB+DTIC) therapy, R-CHOP (Rituximab+CPA+DXR+VCR+PSL) therapy, ESHAP (VP-16+mPSL+Ara-C+CDDP) therapy, EPOCH (VP-16+VCR+DXR+CPA+PSL) therapy, ICE (IFM+CBDCA+VP-16) therapy, and Bendamustine monotherapy.

(10. Regimen of Head and Neck Cancer)

Note that, the following abbreviations are used in the regimen of head and neck cancer: CDDP (cisplatin), 5-FU (5-fluorouracil), and DTX (docetaxel).

CDDP+RT (radiation) therapy, FP (5-FU+CDDP)+RT (radiation) therapy, and DTX monotherapy.

Second Embodiment

Figure 12:
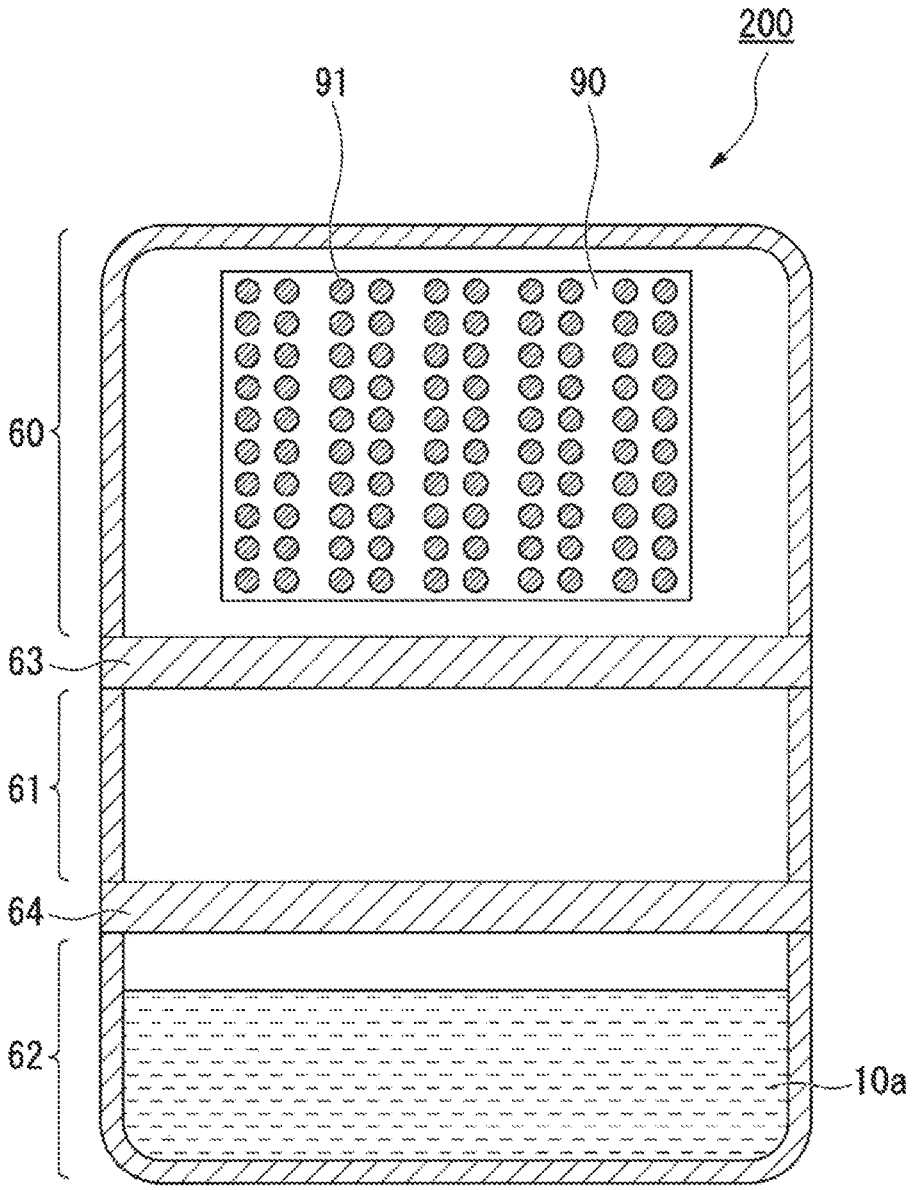
FIG. 12 is a view illustrating one exemplary schematic configuration of a kit product according to the second embodiment.

A configuration of the kit product according to the second embodiment will now be described. FIG. 12 is a view illustrating one exemplary schematic configuration of a kit product according to the present embodiment. Note that, the kit product illustrated in FIG. 12 is before drug preparation.

As illustrated in FIG. 12, a kit product 200 according to the present embodiment includes a bag 62 containing a liquid 10*a*, a drug-enclosing portion 60 enclosing a drug 91, an administrated drug-containing portion 61, a first sealing portion 63 disposed between the drug-enclosing portion 60 and the administrated drug-containing portion 61, and a second sealing portion 64 disposed between the administrated drug-containing portion 61 and the bag 62. Note that, the first sealing portion 63 is not necessary and the first sealing portion 63 may be omitted. The drug-enclosing portion 60 may be said as one enclosing a drug and including the sealing portion 63 or 64.

In the present embodiment, the bag 62, the drug-enclosing portion 60, the administrated drug-containing portion 61, the first sealing portion 63, and the second sealing portion 64 are made by thermoforming a sheet-like plastic material and integrally formed. In the present embodiment, like the drug A in the first embodiment, the drug 91 includes, for example, the cytotoxic anti-cancer agent. Note that, the drug 91 may be a drug which needs to be dose-adjusted.

The drug-enclosing portion 60 is formed on the first sealing portion 63. The drug-enclosing portion 60 encloses, for example, 100 mg worth of the drug 91 as a whole. In the present embodiment, the drug 91 is contained in a drug plate 90. The drug plate 90 is contained in the drug-enclosing portion 60. The drug plate 90 is temporarily fixed on a side wall portion (not illustrated) of the drug-enclosing portion 60 and is configured to be able to easily separate individual pieces from the side wall portion by dividing into pieces as described below and applying the predetermined force.

Figure 13:
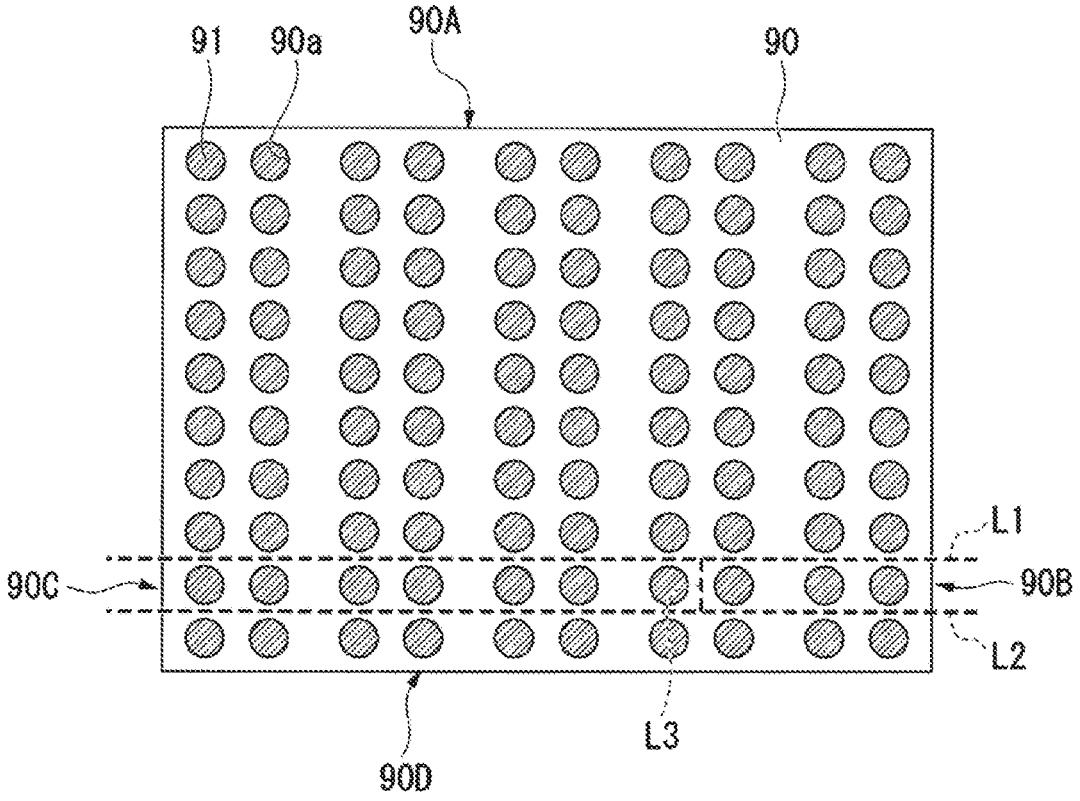
FIG. 13 is a view illustrating one exemplary schematic configuration of a drug plate.

FIG. 13 is a view illustrating one exemplary schematic configuration of the drug plate 90. As illustrated in FIG. 13, the drug plate 90 includes a plurality of (e.g., 100) drug-housing portions 90*a* arranged in a matrix. The drug-housing portions 90*a* are partitioned for each amount and each contains the predetermined amount (e.g., 1 mg) of the drug 91. The drug 91 may be freeze-dried in the drug-housing portion 90*a* rather than tablets. In the case of the tablets, special facilities are generally needed to sterilize the tablets. However, the freeze-dried powder preparation can be produced in a sterile state. In the present embodiment, the drug plate 90 contains, for example, 100 mg worth of the drug 91 as a whole.

The drug plate 90 has cutting lines (not illustrated) along a direction in which the drug-housing portions 90*a* are arranged. The drug plate 90 is configured to be able to be easily separated along the culling lines by applying external force. This makes it possible to divide the drug plate 90 into pieces including the predetermined amount of the drug 91 as described below.

The administrated drug-containing portion 61 is a portion configured to contain the pieces divided from the drug plate 90. In the administrated drug-containing portion 61, the drug 91 housed in the drug-housing portion 90*a* of the piece is taken out as described below.

The first sealing portion 63 bonds a surface side and a back surface side of the kit product 200 with, for example, heat sealing or known adhesives and is configured to be easily openable when external pressure is applied (e.g., by fingers). The drug-enclosing portion 60 is configured to be able to cut away from the bag 62 (administrated drug-containing portion 61) by, for example, cutting the first sealing portion 63 with the hot sealer.

The second sealing portion 64 bonds a surface side and a back surface side of the bag 62 with, for example, heat sealing or known adhesives. The second sealing portion 64 seals the liquid 10*a* in the bag 62. The first sealing portion 63 is opened by applying external force in a direction pulling the surface side and the back surface side of the bag 62 away from each other to thereby release a bonded state. Once the second sealing portion 64 is opened, the administrated drug-containing portion 61 is brought into communication with the bag 62. This makes it possible to charge the drug 91 from the administrated drug-containing portion 61 into the bag 62.

The drug preparation in the kit product 200 according to the present embodiment will now be described.

Figure 14:
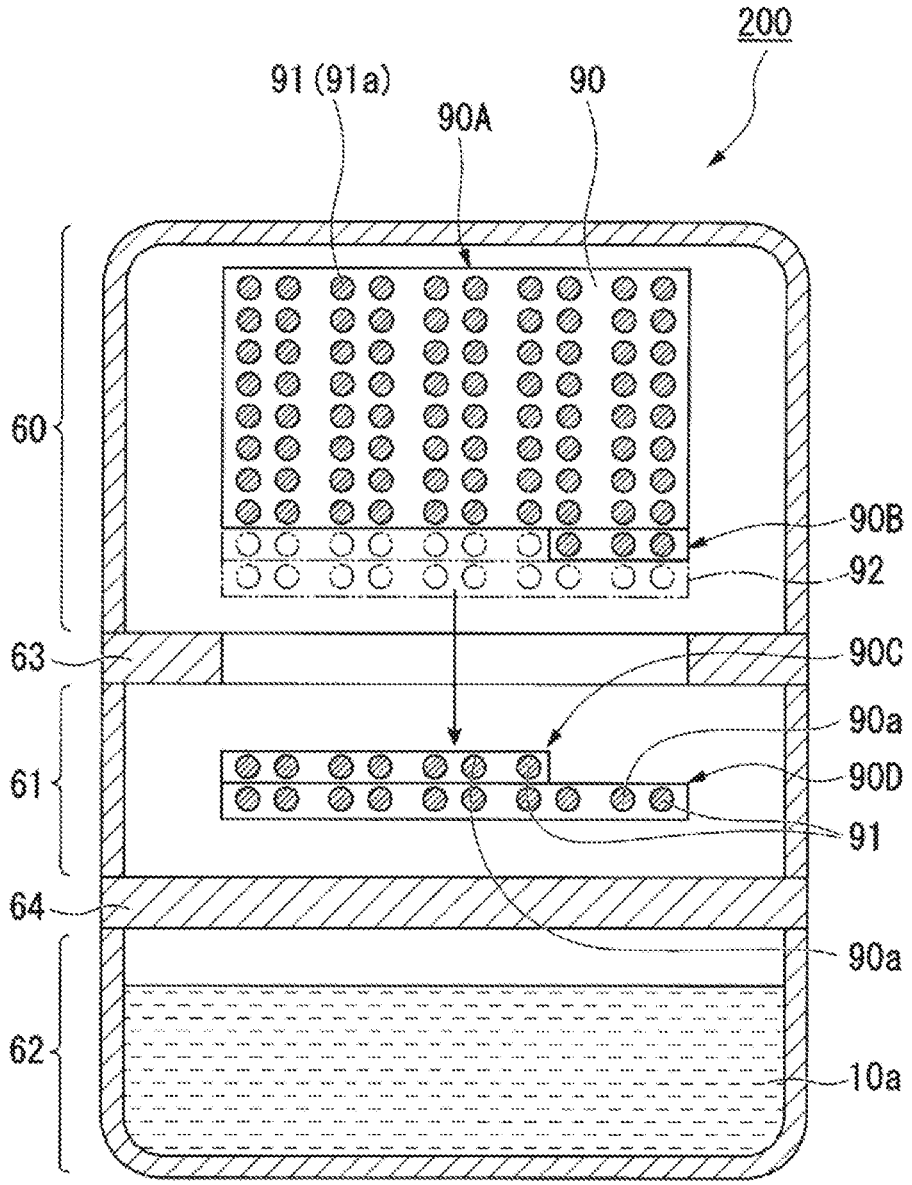
FIG. 14 is an explanatory view illustrating one exemplary drug preparation (dose adjustment) of a kit product according to the second embodiment.
Figure 15:
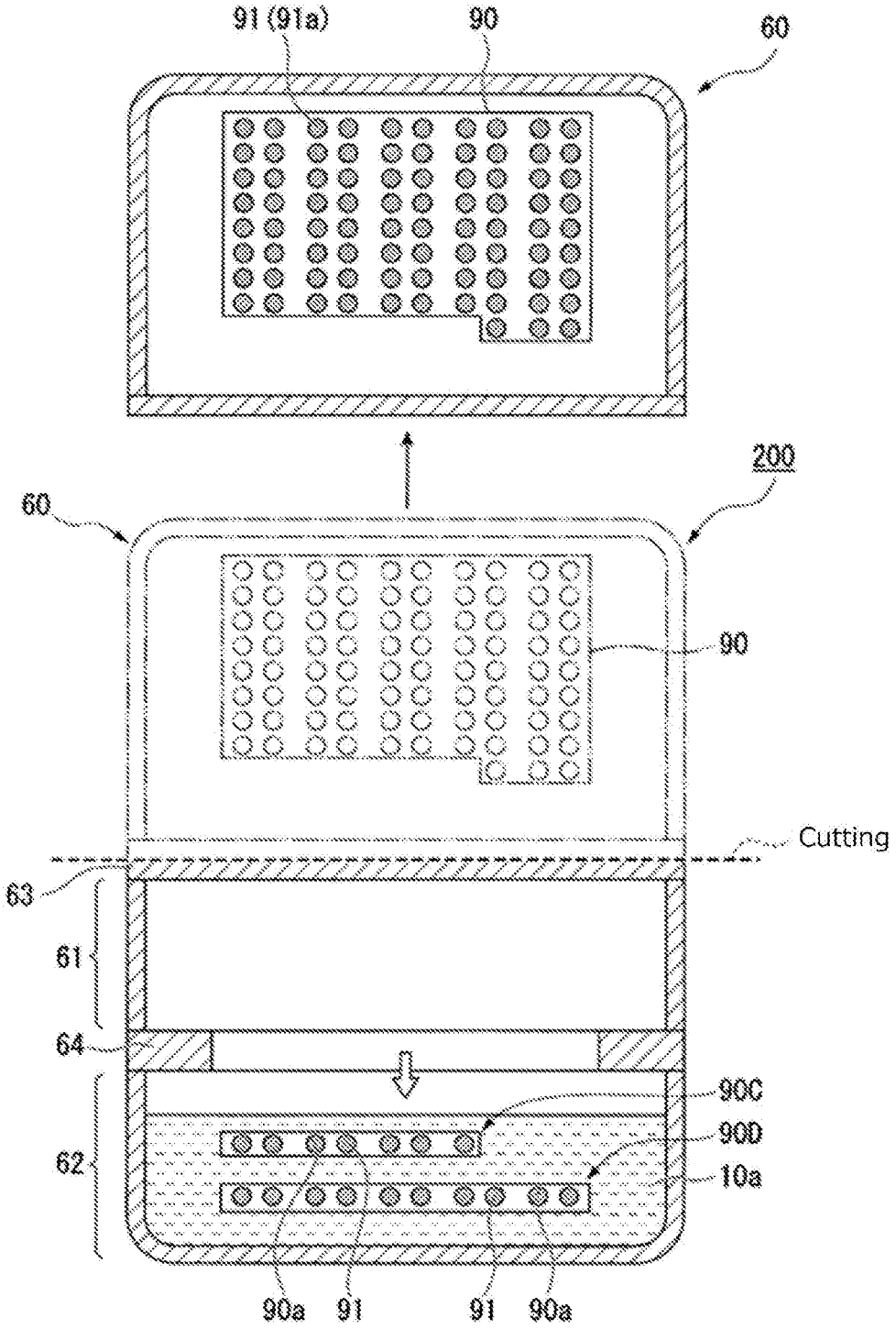
FIG. 15 is an explanatory view illustrating one exemplary drug preparation (dose adjustment) of a kit product according to the second embodiment, as with FIG. 8.

FIGS. 14 and 15 are explanatory views illustrating the drug preparation of the kit product 200. The case in which 17 mg worth out of 100 mg of the drug 91 contained in the drug-enclosing portion 60 (drug plate 90) as a whole is charged into the bag 62 will now be described.

First, external pressure is applied (e.g., by fingers) to the drug plate 90 contained in the drug-enclosing portion 60, thereby cutting the drug plate 90 along a first cutting line L1, a second cutting line L2, and a third cutting line L3 (see FIG. 13). Thus, the drug plate 90 is divided into four portions, i.e., a first plate portion 90A, a second plate portion 90B, a third plate portion 90C, and a fourth plate portion 90D.

The first plate portion 90A includes eighty drug-housing portions 90*a*, the second plate portion 90B includes three drug-housing portions 90*a*, the third plate portion 90C includes seven drug-housing portions 90*a*, and the fourth plate portion 90D includes ten drug-housing portions 90*a*.

Then, the first sealing portion 63 is opened by applying external pressure (e.g., by fingers) (e.g., pulling the surface 11 away from the back surface 12). This brings the drug-enclosing portion 60 into communication with the administrated drug-containing portion 61, thereby transferring the third plate portion 90C and the fourth plate portion 90D, which hold a total of 17 mg of the drug 91 together, from the drug-enclosing portion 60 into the administrated drug-containing portion 61, as illustrated in FIG. 14. The first plate portion 90A and the second plate portion 90B remain in the drug-enclosing portion 60. Note that, the reference numeral 92 in FIG. 14 denotes the third plate portion 90C and the fourth plate portion 90D before transferred.

Then, as illustrated in FIG. 15, the first sealing portion 63 is cut with the hot sealer to cut away the drug-enclosing portion 60 from the bag 62 (administrated drug-containing portion 61). This makes it possible to seal the thus-produced cut section through heat sealing reliably. Therefore, the drug 91*a* remaining in the drug plate 90 of the drug-enclosing portion 60 is prevented from leaking outside (exposure).

Then, the second sealing portion 64 is opened by applying external pressure (e.g., by fingers) (e.g., pulling the surface 11 away from the back surface 12 (see FIG. 3)). Note that, the second sealing portion 64 only has to be opened to the extent that the third plate portion 90C and the fourth plate portion 90D can pass therethrough.

This brings the administrated drug-containing portion 61 into communication with the bag 62, thereby charging the third plate portion 90C and the fourth plate portion 90D in the administrated drug-containing portion 61 into the bag 62. Thus, the drug 91 (e.g., 17 mg worth) contained in the drug-housing portions 90*a* of the third plate portion 90C and the fourth plate portion 90D is mixed with the liquid 10*a*, thereby forming the predetermined dose of the drug liquid in the bag 62. Note that, after the drug 91 is charged into the bag 62, the surface 11 and the back surface 12 may be re-bonded in the second sealing portion 64 through, for example, heat sealing.

Thus, the bag 62 from which the drug-enclosing portion 60 has been cut to isolate (cut away) an unused drug 91*a* is available as a bag for intravenous drip as described below.

The kit product 200 according to the present embodiment enables simple and reliable production of a drug liquid having the predetermined concentration while preventing exposure to the drug 91 which may affect human body.

Moreover, the drug 91*a* (residual drug), which remains in the drug-enclosing portion 60 without being used in the drug preparation, can be completely cut away from the bag 62. Therefore, for example, even when the drug-enclosing portion 60 is damaged by applying external force to the bag 62, the drug 91 does not remain in the drug-enclosing portion 60. This makes it possible to reliably prevent the exposure to the drug 91 from occurring.

Medical accidents due to overdose (e.g., an operator (medical practitioner) charges the residue of the drug 91 into the bag 62 by mistake) can be prevented from occurring because the drug 91 does not remain in the drug-enclosing portion 60. Moreover, the residue of the drug 91 remaining in the drug-enclosing portion 60, which has been cut away from the bag 62, can be reused. Therefore, the drug 91 can be used without waste.

In the second embodiment, the case in which the third plate portion 90C and the fourth plate portion 90D, which have been formed by cutting the drug plate 90 into the predetermined size, are charged into the bag 62 via the administrated drug-containing portion 61 has been described as an example, but the present invention is not limited thereto.

For example, in the drug-enclosing portion 60, a desired amount of the drug 91 to be needed may be removed from the drug-housing portion 90*a* of the drug plate 90. Then, only the thus-removed drug 91 may be charged into the bag 62 via the administrated drug-containing portion 61. That is, the drug plate 90 may not be separated by cutting into the predetermined size. Thus, when the drug 91 is directly charged from the drug plate 90 into the bag 62, the administrated drug-containing portion 61 and the second sealing portion 64 may be omitted from the kit product 200. This enables a simple configuration of the kit product 200 and a cost reduction.

In the second embodiment, the configuration including 100 drug-housing portions 90*a* as the drug plate 90 has been described as an example, but the present invention is not limited thereto.

Figure 16:
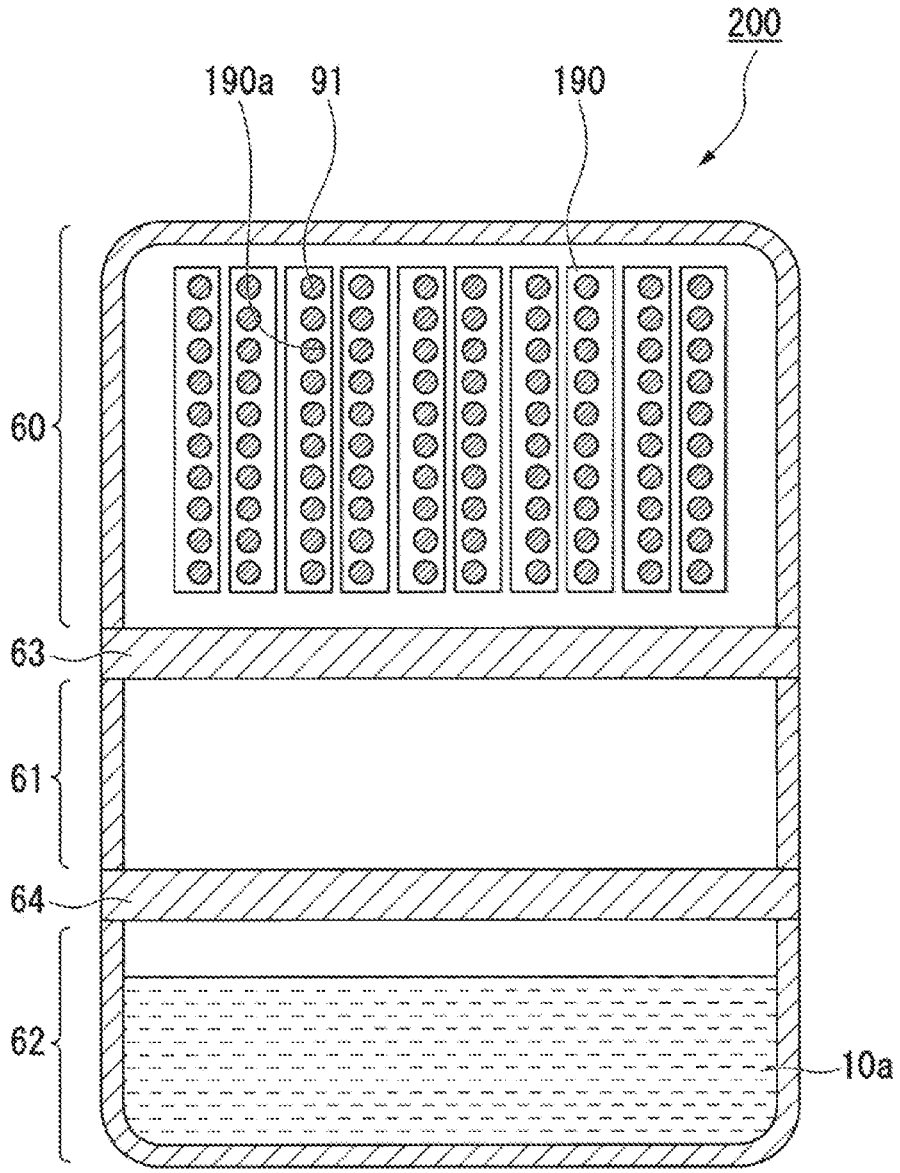
FIG. 16 is an explanatory view illustrating one exemplary drug preparation (dose adjustment) of a kit product according to a modification example of the second embodiment.

For example, in the kit product 200 according to the second embodiment, as illustrated in FIG. 16, the drug-enclosing portion 60 may include a plurality of (e.g., 10) drug plates 190. Each of the drug plates 190 includes a plurality of (e.g., 10) drug-housing portions 190*a* arranged in a matrix. Each of the drug-housing portions 190*a* is partitioned for each amount and contains the predetermined amount (e.g., 1 mg) of the drug 91. In the configuration illustrated in FIG. 16, the drug-enclosing portion 60 encloses, for example, 100 mg worth of the drug 91 as a whole in the plurality of drug plates 190.

The drug plate 190 has cutting lines (not illustrated) along a direction in which the drug-housing portions 190*a* are arranged. The drug plate 190 is configured to be able to be easily separated along the culling lines by applying external force. This makes it possible to divide the drug plate 190 into pieces including the predetermined amount (e.g., 1 mg) of the drug 91.

According to the configuration illustrated in FIG. 16, the plurality of drug plates 190 holding the drug 91 in units of small amounts (e.g., in units of 10 mg) is contained in the drug-enclosing portion 60. This significantly or completely eliminates the trouble of dividing the drug plate 190 into pieces compared with the configuration illustrated in FIG. 12 (specifically, the number of times of cutting are decreased to one or zero). This makes it possible to simply perform the drug preparation work of charging the drug 91 into the bag 62.

Third Embodiment

A configuration of the kit product according to the third embodiment will now be described. The present embodiment is the modification example of the second embodiment. In the present embodiment, the drug plate 190 in the second embodiment may be cut into the drug-housing portions 190*a* one by one. That is, one drug plate 190 may include one drug-housing portion 190*a* containing the predetermined amount (e.g., 1 mg) of the drug 91 and the drug-enclosing portion 60 may contain, for example, 100 mg worth of the drug 91 as a whole. In the drug-enclosing portion 60, the drug plate 190 may be partitioned by partition walls one by one or few by few.

For example, the drug-enclosing portion 60 may include a compartment partitioned by the partition wall and containing one drug plate 190 including 50 mg of the drug 91; a compartment partitioned by the partition wall and containing four drug plates 190 each including 10 mg of the drug 91; a compartment partitioned by the partition wall and containing one drug plate 190 including 5 mg of the drug 91; and a compartment partitioned by the partition wall and containing five drug plates 190 each including 1 mg of the drug 91.

Such a configuration can completely eliminate the trouble of dividing the drug plate 190 into pieces (specifically, the number of times of cutting are decreased to zero). This makes it possible to simply perform the drug preparation work of charging the drug 91 into the bag 62.

Then, the drug preparation in the kit product according to the present embodiment will now be described. The case in which, for example, 83 mg worth of the drug 91 is charged from the drug-enclosing portion 60 into the bag 62 will now be described. First, the first sealing portion 63 is opened by applying external pressure (e.g., by fingers) (e.g., pulling portions corresponding to the surface 11 and the back surface 12 away from each other in FIG. 18 described below). This brings the drug-enclosing portion 60 into communication with the administrated drug-containing portion 61.

Then, one drug plate 190 including 50 mg of the drug 91, three drug plates 190 each including 10 mg of the drug 91, and three drug plates 190 each 1 mg of the drug 91 are transferred from the drug-enclosing portion 60 into the administrated drug-containing portion 61. One drug plate 190 including 10 mg of the drug 91, one drug plate 190 including 5 mg of the drug 91, and two drug plates 190 each including 1 mg of the drug 91 remain in the drug-enclosing portion 60.

Then, the first sealing portion 63 is cut with the hot sealer to cut away the drug-enclosing portion 60 from the bag 62 (administrated drug-containing portion 61). This makes it possible to seal the thus-produced cut section through heat sealing reliably. Therefore, the drug 91 remaining in the drug plate 190 of the drug-enclosing portion 60 is prevented from leaking outside (exposure).

Figure 18:
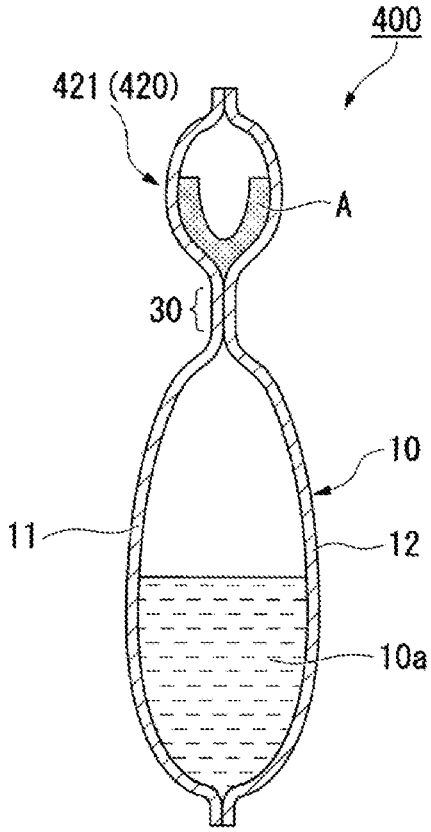
FIG. 18 is a view illustrating a cross-sectional structure taken through the line A-A of FIG. 17.

Then, the second sealing portion 64 is opened by applying external pressure (e.g., by fingers) (e.g., pulling portions corresponding to the surface 11 and the back surface 12 in FIG. 18 away from each other). This brings the administrated drug-containing portion 61 into communication with the bag 62. One drug plate 190 including 50 mg of the drug 91, three drug plates 190 each including 10 mg of the drug 91, and three drug plates 190 each including 1 mg of the drug 91 in the administrated drug-containing portion 61 are charged into the bag 62.

As a result, the drug 91 (e.g., 83 mg worth) is mixed with the liquid 10*a* to thereby form the predetermined dose of the drug liquid in the bag 62. Note that, after the drug 91 is charged into the bag 62, the surface 11 and the back surface 12 may be re-bonded in the second sealing portion 64 through, for example, heat sealing.

Thus, the bag 62 from which the drug-enclosing portion 60 has been cut to isolate (cut away) the unused drug 91 is available as a bag for intravenous drip as described below.

Fourth Embodiment

One exemplary configuration of a kit product according to the fourth embodiment will now be described.

Figure 17:
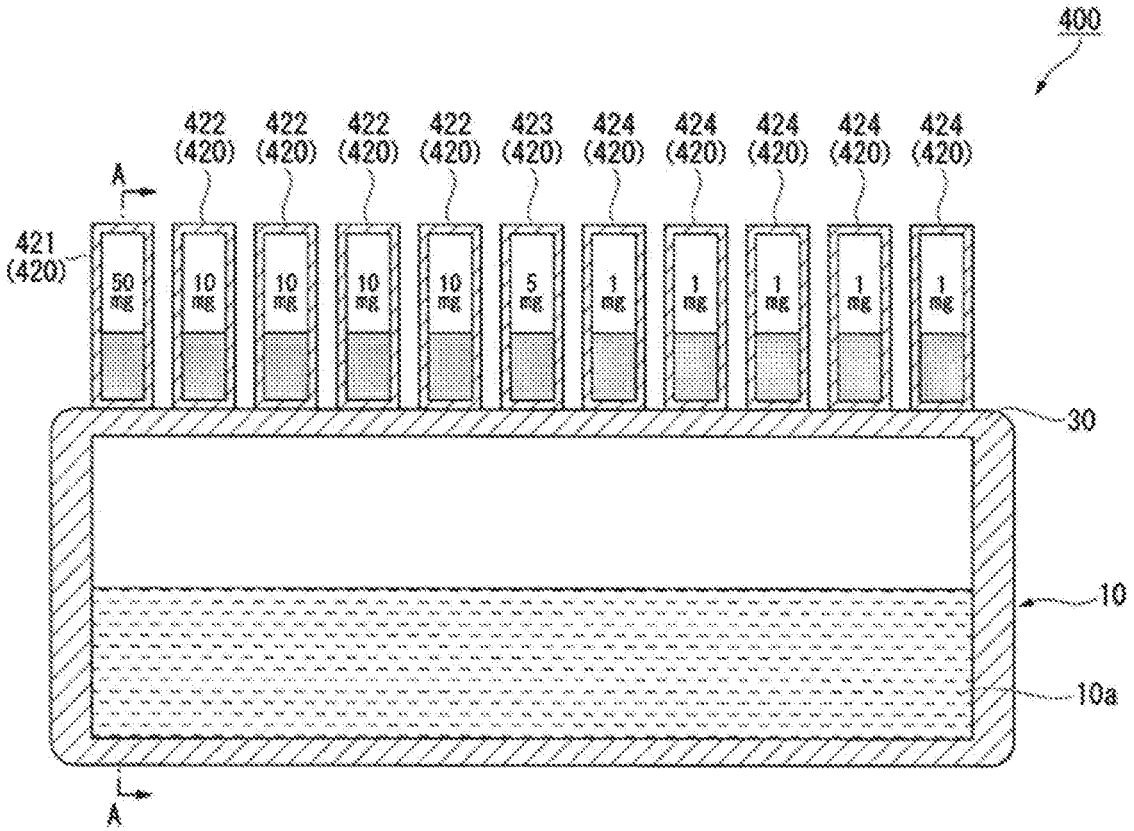
FIG. 17 is a view illustrating one exemplary essential-part configuration of a kit product according to the fourth embodiment.

FIG. 17 is a view illustrating an essential-part configuration of a kit product 400. The kit product 400 includes the bag 10 containing the liquid 10*a*, a drug-enclosing portion 420 enclosing the predetermined freeze-dried drug, and the sealing portions 30 disposed between the bag 10 and the drug-enclosing portions 420. The drug-enclosing portion 420 may be said as one enclosing a drug and including the sealing portion 30.

FIG. 18 is a view illustrating a cross-sectional structure taken through the line A-A of FIG. 17. As illustrated in FIG. 18, the sealing portion 30 bonds the surface 11 and the back surface 12 of the bag 10 with, for example, heat sealing or known adhesives. The sealing portion 30 is opened by, for example, applying external force in a direction pulling the surface 11 and the back surface 12 away from each other to thereby release a bonded state.

As described above, special facilities are generally needed to sterilize tablets. However, the freeze-dried powder preparation can be produced in a sterile state. Therefore, the kit product according to the present embodiment can be easily produced in the sterile state.

The drug-enclosing portion 420 encloses, for example, the anti-cancer agent which needs to be dose-adjusted (drug A). In the present embodiment, the drug-enclosing portion 420 includes one drug-enclosing portion 421 enclosing 50 mg of the drug A, four drug-enclosing portions 422 each enclosing 10 mg of the drug A, one drug-enclosing portion 423 enclosing 5 mg of the drug A, and five drug-enclosing portions 424 each enclosing 1 mg of the drug A. The drug-enclosing portion 420 displays the amounts of the drug A enclosed therein on their surfaces by printing or stamping.

In the kit product 400 according to the present embodiment, a residue of a drug (residual drug), which remains in the drug-enclosing portion 420 without being used in the drug preparation (dose-adjusted), is configured to be able to isolate from the bag 10 before (before drug preparation (dose adjustment)) or after (after drug preparation (dose adjustment)) a portion or all of the drug is charged into the bag 10. As used herein, a state where the drug is isolated from the bag 10 means a state where the drug is not able to be charged into the bag 10 because the drug-enclosing portion 420 and the bag 10 coupled via the sealing portion 30 are sealed by the sealing portion 30 or a state where the drug is not able to be charged into the bag 10 because the drug-enclosing portion 420 has been cut away from the bag 10.

Drug preparation in the kit product 400 according to the present embodiment will now be described.

The case where, for example, 83 mg worth of the drug A is charged from the drug-enclosing portion 420 into the bag 10 will now be described. In this description, the drug A enclosed in a drug-enclosing portion 421, three drug-enclosing portions 422, and three drug-enclosing portions 424 is charged into the bag 10, but the drug A is not charged from one drug-enclosing portion 422, the drug-enclosing portion 423, and two drug-enclosing portions 424 into the bag 10.

First, the sealing portions 30 of the drug-enclosing portion 421, three drug-enclosing portions 422, and three drug-enclosing portions 424 are opened by applying external pressure (e.g., by fingers) (e.g., pulling the surface 11 and the back surface 12 in FIG. 18 away from each other). Then, the bag 10 is inverted to pour the liquid 10*a* in the bag into the thus-opened drug-enclosing portions, thereby dissolving only the drug needed.

Thus, drug preparation work requiring the dose adjustment can be performed without exposing the drug to the outside air, that is, without a risk of exposure by charging a portion of the drug A (e.g., 83 mg worth) enclosed in the drug-enclosing portion 420 into the liquid 10*a* in the bag 10. This allows a drug liquid 15 prepared from the drug A and the liquid 10*a* to be contained in the bag 10.

Then, the residue of the drug A, which remains in the drug-enclosing portion 420 without being used in the drug preparation, is cut away from the bag 10. Specifically the residue of the drug A is cut away from the bag 10 by cutting one drug-enclosing portion 422, one drug-enclosing portion 423, and two drug-enclosing portions 424. The sealing portions 30 of these drug-enclosing portions may be configured to be cut away without leaking the drug A outside. Alternatively, the sealing portion 30 may be configured to be cut away using the hot sealer so as not to leak the drug A outside. The bag 10 from which the drug-enclosing portion 420 have been cut to isolate (cut away) an unused residue of the drug A is available as a bag for intravenous drip.

Note that, the unused residue of the drug A may be cut away before the bag 10 is inverted to pour the liquid 10*a* in the bag into the opened drug-enclosing portions, thereby dissolving only the drug needed as described above.

Figure 19:
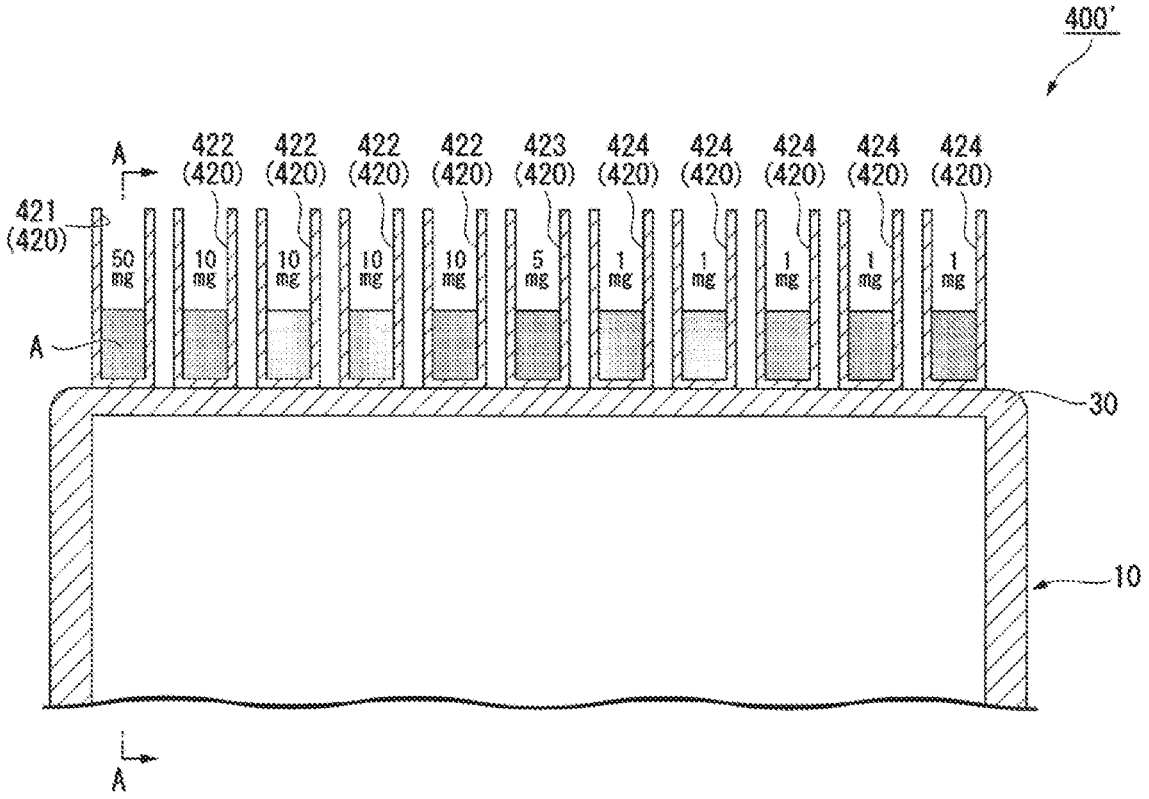
FIG. 19 is an explanatory view illustrating one exemplary step of enclosing a drug in a drug-enclosing portion of a kit product according to the fourth embodiment.

Then, a method for producing the kit product 400 according to the fourth embodiment will now be described. FIG. 19 is an explanatory view illustrating a step of enclosing the drug A in drug-enclosing portions of a kit product 400 according to the present embodiment. In FIG. 19, a container 400' includes the bag 10, the drug-enclosing portion 420, and the sealing portion 30 disposed between the bag 10 and the drug-enclosing portion 420.

In the present step, the bag 10 has not contained the liquid 10*a* yet, is not sealed, and is partially opened. The drug-enclosing portion 420 is not sealed and is opened at the top (the other end away from the sealing portion 30 of the drug-enclosing portion 420).

First, the drug-enclosing portion 420 of the container 400' is loaded with the predetermined amounts of a solution or suspension of the drug A. Examples of a solvent for the drug A include water. More specifically, the drug-enclosing portion 421 is loaded with the solution or suspension of the drug A in an amount so as to include 50 mg of the drug A. Likewise, four drug-enclosing portions 422 are loaded with the solution or suspension of the drug A in an amount so as to each include 10 mg of the drug A; the drug-enclosing portion 423 is loaded with the solution or suspension of the drug A in an amount so as to include 5 mg of the drug A; and five drug-enclosing portions 424 are loaded with the solution or suspension of the drug A in an amount so as to each include 1 mg of the drug A.

Figure 20:
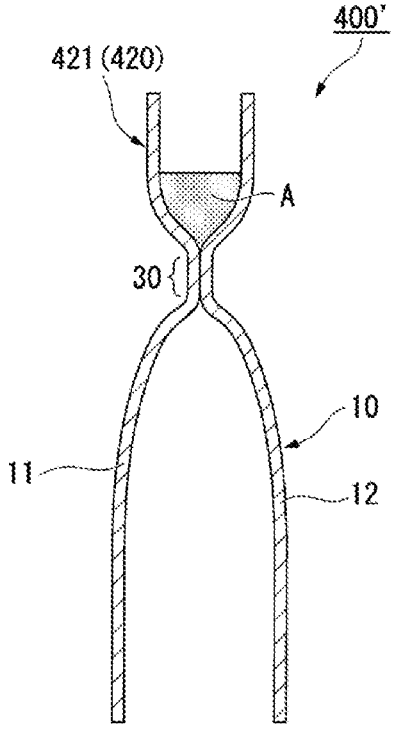
FIG. 20 is a view illustrating a cross-sectional structure taken through the line A-A of FIG. 19.

FIG. 20 is a view illustrating a cross-sectional structure taken through the line A-A of FIG. 19. As illustrated in FIG. 20, the sealing section 30 bonds the surface 11 and the back surface 12 of the bag 10 with, for example, the heat sealing or known adhesives. The sealing section 30 is opened by, for example, applying external force in a direction pulling the surface 11 and the back surface 12 away from each other to thereby release a bonded state. In the container 400', the drug-enclosing portion 420 is not sealed and is opened at the top. The drug-enclosing portion 420 is loaded with the solution of the drug A. The bag 10 has not contained the liquid 10*a* yet, is not sealed, and is partially opened.

Then, the whole of the container 400' is frozen and then placed into a freeze-drier to distill off the solvent for the drug A (e.g., water). As a result, freeze-dried powder of the drug A is adhered to a wall surface of a lower portion (portion adjacent to the sealing portion 30) of the drug-enclosing portion 420.

Then, the top of the drug-enclosing portion 420, which has been opened, is sealed with a heat sealing method using, for example, a hot sealer. The bag 10 is loaded with the liquid 10*a* and sealed with the heat sealing method using, for example, the hot sealer.

Thus, the kit product 400 is obtained. The above-described steps can be performed under a sterile condition. Therefore, according to the method of the present embodiment, the drug-enclosing portion is easily loaded with the drug A under a sterile condition.

Fifth Embodiment

Figure 21:
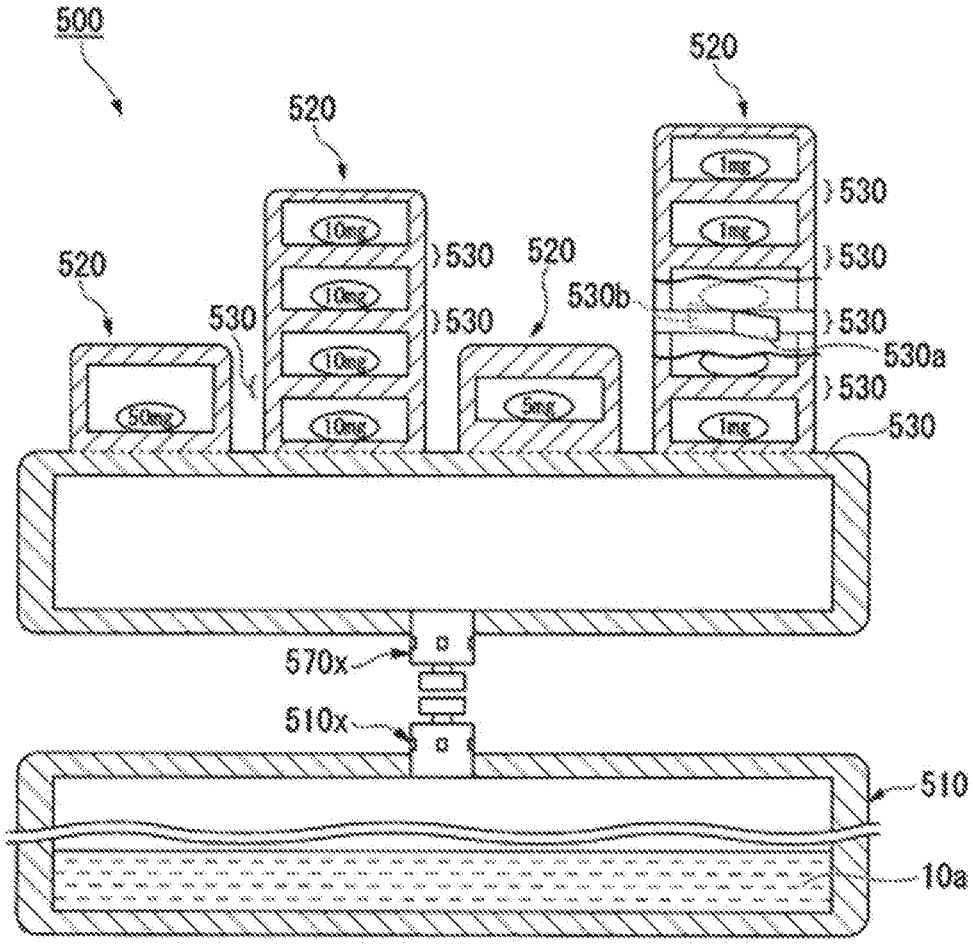
FIG. 21 is a view illustrating one exemplary essential-part configuration of a kit product according to the fifth embodiment.

A configuration of a kit product according to the fifth embodiment will now be described. FIG. 21 is a view illustrating an essential-part configuration of a kit product 500. The kit product 500 is the modification example of the kit product 100 described above. The kit product 500 includes drug-enclosing portions 520 each enclosing the predetermined drug, sealing portions 530 disposed between the drug-enclosing portions 520, and a bag 510 enclosing the liquid 10*a*. As illustrated in FIG. 21, each of the sealing portions 530 may include grip portions 530*a* and 530*b* configured to be gripped and pulled by, for example, fingers when the sealing portion 530 is opened. The drug-enclosing portions 520 may be said as those each enclosing a drug and including the sealing portion 530.

In the kit product 500, the drug-enclosing portions 520 are separated from the bag 510 enclosing the liquid 10*a*, but these are coupled together when used. Such a configuration enables refrigerated storage of only the drug-enclosing portions 520, resulting in improvement of handlability.

Figure 22A:
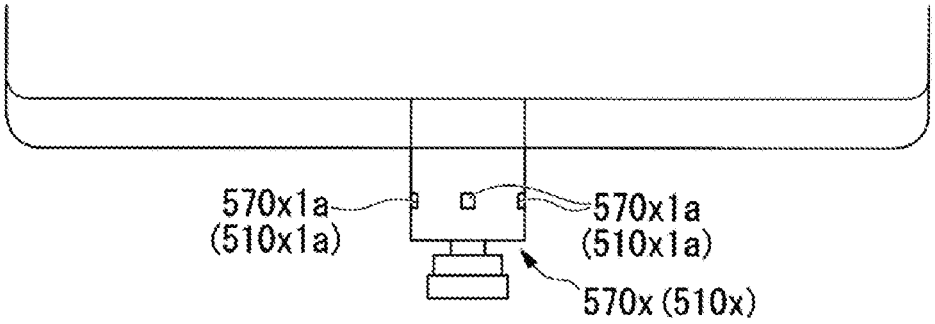
FIG. 22*a* is a schematic view illustrating one exemplary connecting portion.
Figure 22B:
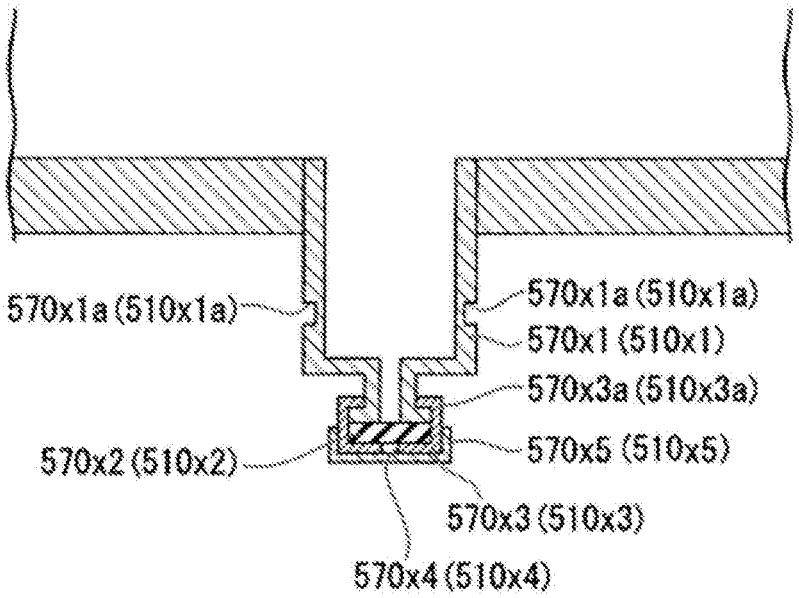
FIG. 22*b* is a view illustrating a cross-sectional structure of FIG. 22*a*.
Figure 23A:
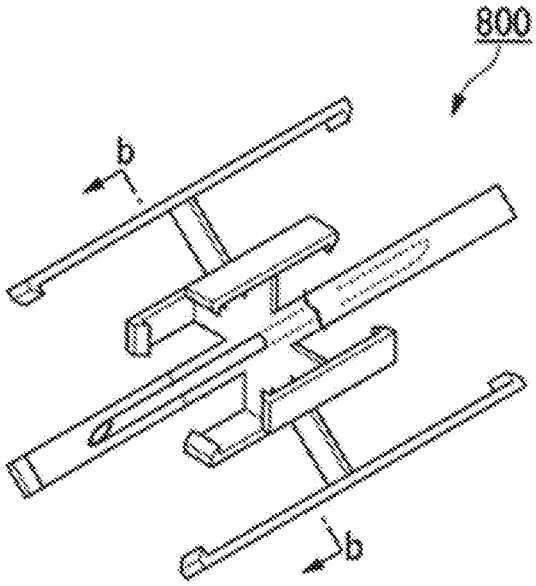
FIG. 23*a* is a perspective view illustrating one exemplary structure of a connecting member.
Figure 23B:
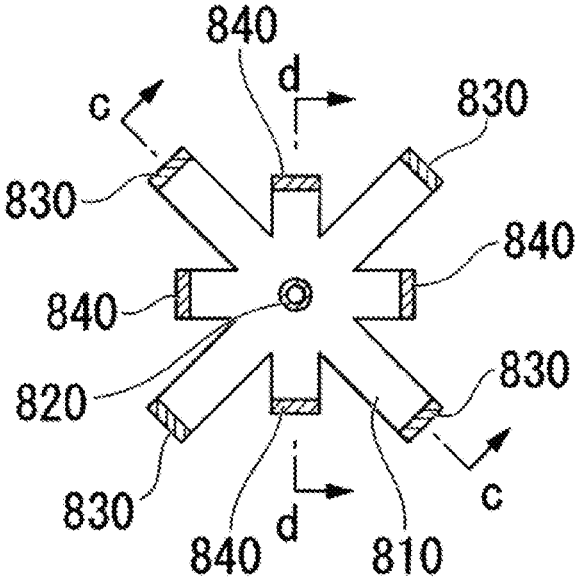
FIG. 23*b* is a view illustrating a cross-sectional structure taken through the line b-b of FIG. 23*a*.
Figure 23C:
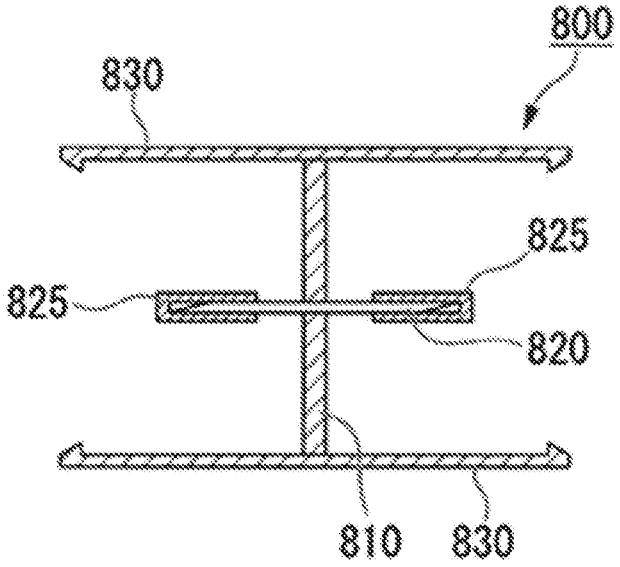
FIG. 23*c* is a view illustrating a cross-sectional structure taken through the line c-c of FIG. 23*b*.
Figure 23D:
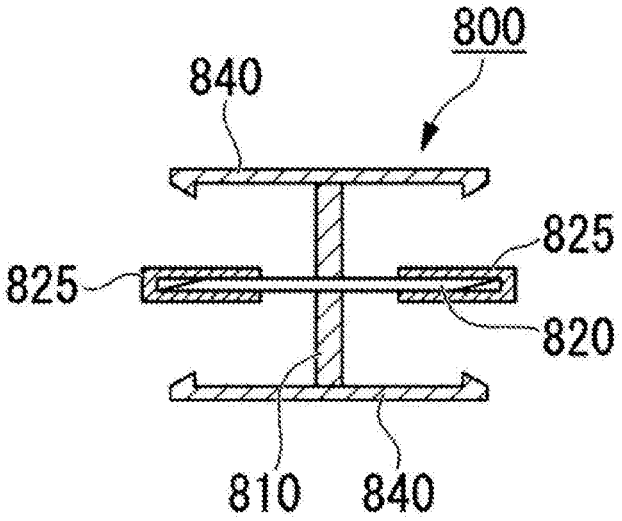
FIG. 23*d* is a view illustrating a cross-sectional structure taken through the line d-d of FIG. 23*b*.
Figure 23E:
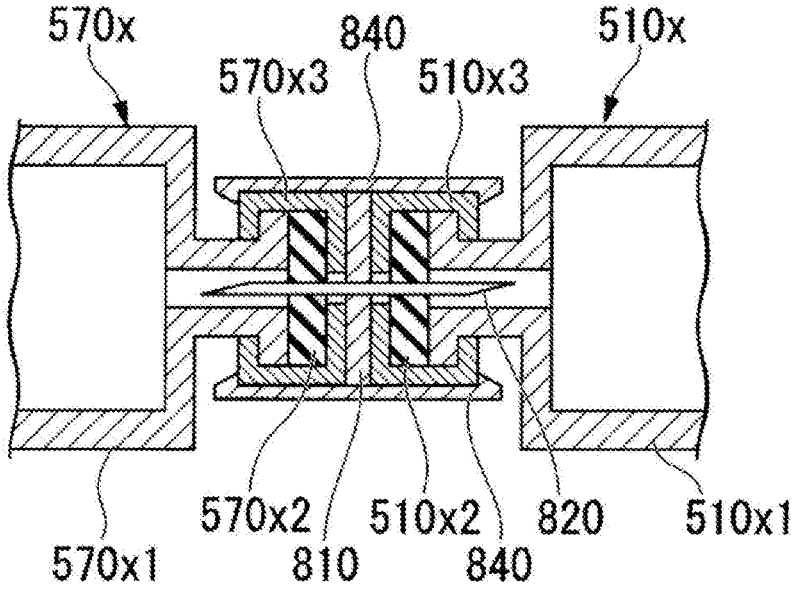
FIG. 23*e* is a view illustrating a cross-sectional structure in a state where connecting portions 570*x* and 510*x* are connected to each other.

Coupling between the drug-enclosing portion 520 and the bag 510 will now be described. The drug-enclosing portion 520 includes a connecting portion 570*x* configured to be coupled to the bag 510. FIG. 22*a* is a schematic view illustrating one exemplary connecting portion 570*x*. FIG. 22*b* is a cross-sectional view of FIG. 22*a*.

The connecting portion 570*x* has the same structure as lid portions of common vials for injection, and includes a vial body portion 570*x*1, a rubber member 570*x*2, and a fixing member 570*x*3 configured to fix the rubber member 570*x*2 to the vial body portion 570*x*1. The rubber member 570*x*2 may also be said as the sealing portion. A notch portion 570*x*1*a* is disposed on the vial body portion 570*x*1 and is configured to fix a connecting member 800 described below. A peripheral edge portion 570*x*3*a* on a side close to the vial body portion 570*x*1 of the fixing member 570*x*3 functions as a portion of a lock mechanism configured to fix the connecting member 800 described below. A through hole 570*x*4 is formed at the center of the fixing member 570*x*3 and the through hole 570*x*4 is blocked at one end with the rubber member 570*x*2. As illustrated in FIG. 22*b*, the connecting portion 570*x* preferably further includes a cap 570*x*5 configured to keep the sterile condition.

The bag 510 includes a connecting portion 510*x* configured to be coupled to the drug-enclosing portion 520. The connecting portion 510$x$ has the same structure as the connecting portion 570$x$ described above. That is, the connecting portion 510$x$ includes a vial body portion 510$x$1, a rubber member 510$x$2, a fixing member 510$x$3, a notch portion 510$x$1$a$, a peripheral edge portion 510$x$3$a$, and a through hole 510$x$4. The connecting portion 510$x$ preferably further includes a cap 510$x$5 configured to keep the sterile condition.

When coupling the drug-enclosing portion 520 and the bag 510, the connecting member 800 is used to connect the connecting portion 570$x$ to the connecting portion 510$x$ described above. FIG. 23$a$ is a perspective view illustrating one exemplary structure of the connecting member 800. FIG. 23$b$ is a cross-sectional view taken through the line b-b of FIG. 23$a$. FIG. 23$c$ is a cross-sectional view taken through the line c-c of FIG. 23$b$. FIG. 23$d$ is a cross-sectional view taken through the line d-d of FIG. 23$b$.

As illustrated in FIGS. 23$a$ to 23$d$, the connecting member 800 includes a supporting member 810, a needle member 820 piercing the supporting member 810, a fixing member 830, and a fixing member 840. The fixing member 830 is configured to fix the connecting member 800 to the above-described connecting portion 570$x$ (or 510$x$). Lock mechanisms, which are configured to engage with the above-described notch portion 570$x$1$a$ (or 510$x$1$a$) and fix the connecting member 800 to the connecting portion 570$x$ (or 510$x$), are disposed on both ends of the fixing member 830.

The fixing member 840 is configured to fix the connecting member 800 to the above-described connecting portion 570$x$ (or 510$x$). Lock mechanisms, which are configured to engage with the above-described peripheral edge portion 570$x$3$a$ (or 510$x$3$a$) and fix the connecting member 800 to the connecting portion 570$x$ (or 510$x$), are disposed on both ends of the fixing member 840.

The needle member 820 is hollow and formed to be sharp at both ends. As illustrated in FIGS. 23$c$ and 23$d$, the needle member 820 preferably further includes caps 825 at both ends in order to keep the sterile condition. When coupling the drug-enclosing portion 520 and the bag 510, the cap 825 of the needle member 820 and the cap 570$x$5 of the connecting portion 570$x$ are firstly removed and one end of the needle member 820 is allowed to pierce the rubber member 570$x$2 through the through hole 570$x$4. The cap 510$x$5 of the connecting portion 510$x$ is removed and the other end of the needle member 820 is allowed to pierce the rubber member 510$x$2 through the through hole 510$x$4.

Moreover, the lock mechanism at one end of the fixing member 830 is engaged with the notch portion 570$x$1$a$ of the vial body portion 570$x$1 to thereby lock them. The lock mechanism at the other end of the fixing member 830 is engaged with the notch portion 510$x$1$a$ of the vial body portion 510$x$1 to thereby lock them. The lock mechanism at one end of the fixing member 840 is engaged with the peripheral edge portion 570$x$3$a$ of the vial body portion 570$x$1 to thereby lock them. The lock mechanism at the other end of the fixing member 840 is engaged with the peripheral edge portion 510$x$3$a$ of the vial body portion 510$x$1 to thereby lock them.

Thus, the drug-enclosing portion 520 and the bag 510 are brought into communication with each other via the needle member 820, thereby tightly fixing the connecting member 800, the connecting portion 570$x$, and the connecting portion 510$x$ to one another. FIG. 23$e$ is a cross-sectional view illustrating a state where the connecting portions 570$x$ and 510$x$ are connected to each other. The needle member 820 is preferably short and preferably has a length so as not to protrude from the rubber member 510$x$2 and the rubber member 570$x$2 as possible, because a portion of the drug liquid may remain in the needle member 820 upon drug preparation described below.

Drug preparation in the kit product 500 according to the present embodiment will now be described. The drug preparation in the kit product 500 is same as in the kit product 100.

In the drug preparation in the kit product 500, the sealing portions 530 for the drug A to be used in the drug preparation are opened and then the drug-enclosing portion 520 and the bag 510 are coupled to each other according to the above-described method. Then, the kit product 500 is lifted up so that the bag 510 is upper and the drug-enclosing portion 520 is lower. As a result, the liquid 10$a$ in the bag 510 is transferred from the bag 510 to the drug-enclosing portion 520 through the needle member 820, thereby obtaining the drug liquid prepared from the thus-released drug A and the liquid 10$a$. Then, the kit product 500 is lifted up so that the drug-enclosing portion 520 is upper and the bag 510 is lower. As a result, the drug liquid is transferred to the bag 510 through the needle member 820.

Note that, in the above case, the sealing portions 530 for the drug A needed are opened and then the drug-enclosing portion 520 and the bag 510 are coupled to each other. However, the drug-enclosing portion 520 and the bag 510 may be coupled to each other in advance before the sealing portions 530 for the drug A needed are opened. The residue of the drug A, which remains in the drug-enclosing portion 520 without being used in the drug preparation, may be cut away in the same manner as in the kit formation 100.

Thus, the drug preparation work requiring the dose adjustment can be performed without exposing the drug A to the outside air, that is, without a risk of exposure while preventing exposure to the drug A which may affect human body, thereby conveniently producing the predetermined dose of the drug liquid.

Sixth Embodiment

Figure 24:
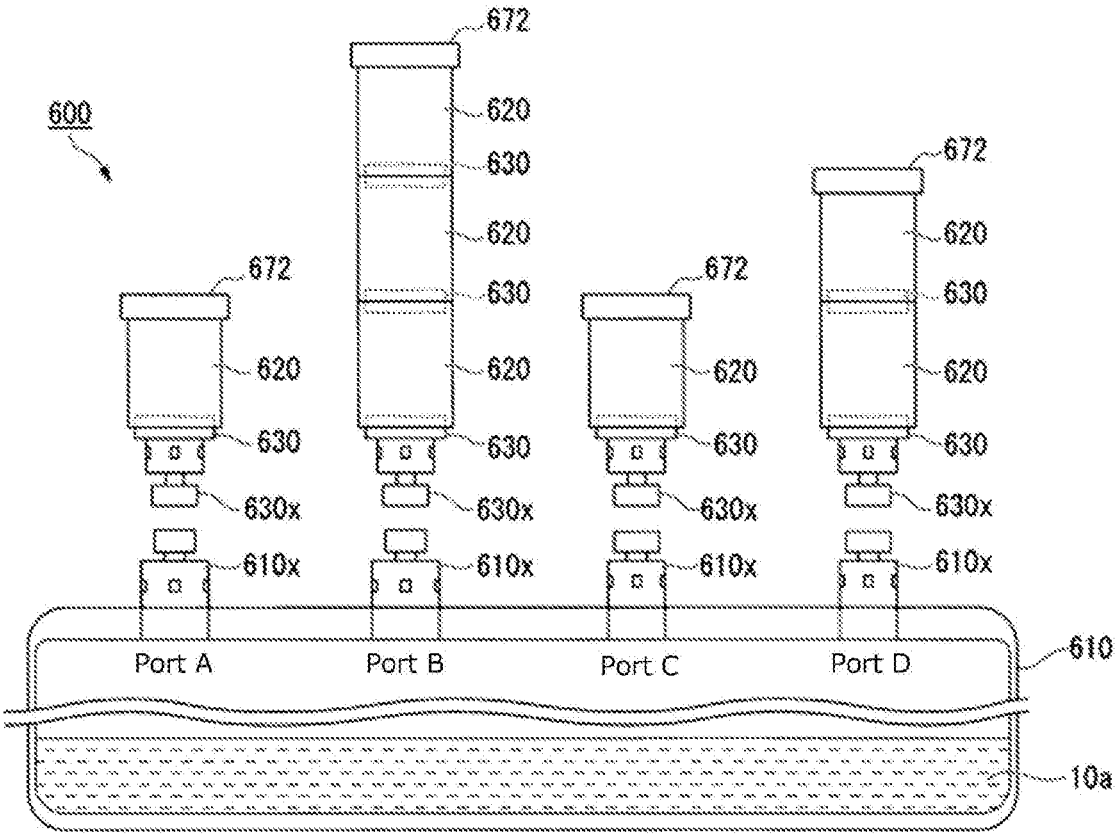
FIG. 24 is a view illustrating one exemplary essential-part configuration of a kit product according to the sixth embodiment.

A configuration of a kit product according to the sixth embodiment will now be described. FIG. 24 is a view illustrating one exemplary essential-part configuration of a kit product 600. The kit product 600 includes the required number of special vials each enclosing a drug and coupled to one another for the drug preparation.

The kit product 600 includes a bag 610 enclosing the liquid 10$a$, at least one vial (drug-enclosing portion) 620 each enclosing a drug and including a sealing portion (lid body member 624) described below, and, if necessary, a coupling member 630 configured to couple a plurality of vials 620 and a coupling member 630$a$ configured to couple the vial 620 and the bag 610 to each other. The coupling member 630$a$ includes a connecting portion 630$x$ configured to connect to the bag 610. The bag 610 includes a connecting portion 610$x$ configured to connect to the coupling member 630$a$.

In the example of FIG. 24, the bag 610 includes four connecting portions 610$x$ for ports A to D. These ports may have a common shape or may have different shapes from one another. For example, the ports may have different shapes from one another so that the port A is connected to only the vial containing 50 mg of the drug A, the port B is connected to only the vial containing 10 mg of the drug A, the port C is connected to only the vial containing 5 mg of the drug A, and the port D is connected to only the vial containing 1 mg of the drug A. This makes it possible to prevent a wrong amount of the drug from being connected upon drug preparation by mistake.

Figure 25A:
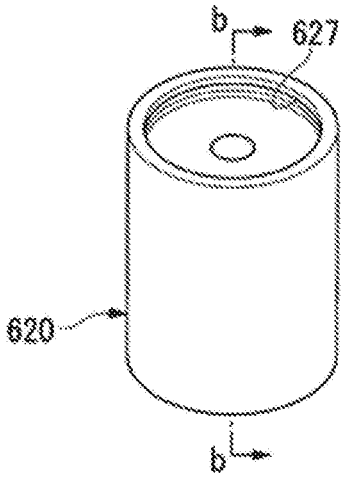
FIG. 25*a* is a perspective view illustrating one exemplary structure of a vial.
Figure 25B:
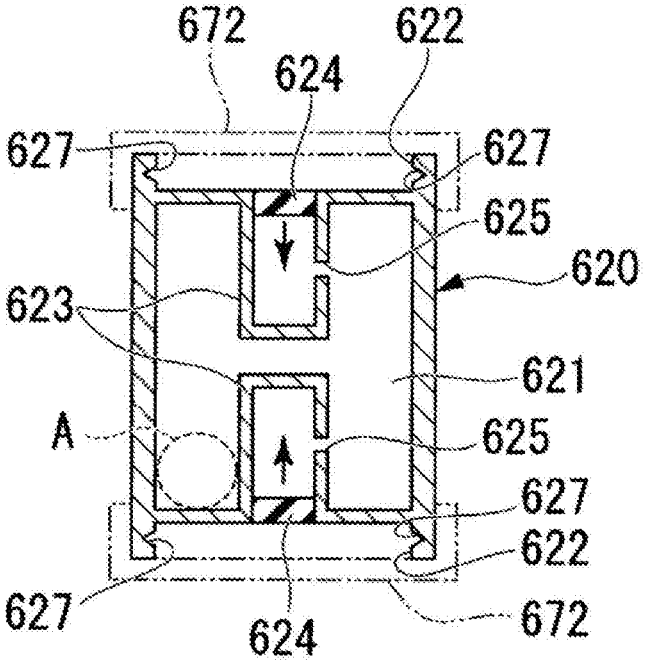
FIG. 25*b* is a view illustrating a cross-sectional structure taken through the line b-b of FIG. 25*a*.
Figure 26A:
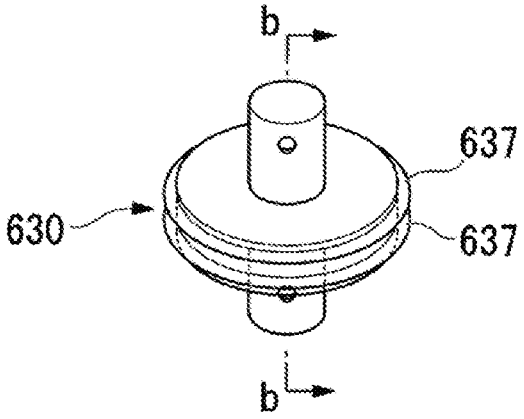
FIG. 26*a* is a perspective view illustrating one exemplary structure of a coupling member.
Figure 26B:
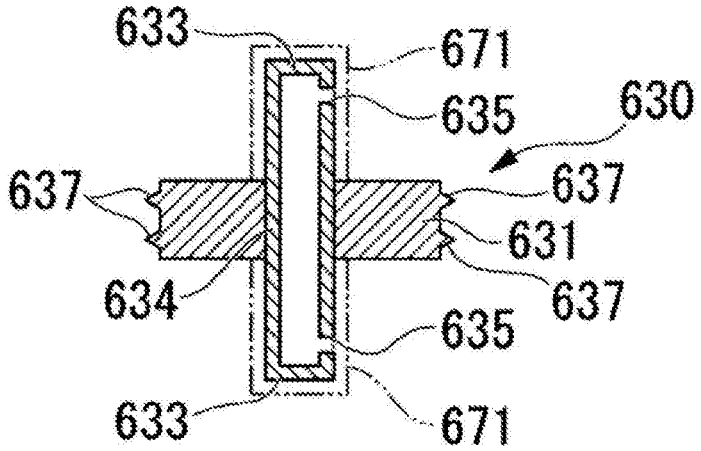
FIG. 26*b* is a view illustrating a cross-sectional structure taken through the line b-b of FIG. 26*a*.
Figure 27A:
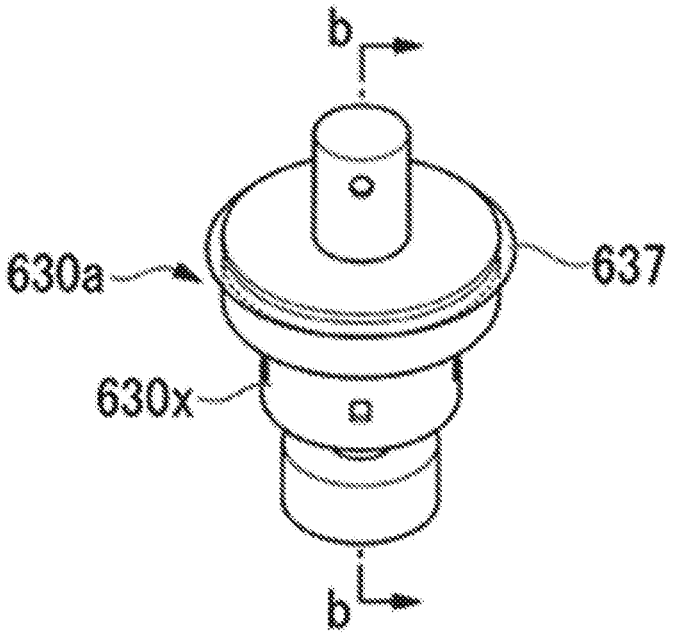
FIG. 27*a* is a perspective view illustrating one exemplary structure of a coupling member.
Figure 27B:
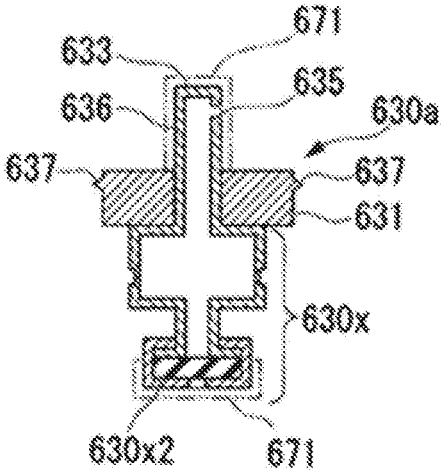
FIG. 27*b* is a view illustrating a cross-sectional structure taken through the line b-b of FIG. 27*a*.

FIG. 25*a* is a perspective view illustrating one exemplary structure of a vial 620. FIG. 25*b* is a cross-sectional view taken through the line b-b of FIG. 25*a*. FIG. 26*a* is a perspective view illustrating one exemplary structure of a coupling member 630. FIG. 26*b* is a cross-sectional view taken through the line b-b of FIG. 26*a*. FIG. 27*a* is a perspective view illustrating one exemplary structure of a coupling member 630*a*. FIG. 27*b* is a cross-sectional view illustrating taken through the line b-b of FIG. 27*a*.

The vial 620 includes a body portion 621 configured to contain the drug A, a guide portion 622 configured to function as a guide when the coupling member 630 or 630*a* is coupled to the vial 620, and a concave portion 623 to which a convex portion 633 of the coupling member 630 or 630*a* is configured to be inserted. An opening of the concave portion 623 is sealed by the lid body member 624. The lid body member 624 may be said as the sealing portion. A through hole 625 is disposed on a wall portion of the concave portion 623. A groove 627, which constitutes a lock mechanism configured to fix the vial 620 and the coupling member 630 or 630*a* to each other, is disposed on the guide portion 622. The vial 620 preferably further includes a cap 672 in order to keep the sterile condition.

The coupling member 630 includes a supporting member 631 and a hollow tubular member 634 configured to form a convex portion 633 penetrating the supporting member 631 and protruding on both sides of the supporting member 631. A through hole 635 is disposed on a wall portion of the convex portion 633. A convex portion 637, which constitutes a lock mechanism configured to fix the vial 620 and the coupling member 630 to each other, is disposed on the supporting member 631. The coupling member 630 preferably further includes a cap 671 in order to keep the sterile condition. A distance between the top of an inner space of the convex portion 633 and the through hole 635 is preferably short because when the distance between the top of the inner space of the convex portion 633 and the through hole 635 is long, a portion of the drug liquid may remain in the inner space of the convex portion 633 upon drug preparation described below.

The coupling member 630*a* includes the supporting member 631 and a hollow tubular member 636 configured to penetrate the supporting member 631. One end of the tubular member 636 forms the convex portion 633. The other end of the tubular member 636 has the same structure as the connecting portions 570*x* or 510*x* described above. The through hole 635 is disposed on a wall portion of the convex portion 633. A convex portion 637, which constitutes a lock mechanism configured to fix the vial 620 and the coupling member 630*a* to each other, is disposed on the supporting member 631. The coupling member 630 preferably further includes the cap 671 in order to keep the sterile condition.

Figure 28A:
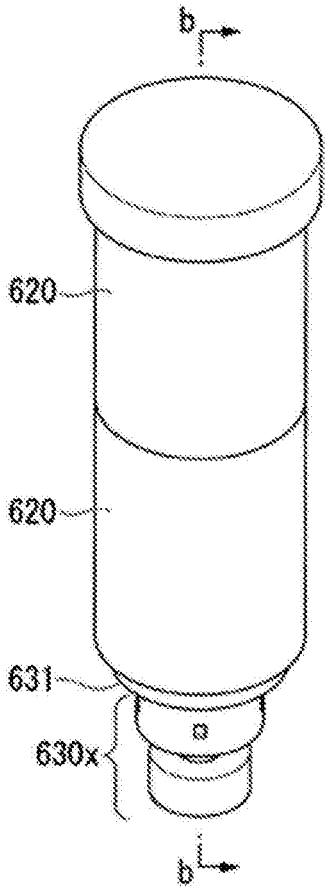
FIG. 28*a* is a perspective view illustrating one exemplary state where the first vial, the first coupling member, the second vial, and the second coupling member are connected to each other in this order.
Figure 28B:
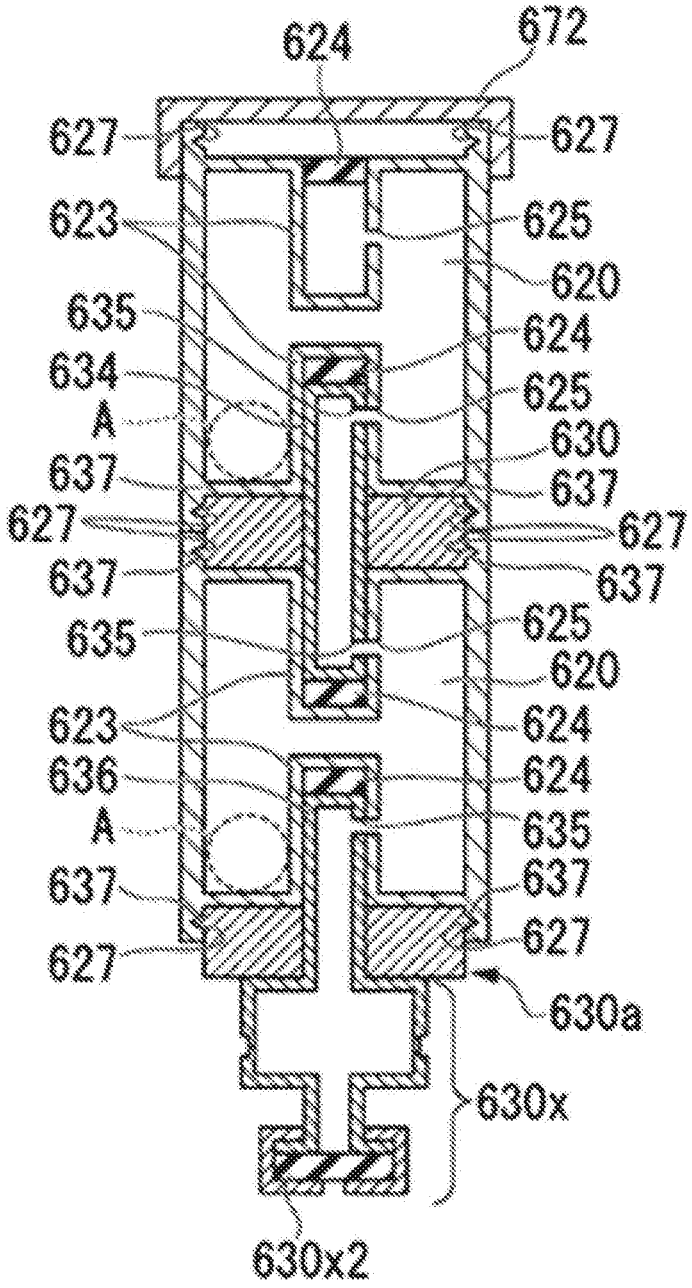
FIG. 28*b* is a view illustrating a cross-sectional structure taken through the line b-b of FIG. 28*a*.

Coupling of the vials 620 will now be described referring to FIG. 28. FIG. 28*a* is a perspective view illustrating one exemplary state where a first vial 620, a coupling member 630, a second vial 620, and a coupling member 630*a* are connected to one another in this order. FIG. 28*b* is a cross-sectional view taken through the line b-b of FIG. 28*a*.

First, one of the caps 672 of the first vial 620 is removed and one of the caps 671 of the coupling member 630 is removed. Then, the convex portion 633 of the coupling member 630 is inserted into the first concave portion 623 of the vial 620 to mate the lock mechanism 627 with the lock mechanism 637, thereby fixing to each other. As a result, the lid body member 624 is transferred in a direction of the arrow illustrated in FIG. 25*b*, the through hole 625 of the concave portion 623 is connected to the through hole 635 of the convex portion 633, and thus the inside of the tubular member 634 of the coupling member 630 is brought into communication with an inside of the vial 620. It may be said that the transfer of the lid body member 624 corresponds to the opening of the sealing portion of the drug-enclosing portion.

Then, one of the caps 672 of the second vial 620 is removed and the other cap 671 of the coupling member 630 is removed. Then, the convex portion 633 of the coupling member 630 is inserted into the first concave portion 623 of the second vial 620 to mate the lock mechanism 627 with the lock mechanism 637, thereby fixing to each other. As a result, the lid body member 624 of the first concave portion 623 of the second vial 620 is transferred in a direction of the arrow illustrated in FIG. 25*b*, the through hole 625 of the concave portion 623 is connected to the through hole 635 of the convex portion 633, and thus the inside of the tubular member 634 of the coupling member 630 is brought into communication with the inside of the second vial 620. It may be said that the transfer of the lid body member 624 corresponds to the opening of the sealing portion of the drug-enclosing portion.

Then, the other cap 672 of the second vial 620 is removed and the cap 671 of the coupling member 630*a* is removed. Then, the convex portion 633 of the coupling member 630*a* is inserted into the second concave portion 623 of the second vial 620 to mate the lock mechanism 627 with the lock mechanism 637, thereby fixing to each other. As a result, the lid body member 624 of the concave portion 623 of the second vial 620 is transferred in a direction of the arrow illustrated in FIG. 25*b*, the through hole 625 of the second concave portion 623 is connected to the through hole 635 of the convex portion 633, and thus the inside of the tubular member 636 of the coupling member 630*a* is brought into communication with the inside of the second vial 620. It may be said that the transfer of the lid body member 624 corresponds to the opening of the sealing portion of the drug-enclosing portion.

Thus, the inside of the first vial 620, the inside of the tubular member 634 of the coupling member 630, the inside of the second vial 620, and the inside of the tubular member 636 of the coupling member 630*a* are brought into communication with one another.

Drug preparation in the kit product 600 according to the present embodiment will now be described. For example, the case of preparing 83 mg worth of the drug A will now be described. In this case, one vial 620 containing 50 mg of the drug A, three vials 620 each containing 10 mg of the drug A, and three vials 620 each containing 1 mg of the drug A may be used.

First, one vial 620 containing 50 mg of the drug A is connected to a connecting portion 610*x* of the port A illustrated in FIG. 24. Specifically, the vial 620 containing 50 mg of the drug A is firstly connected to the coupling member 630*a* as described above. Then, the connecting portion 630*x* of the coupling member 630*a* is connected to the connecting portion 610*x* of the port A of the bag 610. The connecting portion 630*x* and the connecting portion 610*x* are connected using the above-described connecting member 800 in the same manner as when the connecting portion 570*x* is connected to the connecting portion 510*x* in the kit product 500 according to the fifth embodiment described above. It may be said that the connection of the connecting portion 630*x* and the connecting portion 610*x* corresponds to the connection of the drug-enclosing portion (vial 620) and the bag 610. Also, it may be said that the connection of the connecting portion 630*x* and the connecting portion 610*x* corresponds to the opening of the sealing portion (rubber member 630x2). The drug-enclosing portion (vial 620) and the bag 610 may be connected to each other before the sealing portion (lid body member 624, rubber member 630x2) is opened, the sealing portion (lid body member 624, rubber member 630x2) may be opened before the drug-enclosing portion (vial 620) and the bag 610 are connected to each other, or the sealing portion (lid body member 624, rubber member 630x2) may be opened at the same time when the drug-enclosing portion (vial 620) and the bag 610 are connected to each other. The phrase "drug-enclosing portion (vial 620) and the bag 610 are connected to each other" means that the vial 620 is connected to the bag 610 or the vial 620 is further connected to the vial 620 which has been already connected to the bag 610.

Then, three vials 620 each containing 10 mg of the drug A is connected to a connecting portion 610x of the port B illustrated in FIG. 24. Specifically, three vials 620 each containing 10 mg of the drug A are connected using two coupling members 630 as described above and further connected to one coupling member 630a. Then, the connecting portion 630x of the coupling member 630a is connected to the connecting portion 610x of the port B of the bag 610. The connecting portion 630x is connected to the connecting portion 610x in the same manner as when the vial 620 containing 50 mg of the drug A is connected.

Then, three vials 620 each containing 1 mg of the drug A are connected to the connecting portion 610x of the port D illustrated in FIG. 24. Specifically, three vials 620 each containing 1 mg of the drug A are connected using two coupling members 630 as described above and further connected to one coupling member 630a. Then, the connecting portion 630x of the coupling member 630a is connected to the connecting portion 610x of the port D of the bag 610. The connecting portion 630x is connected to the connecting portion 610x in the same manner as the vial 620 containing 50 mg of the drug A described above.

In this case, the connecting portion 610x of the port C is not used.

Then, the kit product 600 is lifted up so that, for example, the bag 610 is upper and the vial 620 connected thereto is lower. As a result, the liquid 10a in the bag 610 is transferred from the bag 610 to the inside of each vial 620 through the needle member 820, the tubular member 636 of the coupling member 630a, and the tubular member 634 of the coupling member 630, thereby obtaining the drug liquid prepared from the drug A contained in each vial 620 and the liquid 10a. Then, the kit product 600 is lifted up so that the vial 620 is upper and the bag 610 is lower. As a result, the drug liquid is transferred to the bag 610 through the needle member 820, the tubular member 634, and the tubular member 636. It may be said that the transfer of the drug liquid to the bag 610 corresponds to that the drug is charged into the bag 610 and prepared.

Thus, the drug preparation work requiring the dose adjustment can be performed without exposing the drug A to the outside air, that is, without a risk of exposure while preventing exposure to the drug A which may affect human body, thereby conveniently producing the predetermined dose of the drug liquid.

The kit product 600 includes the required number of special vials each enclosing a drug and coupled to one another for the drug preparation, which is economical because the need of disposal of the drug is eliminated.

Seventh Embodiment

Figure 29A:
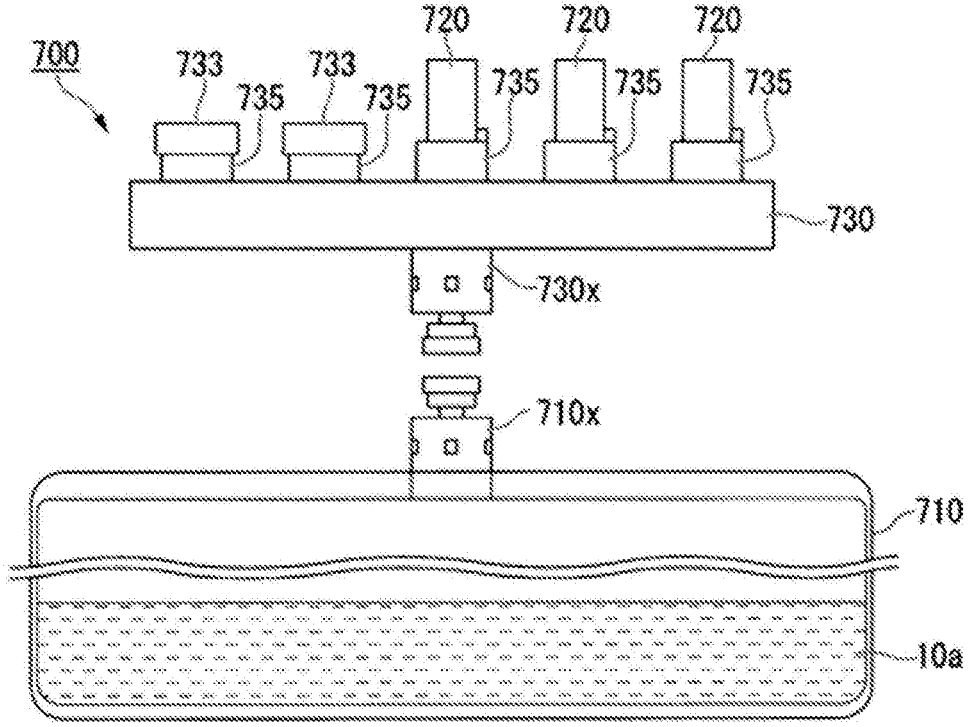
FIG. 29*a* is a view illustrating one exemplary essential-part configuration of a kit product according to the seventh embodiment.

A configuration of a kit product according to the seventh embodiment will now be described. FIG. 29a is a view illustrating one exemplary essential-part configuration of a kit product 700. The kit product 700 includes the required number of special vials each enclosing a drug and coupled to one another for the drug preparation.

Figure 29B:
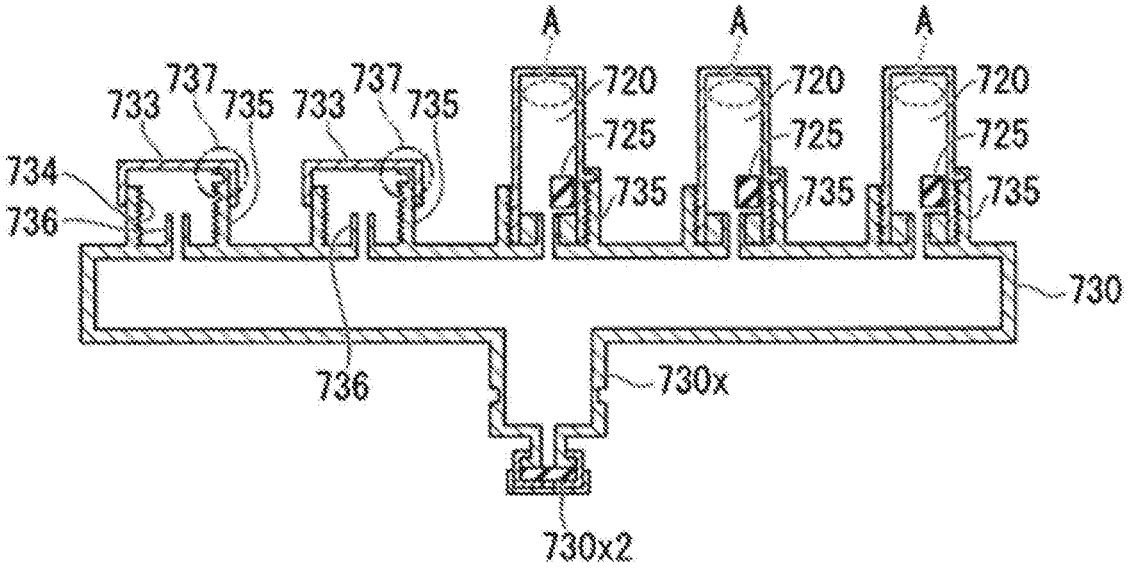
FIG. 29*b* is a view illustrating a cross-sectional structure of a drug-holding unit.
Figure 29C:
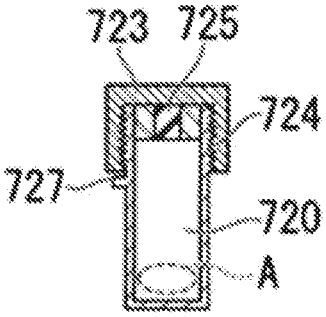
FIG. 29*c* is a view illustrating a cross-sectional structure of a vial.

The kit product 700 includes a bag 710 enclosing the liquid 10a, at least one vial (drug-enclosing portion) 720 enclosing the drug and including a sealing portion (rubber stopper 725) described below, and a drug-holding unit 730 connected to the vial 720. The drug-holding unit 730 includes a port 735 configured to connect to the vial 720 and a connecting portion 730x configured to connect to the bag 710. The bag 710 includes a connecting portion 710x configured to connect to the drug-holding unit 730. FIG. 29b is a cross-sectional view of the drug-holding unit 730 in FIG. 29a. FIG. 29c is a view illustrating a structure of the vial 720.

In FIG. 29a, the bag 710 includes only one connecting portion 710x, but may include a plurality of the connecting portions 710x. In FIG. 29a, the drug-holding unit 730 includes five ports 735, but the number of the ports is not limited to five.

The port 735 includes a screw portion 734 configured to mount the vial 720 through screwing, a lock mechanism 737 configured to fix the thus-mounted vial 720, and a convex portion 736 configured to push the rubber stopper 725 of the vial 720 described below into an inside of the vial 720 to thereby bring the inside of the vial 720 into communication with an inside of the drug-holding unit 730. The port 735 preferably further includes a cap 733 in order to keep the sterile condition.

The predetermined dose of the drug A is enclosed in the inside of the vial 720. An opening of the vial 720 is sealed with the rubber stopper 725. The rubber stopper 725 may be said as the sealing portion. A screw portion 724 configured to mount the vial 720 to the port 735 through screwing and a lock mechanism 727 configured to fix the vial 720 which has been mounted to the port 735 are disposed adjacent to the opening on an outer surface of the vial 720. The lock mechanism 727 is fixed by mating with the lock mechanism 737 of the port 735. The vial 720 preferably further includes a cap 723 in order to keep the sterile condition.

Drug preparation in the kit product 700 according to the present embodiment will now be described. For example, the case of preparing 150 mg worth of the drug A will now be described. In this case, three vials 720 each containing 50 mg of the drug A may be used.

The three vials 720 each containing 50 mg of the drug A are mounted to three of the ports 735 of the drug-holding unit 730 illustrated in FIG. 29a. Specifically, the cap 723 of the vial 720 is firstly removed and then the cap 733 of the port 735 is removed. Then, the vial 720 is mounted to the port 735 through screwing. Moreover, the lock mechanism 727 is mated with the lock mechanism 737, thereby fixing to each other.

At this time, the rubber stopper 725 of the vial 720 is pushed by the convex portion 736 of the port 735 into the inside of the vial 720, thereby bringing the inside of the vial 720 into communication with the inside of the drug-holding unit 730. It may be said that the transfer of the rubber stopper 725 corresponds to the opening of the sealing portion of the drug-enclosing portion. The above procedure is performed for the three vials 720 each containing 50 mg of the drug A. As illustrated in FIGS. 29a and 29b, the port 735 to which the vial 720 is not mounted may be present in the drug preparation.

Then, the connecting portion 730x of the drug-holding unit 730 and the connecting portion 710x of the bag 710 are connected to each other. The connecting portion 730*x* and the connecting portion 710*x* are connected using the above-described connecting member 800 in the same manner as when the connecting portion 570*x* and the connecting portion 510*x* are connected to each other in the kit product 500 according to the fifth embodiment described above. It may be said that the connection of the connecting portion 730*x* and the connecting portion 710*x* corresponds to the connection of the drug-enclosing portion (vial 720) and the bag 710 and that the connection of the connecting portion 730*x* and the connecting portion 710*x* corresponds to the opening of the sealing portion (rubber member 730*x*2). The drug-enclosing portion (vial 720) and the bag 710 may be connected to each other before the sealing portion (rubber stopper 725, rubber member 730*x*2) is opened, the sealing portion (rubber stopper 725, rubber member 730*x*2) may be opened before the drug-enclosing portion (vial 720) and the bag 710 are connected to each other, or the sealing portion (rubber stopper 725, rubber member 730*x*2) may be opened at the same time when the drug-enclosing portion (vial 720) and the bag 710 are connected to each other. The phrase "the drug-enclosing portion (vial 720) and bag 710 are connected to each other" means that the vial 720 is connected to the bag 710.

Then, the kit product 700 is lifted up, for example, so that the bag 710 is upper and the drug-holding unit 730 is lower. As a result, the liquid 10*a* in the bag 710 is transferred from the bag 710 to the inside of each vial 720 through the needle member 820, thereby obtaining the drug liquid prepared from the drug A contained in each vial 720 and the liquid 10*a*. Then, the kit product 700 is lifted up so that the vial 720 is upper and the bag 710 is lower. As a result, the drug liquid is transferred to the bag 710 through the inside of the drug-holding unit 730 and the needle member 820. It may be said that the transfer of the drug liquid to the bag 710 corresponds to that the drug is charged into the bag 710 and prepared.

Thus, the drug preparation work requiring the dose adjustment can be performed without exposing the drug A to the outside air, that is, without a risk of exposure while preventing exposure to the drug A which may affect human body thereby conveniently producing the predetermined dose of the drug liquid.

The kit product 700 includes the required number of special vials each enclosing a drug and coupled to one another for the drug preparation, which is economical because the need of disposal of the drug is eliminated.

When the number of the ports 735 in the kit product according to the present embodiment is increased, the drug-holding unit 730 is increased in size and complicated in structure. Therefore, the number of the ports 735 is preferably small.

However, when the number of the ports 735 is decreased, many standards of the vials 720 need to be prepared. Note that, the standards of the vials 720 mean types of amounts of a drug to be enclosed in the vials 720 (e.g., 1 mg, 5 mg, and 10 mg).

For example, in the case where dosages of 1 mg to 10 mg of the drug are set in units of 1 mg, standards of 1 mg, 2 mg, 3 mg, 4 mg, 5 mg, 6 mg, 7 mg, 8 mg, 9 mg, and 10 mg are needed as the vials 720 in order to deal therewith using only one port 735. It is not economical to prepare many different standards of the vials 720 in stock.

Taking such a circumstance into consideration, the number of the ports 735 is preferably 2 to 5, more preferably 3 to 4. This is not limited to the kit product according the present embodiment, but the same applies to the kit products in which one vial is mounted to one port.

For example, in the case where dosages of 1 mg to 10 mg of the drug are set in units of 1 mg, only five standards of 1 mg, 2 mg, 3 mg, 4 mg, and 5 mg of vials 720 have to be prepared in order to deal therewith using two ports 735. Only three standards of 1 mg, 3 mg, and 5 mg; 1 mg, 2 mg, and 5 mg; or 1 mg, 2 mg, and 4 mg of vials 720 have to be prepared in order to deal therewith using three ports 735. Only three standards of 1 mg, 2 mg, and 3 mg of vials 720 have to be prepared in order to deal therewith using four ports 735. Only two standards of 1 mg and 2 mg of vials 720 have to be prepared in order to deal therewith using five ports 735.

Eighth Embodiment

Figure 30:
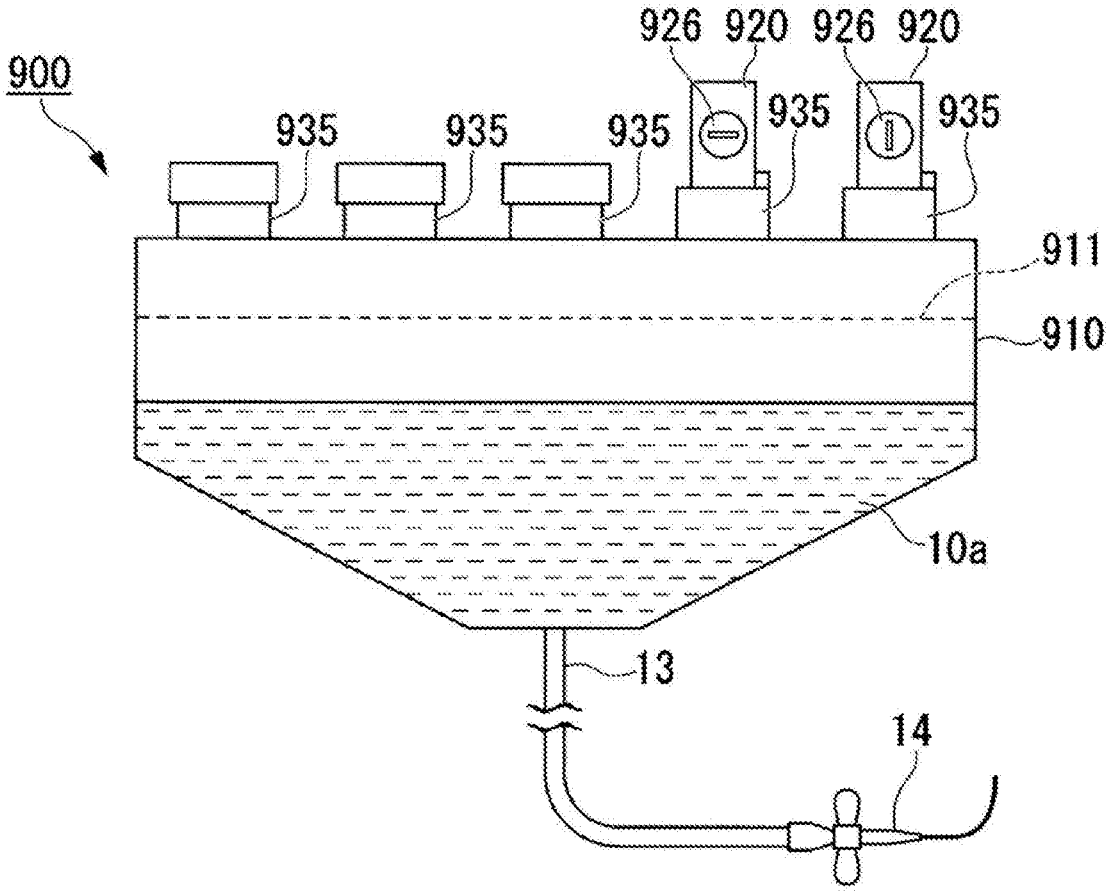
FIG. 30 is a view illustrating one exemplary essential-part configuration of a kit product according to the eighth embodiment.

A configuration of a kit product according to the eighth embodiment will now be described. FIG. 30 is a view illustrating one exemplary essential-part configuration of a kit product 900. The kit product 900 includes the required number of special vials each enclosing a drug and coupled to one another for the drug preparation.

Figure 31A:
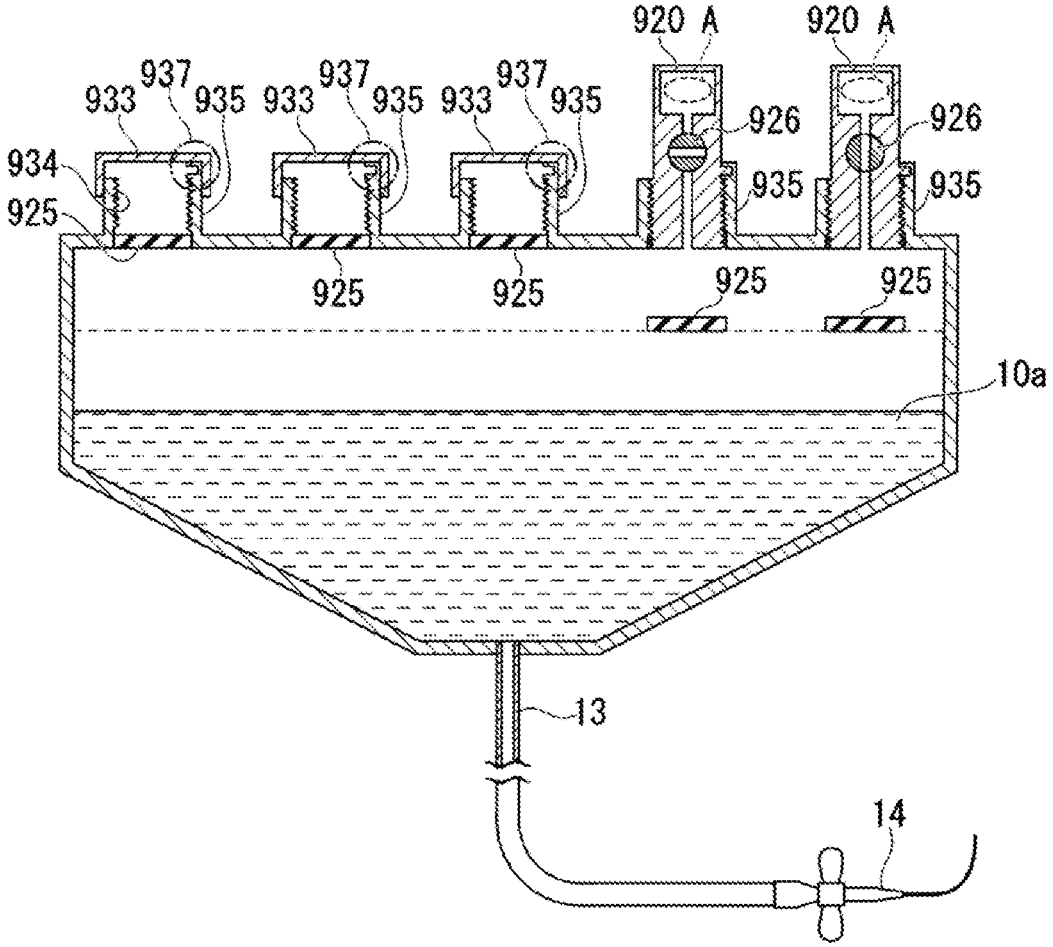
FIG. 31*a* is a view illustrating a cross-sectional structure of FIG. 30.
Figure 31B:
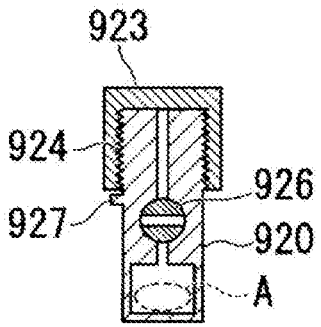
FIG. 31*b* is a view illustrating a cross-sectional structure of a vial.

The kit product 900 includes a bag 910 enclosing the liquid 10*a*, a net 911 configured to hold a rubber stopper 925 described below, at least one vial (drug-enclosing portion) 920 enclosing the drug and including a sealing portion (two-way cock 926) described below, and a port 935 configured to connect to the vial 920. As illustrated in FIG. 30, the kit product 900 may further include the tube for intravenous drip 13 and the injection needle 14. FIG. 31*a* is a cross-sectional view of FIG. 30. FIG. 31*b* is a cross-sectional view illustrating a structure of the vial 920. In FIG. 30, the bag 910 includes five ports 935, but the number of the ports is not limited to five.

The port 935 includes a screw portion 934 configured to mount the vial 920 through screwing, a lock mechanism 937 configured to fix the thus-mounted vial 920, and the rubber stopper 925. The rubber stopper 925 may be said as the sealing portion. The rubber stopper 925 drops into the inside of the bag 910 when the vial 920 is mounted thereto. This allows an inside of the vial 920 to be brought into communication with the inside of the bag 910. The rubber stopper 925, which has been dropped into the inside of the bag 910, is held on the net 911. The port 935 preferably further includes a cap 933 in order to keep the sterile condition.

The predetermined dose of the drug A is enclosed in the vial 920. The drug A may be powder or a solution. In the example illustrated in FIGS. 31*a* and 31*b*, the drug A is powder.

The two-way cock 926 is disposed in the middle of a path leading to an opening of the vial 920 from the inside of the vial 920. As illustrated in FIG. 31*b*, the two-way cock 926 is closed and the drug A is sealed before the vial 920 is mounted to the port 935. The two-way cock 926 may be said as the sealing portion.

A screw portion 924 configured to mount the vial 920 to the port 935 through screwing and a lock mechanism 927 configured to fix the vial 920 which has been mounted to the port 935 are disposed adjacent to the opening on an outer surface of the vial 920. The lock mechanism 927 is fixed by mating with the lock mechanism 937 of the port 935. The vial 920 preferably further includes a cap 923 in order to keep the sterile condition.

Drug preparation in the kit product 900 according to the present embodiment will now be described. For example, the case of preparing 100 mg worth of the drug A will now be described. In this case, two vials 920 each containing 50 mg of the drug A may be used.

The two vials 920 each containing 50 mg of the drug A are mounted to two of the ports 935 of the bag 910 illustrated in FIGS. 30 and 31*a*. Specifically, the cap 923 of the vial 920 is firstly removed and then the cap 933 of the port 935 is removed. Then, the vial 920 is mounted to the port 935 through screwing. Moreover, the lock mechanism 927 is mated with the lock mechanism 937, thereby fixing to each other.

At this time, the rubber stopper 925 of the port 935 is pushed by the vial 920 to thereby drop into the inside of the bag 910. This allows the inside of the vial 920 to be brought into communication with the inside of the bag 910. The rubber stopper 925, which has been dropped into the inside of the bag 910, is held on the net 911. Then, the two-way cock 926 of the vial 920 is rotated to open, thereby bringing the inside of the vial 920 into communication with the inside of the bag 910. It may be said that the drop of the rubber stopper 925 and the rotation and opening of the two-way cock 926 corresponds to the opening of the sealing portion of the drug-enclosing portion.

The above procedure is performed for the two vials 920 each containing 50 mg of the drug A. The vial 920 mounted to the rightmost port 935 in FIG. 31*a* is illustrated in a state where the two-way cock 926 is opened. The vial 920 mounted to the second-rightmost port 935 in FIG. 31*a* is illustrated in a state where the two-way cock 926 has not opened yet. As illustrated in FIGS. 30 and 31*a*, the port 935 to which the vial 920 is not mounted may be present in the drug preparation.

Then, the kit product 900 is lifted up, for example, so that the bag 910 is upper and the vial 920 is lower. As a result, the liquid 10*a* in the bag 910 is transferred from the bag 910 to the inside of each vial 920, thereby obtaining the drug liquid prepared from the drug A contained in each vial 920 and the liquid 10*a*. Then, the kit product 900 is lifted up so that the vial 920 is upper and the bag 910 is lower. As a result, the drug liquid is transferred to the bag 910. It may be said that the transfer of the drug liquid to the bag 910 corresponds to that the drug is charged into the bag 910 and prepared.

Thus, the drug preparation work requiring the dose adjustment can be performed without exposing the drug A to the outside air, that is, without a risk of exposure while preventing exposure to the drug A which may affect human body, thereby conveniently producing the predetermined dose of the drug liquid.

The kit product 900 includes the required number of special vials each enclosing a drug and coupled to one another for the drug preparation, which is economical because the need of disposal of the drug is eliminated.

A relationship between the number of ports and the number of standards of the vial in the kit product according to the present embodiment is the same as in the kit product according to the seventh embodiment. That is, the number of the ports 935 is preferably 2 to 5, more preferably 3 to 4.

Ninth Embodiment

Figure 32:
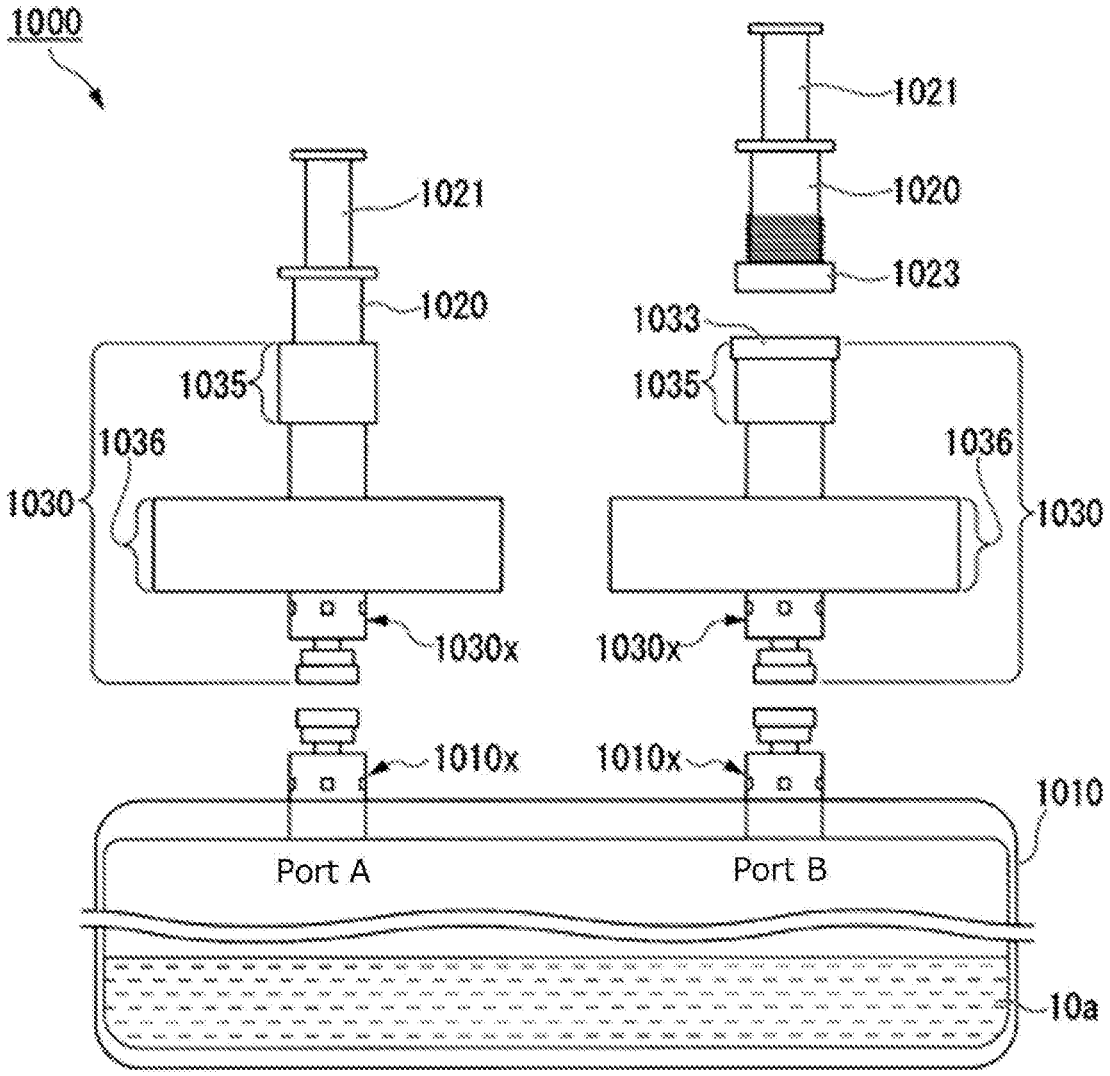
FIG. 32 is a view illustrating one exemplary essential-part configuration of a kit product according to the ninth embodiment.

A configuration of a kit product according to the ninth embodiment will now be described. FIG. 32 is a view illustrating one exemplary essential-part configuration of a kit product 1000. The kit product 1000 includes a bag 1010 enclosing the liquid 10*a*, a cylinder 1020 housing the drug, and a connecting member 1030 configured to connect the cylinder 1020 and the bag 1010 to each other. The bag 1010 includes a connecting portion 1010*x* configured to connect to the connecting member 1030. The connecting member 1030 includes a port 1035 configured to connect to the cylinder 1020, a connecting portion 1030*x* configured to connect to the bag 1010, and a chamber portion (administrated drug-containing portion) 1036 configured to open a drug package described below. The connecting portion 1010*x* and the connecting portion 1030*x* have the same structure as the connecting portion 510*x* or the connecting portion 570*x*, respectively, in the kit product 500 according to the fifth embodiment described above. In FIG. 32, the bag 1010 includes two connecting portions 1010*x*, i.e., ports A and B, but the number of the ports is not limited to two.

Figure 33A:
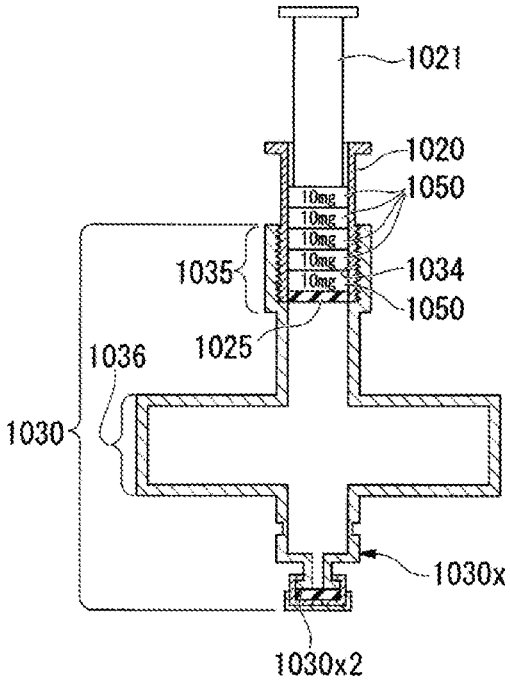
FIG. 33*a* is a cross-sectional view of a connecting member to which a cylinder has been connected.

FIG. 33*a* is a cross-sectional view of the connecting member 1030 to which the cylinder 1020 has been connected. The port 1035 includes a screw portion 1034 configured to mount the cylinder 1020 through screwing. The port 1035 preferably further includes a cap 1033 before the cylinder 1020 is connected thereto in order to keep the sterile condition.

The cylinder 1020 includes a rubber stopper 1025, a single or a plurality of drug packages 1050 enclosing the predetermined amount of the drug A, and a piston 1021. The drug package 1050 has a bag-like structure which can be opened (broken) by applying pressure (e.g., by fingers) and is configured to seal the drug A therein. The drug package 1050 may be said as the drug-enclosing portion. The drug package 1050 may also be said as the sealing portion configured to seal a drug. A material of the drug package 1050 is not limited as long as it is those commonly used for sealing a drug. Examples thereof include low-strength polypropylene. The drug A may be powder or a tablet. The cylinder 1020 preferably further includes a cap 1023 before being connected to the port 1035 in order to keep the sterile condition.

Drug preparation in the kit product 1000 according to the present embodiment will now be described. For example, the case of preparing 23 mg worth of the drug A will now be described. In this case, for example, the cylinder 1020, which contains the drug packages 1050 each containing 10 mg of the drug A, may be connected to the port A of the bag 1010 and the cylinder 1020, which contains the drug packages 1050 each containing 1 mg of the drug A, may be connected to the port B of the bag 1010.

First, the cap 1023 of the cylinder 1020 which contains the drug packages 1050 each containing 10 mg of the drug A is removed and then the cap 1033 of the port 1035 of the connecting member 1030 is removed. Then, the cylinder 1020 is mounted to the port 1035 through screwing.

Then, the connecting portion 1030*x* of the connecting member 1030 and the connecting portion 1010*x* of the port A of the bag 1010 are connected to each other. The connecting portion 1030*x* and the connecting portion 1010*x* are connected using the above-described connecting member 800 in the same manner as when the connecting portion 570*x* is connected to the connecting portion 510*x* in the kit product 500 according to the fifth embodiment described above.

Figure 33B:
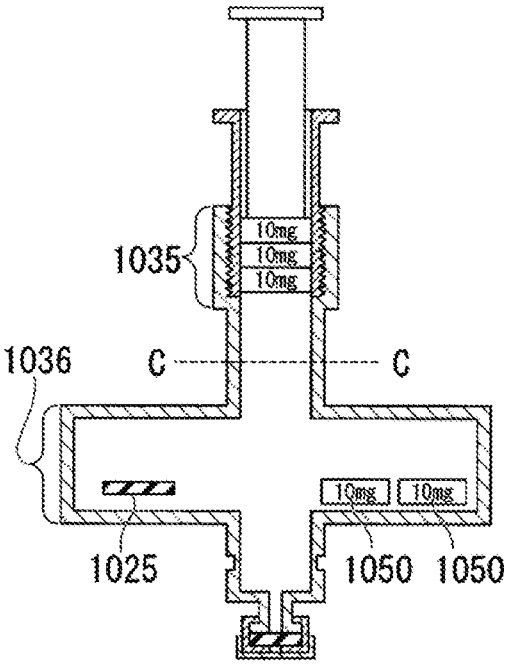
FIG. 33*b* is a view illustrating a state where two drug packages have been dropped into a chamber portion.

Then, the piston 1021 of the cylinder 1020 is pushed down. As a result, the rubber stopper 1025 is firstly dropped into a chamber portion 1036 of the connecting member 1030. The piston 1021 is further continued to be pushed down and stopped being pushed down at the time when two drug packages 1050 are dropped into the chamber portion 1036. FIG. 33*b* is a view illustrating a state where two drug packages 1050 have been dropped into the chamber portion 1036. It may be said that the dropping the drug package 1050 into the chamber portion 1036 and connecting the connecting portion 1030*x* and the connecting portion 1010*x* to each other corresponds to connecting the drug-enclosing portion (drug package 1050) and the bag 1010 to each other. It may also be said that connecting the connecting portion 1030*x* and the connecting portion 1010*x* to each other corresponds to opening the sealing portion (rubber member 1030*x*2). The drug package 1050 may be dropped into the chamber portion 1036 before the connecting portion 1030*x* and the connecting portion 1010*x* are connected to each other, the connecting portion 1030*x* and the connecting portion 1010*x* may be connected to each other before the drug package 1050 is dropped into the chamber portion 1036, or the drug package 1050 may be dropped into the chamber portion 1036 at the same time when the connecting portion 1030*x* and the connecting portion 1010*x* are connected to each other.

Then, a region between the port 1035 of the connecting member 1030 and the chamber portion 1036 is cut with the hot sealer, for example, along the line c-c in FIG. 33*b*. As a result, the cylinder 1020 and the connecting member 1030 are partially cut away. This makes it possible to seal the thus-produced cut section through heat sealing reliably. Therefore, the drug A is prevented from leaking outside (exposure). The cylinder 1020 containing the remaining drug package 1050 may be disposed or reused.

The cylinder 1020 which contains the drug packages 1050 each containing 1 mg of the drug A is connected to the port B of the bag 1010 in the same manner. Moreover, the same procedure as in the port A is also performed in the port B to thereby drop three drug packages 1050 each containing 1 mg of the drug A into the chamber portion 1036. Then, a region between the port 1035 of the connecting member 1030 and the chamber portion 1036 is cut with the hot sealer.

Figure 33C:
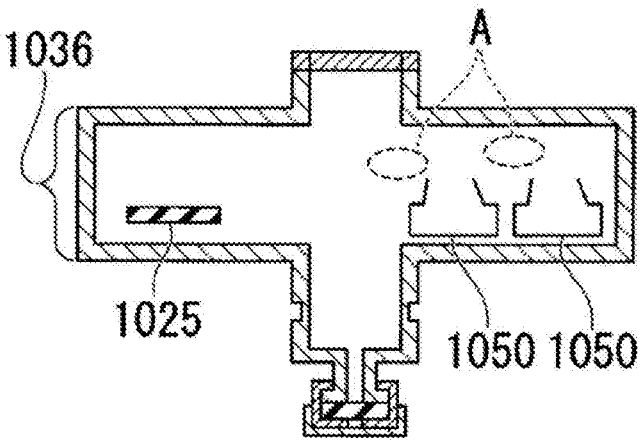
FIG. 33*c* is a view illustrating a state where the drug packages are opened.

Then, the drug packages 1050 are opened by applying pressure (e.g., by fingers) from outside of the chamber portion 1036. It may be said that opening the drug package 1050 corresponds to opening the sealing portion of the drug-enclosing portion. A material the chamber portion 1036 is not particularly limited as long as it is those commonly suitable for, for example, medical infusion solution bags. Examples thereof include high-strength polypropylene. FIG. 33*c* is a view illustrating a state where the drug package 1050 is opened within the chamber portion 1036 of the connecting member 1030 which has been connected to the port A of the bag 1010. The same procedure as in the port A is also performed in the port B.

Thus, two drug packages 1050 each containing 10 mg of the drug A and three drug packages 1050 each containing 1 mg of the drug A are opened to thereby release a total of 23 mg of the drug A into the chamber portion 1036.

Then, the kit product 1000 is lifted up so that, for example, the bag 1010 is upper and the chamber portion 1036 is lower. As a result, the liquid 10*a* in the bag 1010 is transferred from the bag 1010 to the inside of the chamber portion 1036, thereby obtaining the drug liquid prepared from the drug A released into the chamber portion 1036 and the liquid 10*a*. Then, the kit product 1000 is lifted up so that, for example, the chamber portion 1036 is upper and the bag 1010 is lower. As a result, the drug liquid is transferred to the bag 1010. It may be said that the transfer of the drug liquid to the bag 1010 corresponds to that the drug is charged into the bag 1010 and prepared.

Thus, the drug preparation work requiring the dose adjustment can be performed without exposing the drug A to the outside air, that is, without a risk of exposure while preventing exposure to the drug A which may affect human body, thereby conveniently producing the predetermined dose of the drug liquid.

Aspects which are any combination of subconfigurations of the above-listed embodiments are also encompassed within the present invention.

(Material of Each Member Constituting Kit Product)

For example, glass, rubber, polymers, and metal may be appropriately used as a material for each member constituting the kit product of each of the above-described embodiments.

<<Glass>>

For example, transparent and colorless glass, borosilicate glass, soda-lime glass, and hard glass may be used as the glass.

<<Rubber>>

For example, butyl rubber, isoprene-chlorobutyl rubber, halobutyl rubber (e.g., chlorinated butyl rubber and brominated butyl rubber), styrene-butadiene rubber, isoprene rubber (polyisoprene rubber), butadiene rubber (polybutadiene rubber), isopropylene rubber, ethylene-vinyl acetate copolymers, laminate rubber, and thermoplastic elastomer may be used as the rubber.

<<Polymer>>

For example, polyethylene, polystylene, polypropylene, polyethylene terephthalate, polyamide, acrylonitrile-butadiene-styrene (ABS), polycarbonate, polybutylene terephthalate, polypropylene-polyethylene-terephthalate, cyclic polyolefin resin, polyester, ethylene-vinyl acetate, fluorinated resin polymer, ethylene-vinyl alcohol copolymers, polymethyl pentene, ethylene-vinyl acetate copolymers, polyvinyl chloride, polyvinylidene chloride, poly-vinyl acetate, acrylic resins, polyethersulfone, cycloolefin polymers, cycloolefin polymers, and nylon 6 may be used as the polymers.

<<Metal>>

For example, stainless steel, aluminum, and aluminum laminate films may be used as the metal.

Each of the above materials may be used as a single material or two or more of the above materials may be used as a mixed material. For example, a mixed material of brominated butyl rubber and isoprene rubber may be used as the rubber and a blend material such as polypropylene-containing polyethylene may be used as the polymer.

(Additives which May be Included in Injections)

In kit product of each of the above-described embodiments, examples of additives which may be included in the infusion solution or the drug include ascorbic acid, L-aspartic acid, acetyltryptophan, sodium acetyltryptophan, L-alanine, gum arabic, powdered acacia, sodium hydrogen sulfite, sodium sulfite, L-arginine, L-arginine hydrochloride, alpha-thioglycerol, albumin, benzoic acid, sodium benzoate, benzyl benzoate, ammonia water, inositol, ursodeoxycholic acid, ethanol, ethylurea, ethylenediamine, edetate calcium disodium, disodium edetate, zinc chloride, aluminum chloride, potassium chloride, calcium chloride hydrate, stannous chloride, sodium chloride, magnesium chloride, hydrochloric acid, cysteine hydrochloride, L-histidine hydrochloride, meprylcaine hydrochloride, lidocaine hydrochloride, oleic acid, ethyl oleate, sodium oleate, quatresin, sodium caprylate, caldiamide sodium, calteridol calcium, carbazochrome sodium sulfonate hydrate, carmellose sodium, dried sodium sulfite, dried aluminum hydroxide gel, dried sodium carbonate, dilute hydrochloric acid, xylitol, citric acid hydrate, sodium citrate hydrate, disodium citrate, glycylglycine, glycine, glycerin, calcium gluconate hydrate, sodium gluconate, magnesium gluconate, monopotassium L-glutamate, sodium L-glutamate, L-glutamic acid, L-lysine, creatinine, cresol, m-cresol, chlorobutanol, crystalline sodium dihydrogenphosphate, gentisic acid ethanolamide, highly purified yolk lecithin, succinic acid, sesame oil, sodium chondroitin sulfate, acetic acid, zinc acetate, ammonium acetate, sodium acetate hydrate, sodium salicylate, zinc oxide, calcium oxide, diethanolamine, diethylenetriaminepenta-acetic acid, L-cystine, L-cysteine, dibutylhydroxytoluene, N,N-dimethylacetamide, calcium bromide, sodium bromide, tartaric acid, sodium L-tartrate, aluminum hydroxide, sodium hydroxide, refined olive oil, purified oleic acid, purified gelatin, refined soybean oil, refined soybean lecithin, refined white sugar, refined yolk lecithin, saline, gelatin, hydrolyzed gelatin, sorbitan fatty acid ester, sorbitan sesquioleate, D-sorbitol, D-sorbitol solution, soybean oil, taurine, sodium hydrogen carbonate, sodium carbonate hydrate, thioglycolic acid, sodium thioglycollate, potassium thiocyanate, sodium thiosulphate, sodium thiomalate, thimerosal, medium chain fatty acid triglyceride, water for injection, camellia oil, dextran 40, dextran 70, sodium desoxycholate, Calcium D-Saccharate, triethanolamine, trehalose, trometamol, sodium sulfoaldehydesulfoxylate, nicotinic acid amide, lactic acid, lactic acid-glycolic acid copolymers (1:1), lactic acid-glycolic acid copolymer (95:5) high molecular weight copolymers, lactic acid-glycolic acid copolymer (95:5) low molecular weight copolymers, sodium lactate liquid, lactose hydrate, urea, concentrated glycerin, white sugar, ethyl p-hydroxybenzoate, butyl parahydroxy-benzoate, propyl parahydroxy-benzoate, methyl parahydroxybenzoate, L-histidine, human serum albumin, 4-(2-hydroxyethyl)-1-piperazine-ethanesulfonic acid, N-hydroxyethyllactamide liquid, hydroxypropylcellulose, castor oil, glacial acetic acid, potassium pyrosulfite, sodium pyrosulfite, L-phenylalanine, phenoxyethanol, phenol, Phenol Red, butylhydroxyanisole, glucose, fluorescein sodium, procaine hydrochloride, protamine sulfate, propylene glycol, heparin sodium, benzalkonium hydrochloride, benzyl alcohol, benzethonium hydrochloride, polyoxyethylene hydrogenated castor oil 50, polyoxyethylene hydrogenated castor oil 60, polyoxyethylene sorbitan monolaurate, polyoxyethylene castor oil, polyoxyethylene (160) polyoxypropylene (30) glycol, polysorbate 20, polysorbate 80, formalin, Macrogol 300, Macrogol 400, Macrogol 600, Macrogol 4000, maltose hydrate, maleic acid, D-mannitol, sterile sodium hydrogen carbonate, dehydrated ethanol, tin(II) chloride anhydrous, anhydrous citric acid, anhydrous sodium acetate, anhydrous sodium carbonate, sodium pyrophosphate dehydrate, maleic anhydride, dibasic sodium phosphate anhydride, monobasic sodium phosphate anhydride, meglumine, sodium metasulfobenzoate, methanesulfonic acid, DL-methionine, L-methionine, L-methionine, monoethanolamine, peanut oil, L-lysine monohydrochloride, lidocaine, sulfuric acid, aluminum potassium sulfate hydrate, potassium sulphate, magnesium sulfate hydrate, phosphoric acid, dibasic sodium phosphate heptahydrate, trisodium phosphate, dibasic sodium phosphate hydrate, dipotassium phosphate, potassium dihydrogenphosphate, sodium dihydrogenphosphate hydrate, and L-leucine.

(Standard of Drug-Enclosing Portion)

Some of the anti-cancer agents need to be dose-adjusted. For example, in the case of taxol, the dosage thereof shall be 80 mg/m$^2$ (C method). The "80 mg/m$^2$" means that 80 mg is administered per 1 m$^2$ of body surface area.

There are various calculation methods for body surface area. For example, when using Fujimoto method, it is calculated as follows: Body surface area (m$^2$)=Body weight (kg)$^{0.444}$×Height (cm)$^{0.663}$×0.008883. In the case of the height of 170 cm and the body weight of 80 kg, the body surface area is calculated as 1.908 m$^2$ according to the calculation formula. Therefore, in this case, a dosage is 152.64 mg. However, taking the daily variation of the body weight of ±0.5 kg into consideration, the significant figures of the body weight are the first two digits at most. Therefore, the significant figures of the dosage are also the first two digits and the dosage is 150 mg.

For the taxol, vials of 30 mg and 100 mg are commercially available. That is, the taxol is supplied in standards of 30 mg and 100 mg. Therefore, when 150 mg of the taxol is administered, one vial of 100 mg and two vials of 30 mg should be purchased. The whole amount of one vial of 100 mg and one vial of 30 mg are administered and 20 mg of the taxol is administered from the remaining one vial of 30 mg.

Specifically, a dissolution liquid is injected into the vial of 30 mg via injection to thereby dissolve the whole amount of the taxol. Among this, 20 mg is taken by a syringe into an infusion solution bag to thereby dissolve, which is administered. The remaining 10 mg is disposed in the Japanese market. Alternatively, it is used for another drug preparation within 1 hour to 6 hours or otherwise disposed in the United States market. This is conventional dose adjustment.

In the conventional dose adjustment method, a drug which is not needed to be administered (also referred as a residual drug, corresponds to 10 mg worth of the vial of 30 mg in the above case) is also dissolved in the dissolution liquid. This shortens a storage period and disposal of expensive drug is unavoidable. Therefore, anti-cancer agents are difficult to form into kit products especially in the United States.

In one embodiment, the present invention provides a kit product supplied in at least one standard selected from 10 mg, 20 mg, 30 mg, 40 mg, 50 mg, 100 mg, 200 mg, 300 mg, 400 mg, and 500 mg.

In this case, for example, when 150 mg of the drug is administered, one vial of 100 mg and one vial of 50 mg are used for the kit product described above. For example, when 370 mg of the drug is administered, one vial of 300 mg, one vial of 50 mg, and one vial of 20 mg are used for the kit product described above.

Thus, the anti-cancer agents which need to be dose-adjusted can be formed into kit products by supplying the drug-enclosing portion (vial) in at least one standard selected from 10 mg, 20 mg, 30 mg, 40 mg, 50 mg, 100 mg, 200 mg, 300 mg, 400 mg, and 500 mg. Moreover, a necessary and sufficient amount of the drug is used for the kit product, which prevents the residual drug from occurring.

This is not limited to the anti-cancer agents, but is able to be applied to any drug which needs to be dose-adjusted. When the drug which needs to be dose-adjusted is formed into the kit product, the drug-enclosing portion may be, for example, supplied in at least one standard selected from 1 mg, 10 mg, and 100 mg. Alternatively, the drug-enclosing portion may be supplied in at least one standard selected from 0.001 mg, 0.01 mg, 0.1 mg, 1.0 mg, 10 mg, 100 mg, and 1,000 mg. There may be an embodiment in which the number of the drug-enclosing portions are two or more, and the drug-enclosing portions are supplied in at least one standard selected from 1x mg, 2x mg, 3x mg, 4x mg, and 5x mg and at least one standard selected from 10x mg, 20x mg, 30x mg, 40x mg, and 50x mg, where the x is any selected from 0.001, 0.01, 0.1, 1.0, 10, 100, and 1,000.

(Dose Adjustment Method)

In one embodiment, the present invention provides a dose adjustment method of a drug including determining, based on a dosage of the drug, a standard and the number of drug-enclosing portions to be used. In the dose adjustment method according to the present embodiment, the drug-enclosing portion may be supplied in at least one standard selected from 0.001 mg, 0.01 mg, 0.1 mg, 1.0 mg, 10 mg, 100 mg, and 1,000 mg. The dose adjustment method according to the present embodiment may include connecting the thus-determined standard and number of the drug-enclosing portion to the bag of the kit product described above.

The dose adjustment method according to the present embodiment is performed in the following manner. First, types and dosage regimens (administration methods and administration amounts) of the drug to be administered to patients are selected based on information such as symptoms, heights, body weights, ages, body surface areas, AUC (area under blood concentration curve), and Scr (serum creatinine) of the patients.

Then, the significant figures of the dosage of the drug and then an amount of the drug to be prepared are determined in the same manner as in the above-described example of the taxol. Then, the number of ports to be used of the kit product and standard and the number of the drug-enclosing portions (vials) are determined based on, for example, the standard of the drug supplied and the number of ports disposed in the kit product. Then, the drug-enclosing portion is connected to the port of the bag of the kit product to thereby prepare the drug. Thus, the drug can be dose-adjusted.

The number of drug-enclosing portions to be used can be determined based on the number of digits of significant figures of the dosage of the drug. For example, it may be the number of digits of significant figures of the dosage of the drug or greater.

REFERENCE SIGNS LIST

A, A1, A2, A2*a*, A3, A4, A4*a*, 91 . . . drug
A2*a*', A4*a*', 91*a* . . . drug (residual drug)
L1 . . . first cutting line
L2 . . . second cutting line
L3 . . . third cutting line
10, 62, 110, 510, 610, 710, 910, 1010 . . . bag
10A, 10B . . . bag for intravenous drip
10*a*, 110*a* . . . liquid
11 . . . surface
12 . . . back surface
13, 13A, 13B, 130 . . . tube for intravenous drip
14 . . . injection needle
15, 55, 56 . . . drug liquid
16, 926 . . . two-way cock
20, 60, 120, 420, 421, 422, 423, 424, 520 . . . drug-enclosing portion
21 . . . first enclosing portion
21*b*, 22*b*, 23*b*, 24*b*, 470*a* . . . bottom portion
22 . . . second enclosing portion
22A, 22A', 24A, 24A' . . . region
22*a*, 24*a* . . . partition wall
23 . . . third enclosing portion
24 . . . fourth enclosing portion
30, 150, 153, 530 . . . sealing portion
31 . . . sealing section
32 . . . re-sealing section
40, 140, 440 . . . coupler
41, 441 . . . first coupler
41*a*, 455, 510*x*5, 570*x*5, 671, 672, 723, 733, 825, 923, 933, 1023, 1033 . . . cap
42, 442 . . . second coupler
43, 443 . . . third coupler
44, 121, 122, 151, 152 . . . tube
50, 51 . . . intravenous drip device
61 . . . administrated drug-containing portion
63 . . . first sealing portion
64 . . . second sealing portion
90, 190 . . . drug plate
90A . . . first plate portion
90*a*, 190*a* . . . drug-housing portion
90B . . . second plate portion
90C . . . third plate portion
90D . . . fourth plate portion
92 . . . third plate portion 90C and fourth plate portion 90D before transfer
100, 200, 300, 400, 500, 600, 700, 900, 1000 . . . kit product
120*a* . . . cylinder portion
120*b* . . . piston portion
120*c*. 820 . . . needle member
130*a*, 141*a*, 439 . . . internal flow channel
131 . . . seal member
132, 510*x*4, 570*x*4, 625, 635 . . . through hole
141, 450, 470, 621 . . . body portion
142, 158, 510*x*, 570*x*, 610*x*, 630*x*, 710*x*, 730*x*, 1010*x*, 1030*x* . . . connecting portion
143 . . . engaging frame portion
146 . . . flow channel-switching handle
143*a* . . . opening
144 . . . outlet for drug liquid
145 . . . hook portion
153*a*, 153*b*, 530*a*, 530*b* . . . grip portion
154 . . . water absorptive polymer
155 . . . outer cylinder portion
156*a*, 156*b*, 510*x*2, 570*x*2, 630*x*2, 730*x*2, 1030*x*2 . . . rubber member
157 . . . fastener
400' . . . container
439*a* . . . first flow channel
439*b* . . . second flow channel
451 . . . first connecting portion
452 . . . second connecting portion
453 . . . third connecting portion
454, 800, 1030 . . . connecting member
454*a*, 477 . . . flow channel
456, 476, 623 . . . concave portion
456*a*, 478 . . . movable rubber stopper
460, 633, 736 . . . convex portion
461 . . . holding member
461*a*, 470*b* . . . notch
463, 475 . . . lid portion
474 . . . flow channel-forming member
510*x*1, 570*x*1 . . . vial body portion
510*x*1*a*, 570*x*1*a* . . . notch portion
510*x*3, 570*x*3, 830, 840 . . . fixing member
510*x*3*a*, 570*x*3*a* . . . peripheral edge portion
620, 720, 920 . . . vial
622 . . . guide portion
624 . . . lid body member
627, 637, 727, 737, 927, 937 . . . lock mechanism
630, 630*a* . . . coupling member
631, 810 . . . supporting member
634, 636 . . . tubular member
724, 734, 924, 934, 1034 . . . screw portion
725, 925, 1025 . . . rubber stopper
735, 935, 1035 . . . port
730 . . . drug-holding unit
911 . . . net
1020 . . . cylinder
1021 . . . piston
1036 . . . chamber portion
1050 . . . drug package

The invention claimed is:

1. A kit product (100) for providing a dosed fluid for a patient, the kit product (100) comprising:

a bag (10) which contains an infusion solution or pure water; and a plurality of drug-enclosing portions (20), with each drug-enclosing portion (20) providing a volume within which a drug (A) is enclosed, and each drug-enclosing portion (20) comprises a sealing portion (30) retaining the respective drug (A) within the respective drug-enclosing portion (20), with each sealing portion (30) connecting the drug-enclosing portion (20) with the bag (10), each respective sealing portion (30) being constructed to be openable to allow the respective drug (A) within the respective drug-enclosing portion (20) to move toward the bag (10), with a number of sealing portions (30) being opened to allow the respective drug (A) within the respective number of the drug-enclosing portions (20) to move toward the bag (10) as a selection of dose adjustment of the drug (A) into the bag (10), and each respective sealing portion (30) being constructed to retain the respective drug (A) within the respective drug-enclosing portion (20) and to permit complete detachment along the sealing portion (30) of the respective drug-enclosing portion (20) from the bag (10) so as to permit removal of any of the drug-enclosing portions (20) from the bag (10), with the respective drug (A) enclosed therein, that are not within the respective number of the drug-enclosing portions (20) that have the respective sealing portions (30) opened for selection of dose adjustment of the drug (A) into the bag (10), and with the bag (10) and contents therein, including the drug (A) as the dose adjustment from the respective number of the drug-enclosing portions (20), remaining for operable use for the patient.

2. The kit product (100) according to claim 1, wherein the drug-enclosing portions (20) are provided comprising at least one standard selected from the group consisting of 1x mg, 2x mg, 3x mg, 4x mg, and 5x mg and/or in at least one standard selected from the group consisting of 10x mg, 20x mg, 30x mg, 40x mg, and 50x mg, where the x is any selected from the group consisting of 0,001, 0.01, 0.1, 1.0, 10, 100, and 1,000.

3. The kit product (100) according to claim 1, wherein the drug-enclosing portions (20) are provided comprising at least one standard selected from the group consisting of 0.001 mg, 0.01 mg, 0.1 mg, 1.0 mg, 10 mg, 100 mg, and 1,000 mg.

4. The kit product (100) according to claim 1, wherein the drug-enclosing portions (20) are provided comprising at least one standard selected from the group consisting of 10 mg, 20 mg, 30 mg, 40 mg, 50 mg, 100 mg, 200 mg, 300 mg, 400 mg, and 500 mg.

5. The kit product (100) according to claim 1, wherein the drug (A) comprises an anti-cancer agent or an antibody agent needed to be dose-adjusted.

6. A dose adjustment method of a drug (A), the method comprising:

preparing the kit product (100) of claim 1, wherein the step of preparing the kit product (100) comprises the step of determining, based on a dosage of the drug, a standard and the number of a drug-enclosing portions (20) to be used.

7. A drug container obtained by the method according to claim 6.

8. The dose adjustment method according to claim 6, wherein the method comprises connecting the drug-enclosing portion (20) in the determined standard and number with the bag (10) of the kit product (100).

9. The dose adjustment method according to claim 6, wherein the number of the drug-enclosing portions (20) to be used is determined based on the number of significant digits of the dose of the drug (A).

10. The dose adjustment method according to claim 9, wherein the number of the drug-enclosing portions (20) to be used is equal to or greater than the number of significant digits of the dose of the drug (A).

11. An intravenous drip device (50, 51) containing the kit product (100) of claim 1, further comprising a tube for intravenous drip (13, 13A, 13B, 130) connected to the bag (10).

* * * * *